US008707867B2

(12) United States Patent
Uhr

(10) Patent No.: US 8,707,867 B2
(45) Date of Patent: Apr. 29, 2014

(54) DRILL CARTRIDGES, ADAPTORS AND METHODS FOR MULTI-CALIBER DRILL CARTRIDGE TRAINING

(71) Applicant: Oren Louis Uhr, Rishon le-Zion (IL)

(72) Inventor: Oren Louis Uhr, Rishon le-Zion (IL)

( * ) Notice: Subject to any disclaimer, the term of this patent is extended or adjusted under 35 U.S.C. 154(b) by 0 days.

(21) Appl. No.: 13/932,036

(22) Filed: Jul. 1, 2013

(65) Prior Publication Data

US 2013/0295527 A1 Nov. 7, 2013

Related U.S. Application Data

(63) Continuation of application No. 13/190,135, filed on Jul. 25, 2011, now Pat. No. 8,584,587, which is a continuation-in-part of application No. 13/008,234, filed on Jan. 18, 2011, said application No. 13/190,135 is a continuation-in-part of application No. 13/106,842, filed on May 12, 2011, now Pat. No. 8,568,143.

(60) Provisional application No. 61/296,045, filed on Jan. 19, 2010, provisional application No. 61/334,203, filed on May 13, 2010.

(51) Int. Cl.

| | |
|---|---|
| ***F42B 8/00*** | (2006.01) |
| ***F42B 8/08*** | (2006.01) |
| ***F42B 8/10*** | (2006.01) |

(52) U.S. Cl.

CPC .... *F42B 8/08* (2013.01); *F42B 8/10* (2013.01)
USPC ..... 102/444; 102/446; 42/134

(58) Field of Classification Search

USPC ..... 102/446, 444; 42/134
See application file for complete search history.

(56) References Cited

U.S. PATENT DOCUMENTS

| | | | | |
|---|---|---|---|---|
| 6,742,299 | B2 * | 6/2004 | Strand | 42/134 |
| 8,430,035 | B2 * | 4/2013 | Ducastel, Jr. | 102/444 |
| 2001/0008107 | A1 * | 7/2001 | Hunt | 102/444 |
| 2002/0129536 | A1 * | 9/2002 | Iafrate et al. | 42/134 |
| 2010/0305261 | A1 * | 12/2010 | Maljkovic et al. | 524/521 |
| 2012/0224387 | A1 * | 9/2012 | Moore | 362/553 |

* cited by examiner

*Primary Examiner* — J. Woodrow Eldred
(74) *Attorney, Agent, or Firm* — Law Office of Arthur M. Antonelli, PLLC

(57) ABSTRACT

A caliber specific drill cartridge and an adaptor assembly for transforming the caliber specific drill cartridge for use in a first firearm chamber into a caliber specific drill cartridge assembly for use in a second firearm chamber. The adaptor assembly may include a drill cartridge having a first central axis, a rear casing, and a front casing with a first maximum outer dimension perpendicular to the first central axis. The front casing may be connected to the rear casing such that the front and rear casings cooperate to form a housing, which may be configured and dimensioned for chambering in a first firearm chamber. The adaptor assembly further may include a cartridge specific adaptor with a second central axis. The drill cartridge and the cartridge specific adaptor may be combined such that the adaptor assembly is configured and dimensioned for chambering in a second firearm chamber.

14 Claims, 36 Drawing Sheets

DRILL CARTRIDGES, ADAPTORS AND METHODS FOR MULTI-CALIBER DRILL CARTRIDGE TRAINING

CROSS REFERENCE TO RELATED APPLICATIONS

This application is a continuation of U.S. patent application Ser. No. 13/190,135 filed on Jul. 25, 2011. U.S. patent application Ser. No. 13/190,135 filed on Jul. 25, 2011 is a continuation-in-part of U.S. patent application Ser. No. 13/008,234 filed on Jan. 18, 2011, which claims the benefit of U.S. patent application Ser. No. 61/296,045 filed on Jan. 19, 2010. Also, U.S. patent application Ser. No. 13/190,135 filed on Jul. 25, 2011 is a continuation-in-part of U.S. patent application Ser. No. 13/106,842 filed on May 12, 2011, which claims the benefit of U.S. patent application Ser. No. 61/334,203 filed on May 13, 2010.

The entire disclosure of each of the U.S. patent applications mentioned in the preceding paragraph is incorporated by reference herein.

FIELD OF THE INVENTION

The present invention generally relates to devices and methods for simulating live fire training for a wide variety of handheld firearms, as well as for a wide variety of air guns or gaming systems. More particularly, this invention relates to caliber specific drill cartridges and a system of mechanical components for use with the drill cartridge, which selectively allow a user to simulate the profile of a wide variety of ammunition, which enables use of the drill cartridge in any of several firearms having a barrel assembly of differing calibers. Also, the present invention relates to a method of selectively transforming the profile of a drill cartridge for use in any of several firearms having a barrel assembly of differing calibers. Also, the present invention relates to a drill cartridge that is configured for service in a 9 mm pistol and a .223 caliber rifle. The present invention further relates to a drill cartridge that is adapted for use in a revolver.

BACKGROUND

Dry fire training—repeated drawing, aiming and firing without ammunition—is a practical and convenient way to improve and/or maintain shooting techniques. The practice is limited, however, by the fact that the bullet impact point is a mere assumption; thus the trainees and/or trainers are limited in their ability to evaluate the trainees' performance and/or improve their skills. Furthermore, there has long existed the need for an apparatus and system whereby a single or multiple user, or trainer and trainee, can readily practice using a firearm without placing themselves or others at risk of accidental discharge of the firearm while still maintaining the ability to recognize the "hits." This safety imperative coincides with an added desire to limit the financial burden related to the wear and tear on a firearm, including cost of ammunition and use of adequate facilities brought about by live fire training. Although, caliber specific laser training devices have been developed to overcome the location restraints required for live fire training and enable an effective training alternative, a need exists for a shooting training aid that can be used in a variety of guns and training systems.

SUMMARY

Hence, the present invention is directed to a caliber specific drill cartridge and an adaptor assembly to transform the caliber specific drill cartridge for use in a first firearm chamber into a caliber specific drill cartridge assembly for use in a second firearm chamber.

In one aspect, the present invention relates to an adaptor assembly that may include a drill cartridge having a first central axis, a rear casing, and a front casing with a first maximum outer dimension perpendicular to the first central axis. The front casing may be connected to the rear casing such that the front and rear casings cooperate to form a housing, which may be configured and dimensioned for chambering in a first firearm chamber. The adaptor assembly further may include a cartridge specific adaptor with a second central axis. The cartridge specific adaptor may include a cylindrical member with second maximum outer diameter which includes a front end, a rear end, and a first passage extending from the rear end toward the front end. The first passage may be bound by a first inner surface. The cylindrical member further may include a second passage extending from the front end to the first passage. The second passage may be bound by a second inner surface. The cylindrical member further may include an end wall adjacent the second inner surface. The adaptor assembly may be a combination of the drill cartridge and the cartridge specific adaptor such that the end wall is disposed between the front casing and the rear casing, the second inner surface and the front casing which define an annular space, and the adaptor assembly is configured and dimensioned for chambering in a second firearm chamber. The end wall may connect the first inner surface and the second inner surface. The adaptor assembly further may include a first screw thread, and the rear casing may include a second screw thread. The first screw thread and the second screw thread may mate to secure the front casing to the rear casing. Additionally, the first inner surface may have a third screw thread, and the third screw thread and the first screw thread may mate to secure the cylindrical member to the front casing.

Another aspect of the present invention relates to adaptor assembly which may increases the effective length and effective diameter of the cartridge specific adaptor. In one embodiment, the adaptor assembly may increase the effective length of the cartridge specific adaptor by between approximately 0.1 mm and 10 mm. In a more preferred embodiment, the adaptor assembly may increase the effective length of the cartridge specific adaptor by between approximately 0.2 nm and 4.0 mm.

In another aspect, the present invention relates to a housing that may contain a plurality of internal components that cooperate with the housing to form a dry fire training device. The plurality of internal components may include a laser diode which is aligned with the first central axis. The laser diode may have an operable configuration which produces emissions of light having a predominant wavelength of about 650 nm. The plurality of internal components further may include a power supply. The plurality of internal components further include a control circuit for energizing the laser diode, a microcontroller for regulating emissions from the laser diode, and a capacitor electrically connected to the power supply and microcontroller such that the capacitor provides power to the microcontroller when the laser diode produces emissions of light having a predominant wavelength of between approximately 635 nm and 850 nm. In addition, the laser diode may have another operable configuration in which the laser diode produces emissions of light having a predominant wavelength of about 780 nm.

Another aspect of the invention relates to a retaining pipe secured to the front casing of the adaptor assembly. The assembly further may include a beveled fastener secured to the retaining pipe such that the beveled fastener, the retaining pipe, and the front casing are each aligned about the first central axis. The drill cartridge may be formed of stainless steel.

Another aspect of the invention relates to a drill cartridge having a rear end which may be configured and dimensioned to cooperate with a firearm cartridge extraction system such that the firearm cartridge extraction system biases the adaptor assembly into alignment with a central axis of the firearm barrel.

Another aspect of the invention relates to a method for transforming a caliber specific drill cartridge for use in a first firearm chamber into a caliber specific drill cartridge for use in a second firearm chamber of another caliber. The method may include providing a drill cartridge which comprises a first profile that is suitable for use in a first firearm chamber having a first caliber, providing a cartridge adaptor for connection to the drill cartridge, connecting the cartridge adaptor to the drill cartridge, and creating an assembly from the drill cartridge and cartridge adaptor such that the assembly has a second profile that is suitable for use in a second firearm chamber of another caliber.

Another aspect of the invention may relate to increasing the effective diameter of the drill cartridge and changing the effective length of the drill cartridge. Changing the effective length of the drill cartridge may increase the effective length of the drill cartridge. For example, changing the effective length may include increasing the effective length by approximately 0.5 mm to approximately 25 mm. In another example, changing the effective length may include increasing the effective length by approximately 1 mm to approximately 10 mm. In another example, changing the effective length may include increasing the effective length by approximately 2.7 mm to approximately 5 mm. In another example, changing the effective length may result in the drill cartridge assembly having an effective length of approximately 4.0 mm and an effective diameter of approximately 2.35 mm.

Another aspect of the present invention relates to separating the drill cartridge into a front casing and a rear casing, and securing the cartridge adaptor between the front casing and the rear casing. Securing the cartridge adaptor between the front casing and the rear casing further may include screwing the cartridge adaptor onto the rear end of the front casing. Securing the cartridge adaptor between the front casing and the rear casing may further include securing the rear casing onto the rear end of the front casing and fixing the rear casing against the cartridge adaptor.

Another aspect of the present invention relates to inserting a power source into the front casing. In yet another aspect, the present invention relates to emitting from the drill cartridge a first emission of light having a predominant wavelength of approximately 635 nm to 650 nm. In yet another aspect, the present invention relates to emitting from the drill cartridge a second emission of light having a predominant wavelength of approximately 780 nm to 850 nm.

DESCRIPTION OF THE DRAWINGS

The accompanying drawings, which are incorporated herein and constitute part of this specification, illustrate an embodiment of the invention, and together with the general description given above and the detailed description given below, serve to explain the features of the invention.

DESCRIPTION

Figure 1:
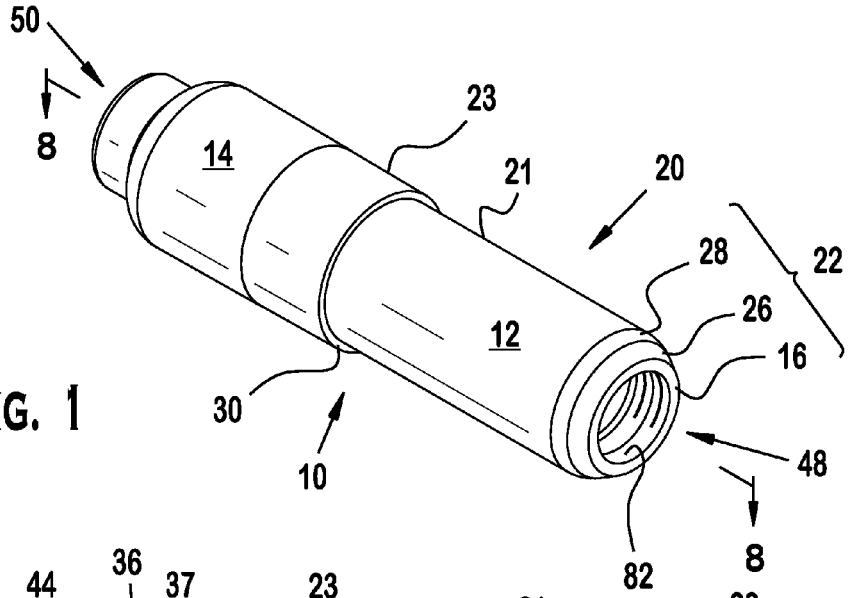
FIG. 1 shows a perspective view of an exemplary embodiment of the dry fire training device of the present invention.
Figure 2:
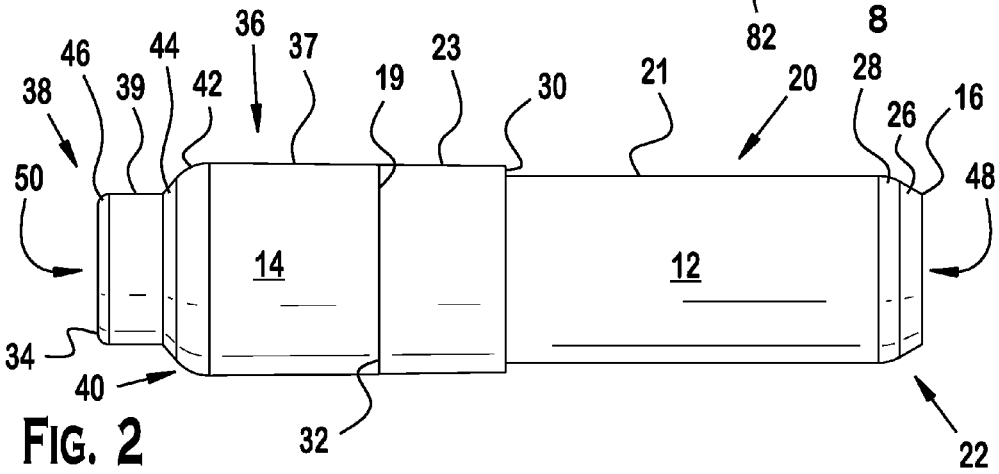
FIG. 2 shows a side view of the device of FIG. 1.

FIG. 1 presents an exemplary embodiment of a drill cartridge 10 of the present invention. In this embodiment, the drill cartridge is suitable for use in a 9 mm handgun. The drill cartridge may include a front casing 12 and a rear casing 14 which cooperate to form a housing for internal components of the drill cartridge.

Figure 8:
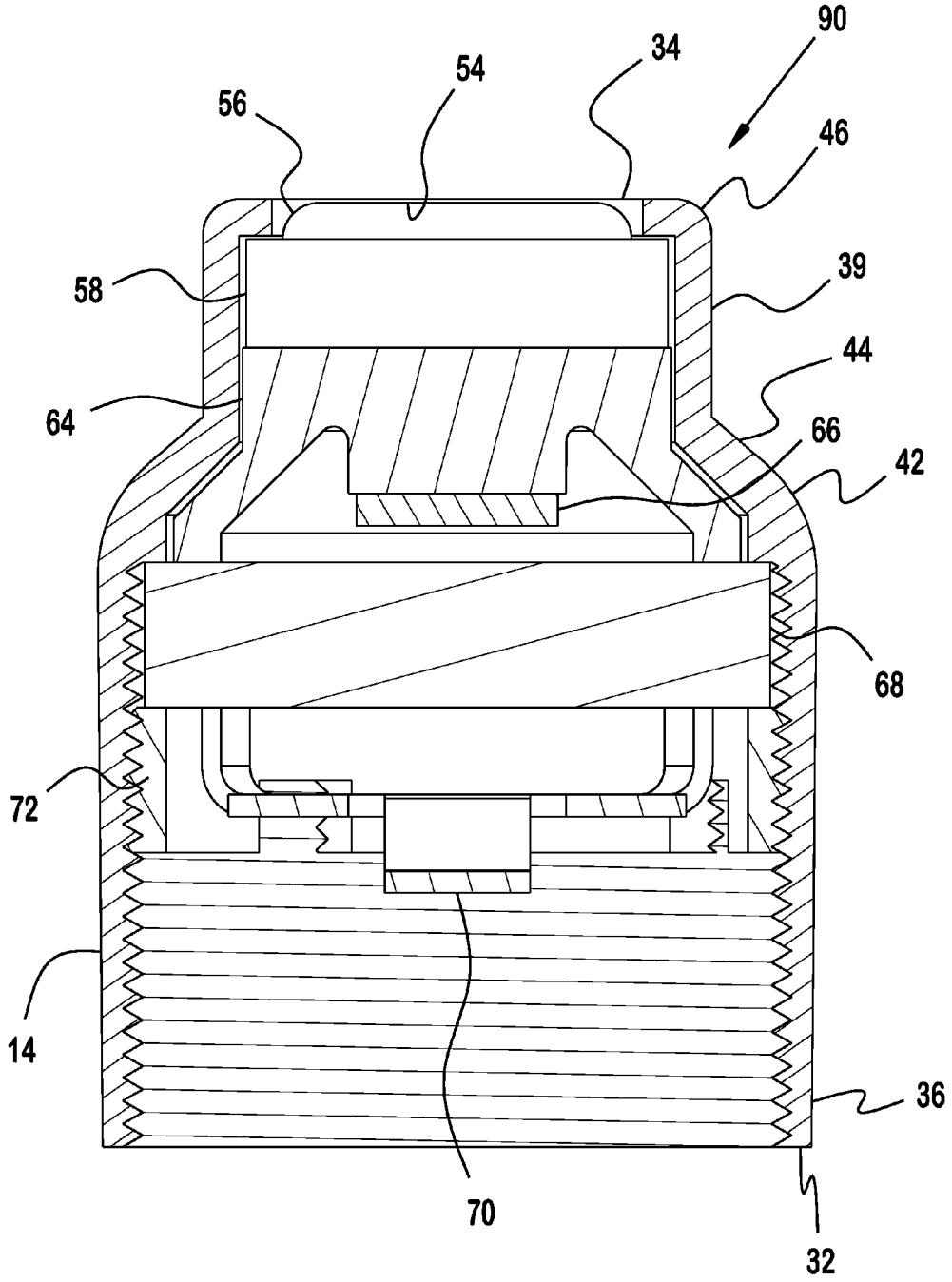
FIG. 8 shows a cross-sectional view of the rear housing and actuator components of the device of FIG. 7.
Figure 9:
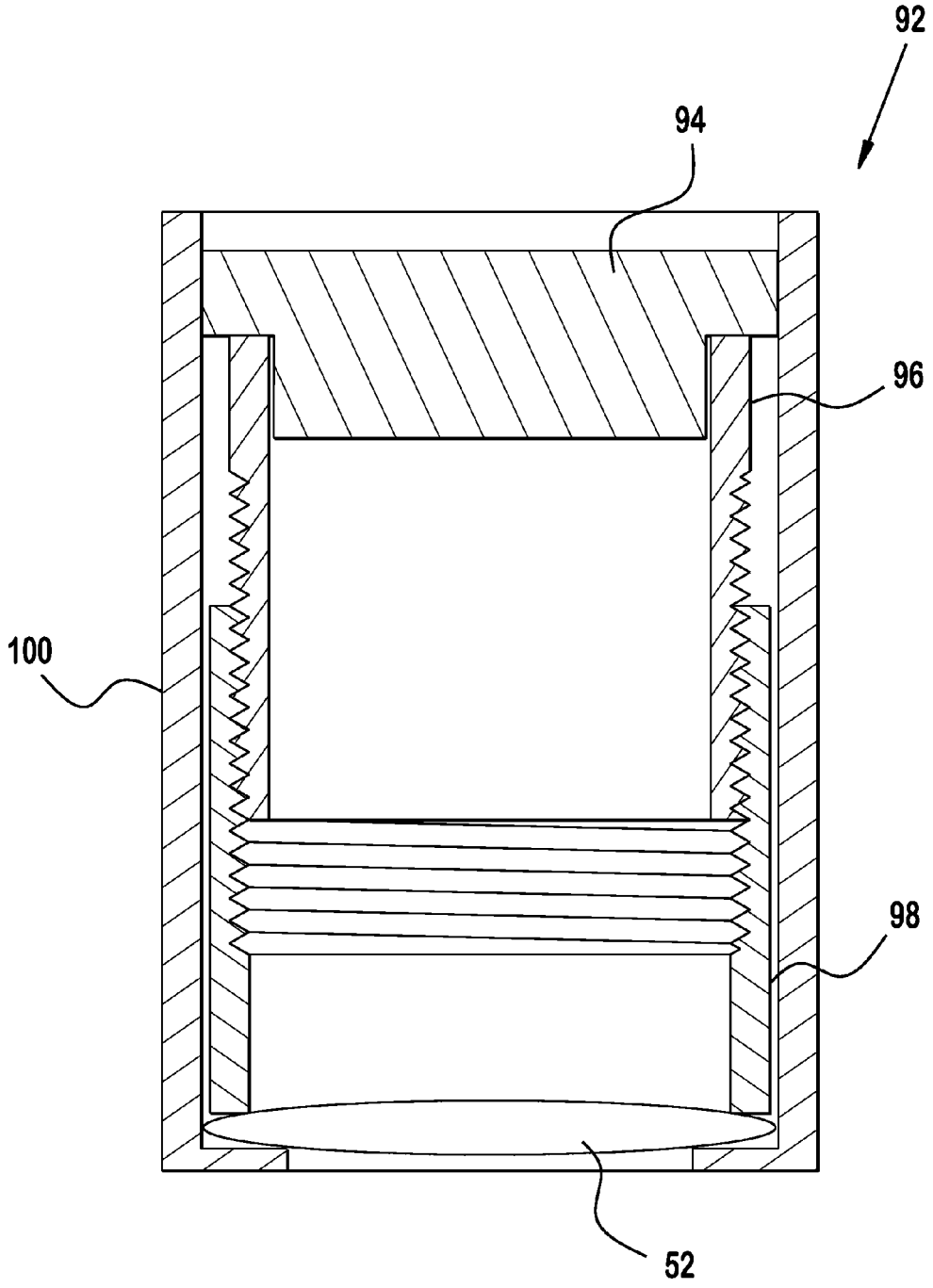
FIG. 9 shows a cross-sectional view of an exemplary illuminator for the device of FIG. 1.

Referring to FIGS. 5-9, the front casing 12 may have a leading edge 16 and a trailing edge 18 (See FIG. 9). The front casing may include a front section 22, intermediate section 20, and a rear section 24 (See FIG. 9). The front section 22 may include a front face 16 that defines a leading edge of the front casing, a leading side surface 26, and a front side transition surface 28. The intermediate section 20 of the front casing 12 may include a cylindrical portion 21 having generally uniform dimension. As shown in FIG. 9, the rear section may include another cylindrical portion 23 having generally uniform dimension and a rear projection 25 (See FIG. 9) of generally lesser outer dimension than the cylindrical portion 23. The rear projection 25 may further include a securing element 62 for connecting with the rear casing 14. For example, the securing mechanism 62 may be a screw thread that is disposed on the outside of the rear projection 25. The transition between the intermediate section 20 of the front casing and the rear section 24 of the front casing may include a surface 30 extending between the cylindrical portion 21 and the other cylindrical portion 23. The surface 30 may form an outer annular surface.

Figure 3:
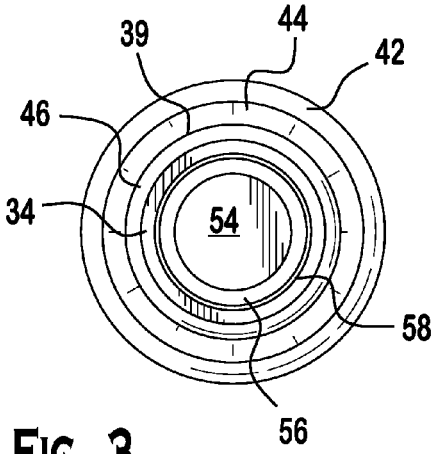
FIG. 3 shows a front view of the device of FIG. 1.

As shown in FIG. 3, the rear casing may be a series of cylindrical segments of varying diameter that are disposed between a leading end 32 (See FIG. 9) and a trailing end 34. For example, the rear casing may include a front section 36, a rear section 38, and an intermediate section 40. The front section 36 may include a generally cylindrical front segment 37 that increases in diameter from the leading end of the rear casing 32 to a point where the diameter reaches a maximum value. The intermediate section 40 may include the portion of the rear casing in which the outer diameter of the rear casing decreases from its widest point until reaching a rear cylindrical portion 39 of the casing having generally uniform dimension. For example, the intermediate section 40 may include a rear transition surface 42 and a rear tapered surface 44. The rear section 38 may include a generally circular cylindrical segment 39 until the diameter of the casing decreases over a rear trailing surface 46 that intersects the trailing end 34 of the rear casing.

Figure 6:
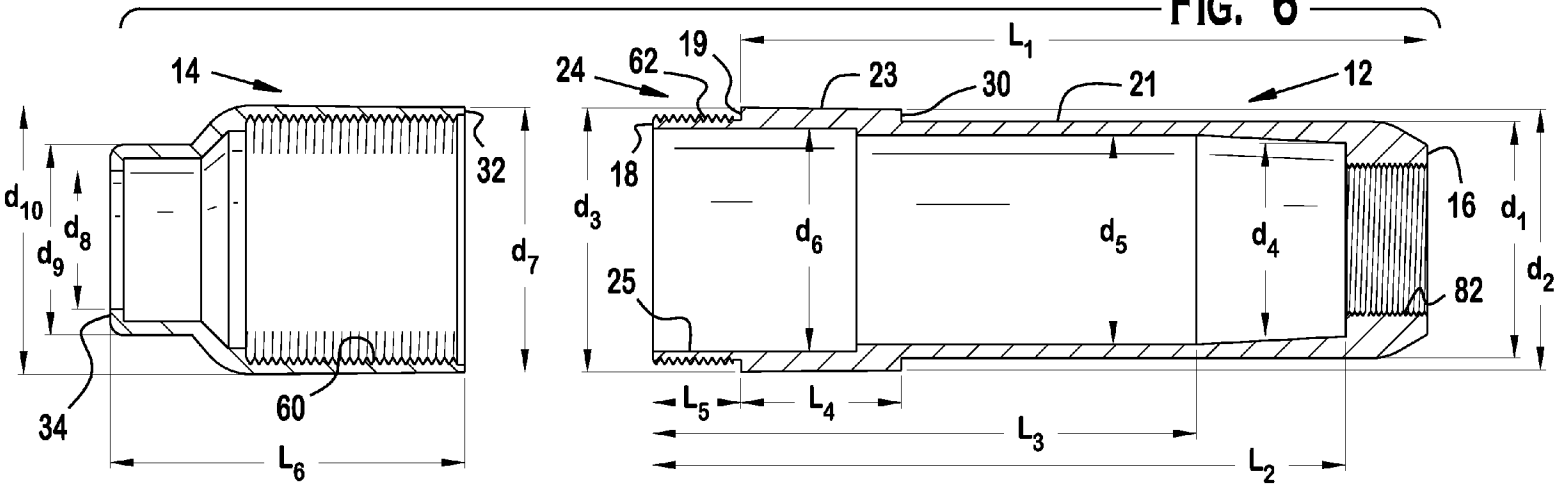
FIG. 6 shows an exploded view of the housing of FIG. 5.
Figure 7:
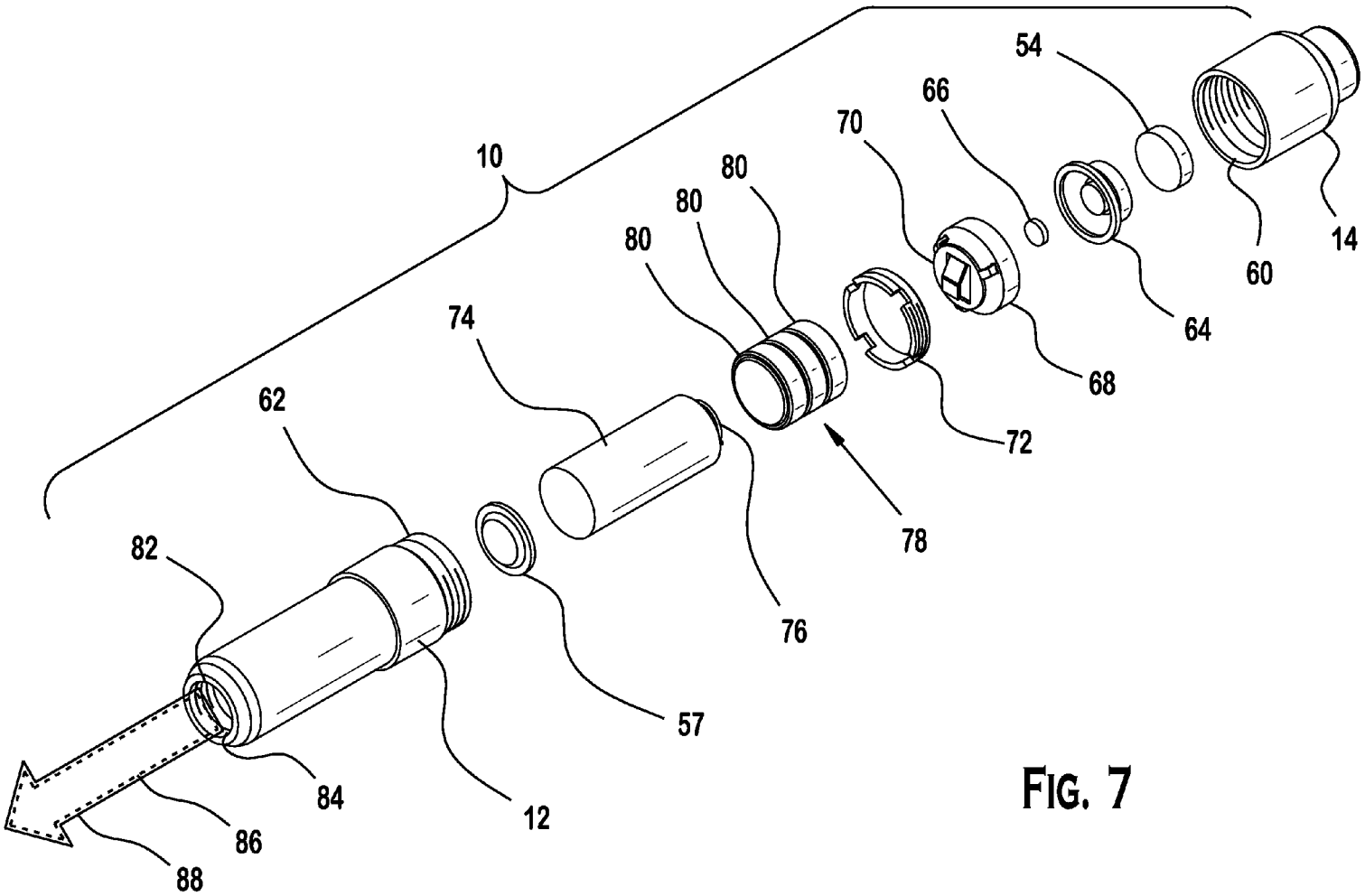
FIG. 7 shows an exploded view of the device of FIG. 1.

Referring to FIG. 6, the rear casing 14 may include a securing mechanism 60 which cooperates with the securing mechanism 62 on the front casing to securely connect the front casing 12 and rear casing 14 together. More particularly the securing mechanism 60 on the front section of the rear casing may be a screw thread which mates with the screw thread 62 on the outside of casing 12.

The housing formed by the front 12 and rear casings 14 may be used to contain components for various types of drill cartridges. For example, the housing may contain a collection of components (i.e., mechanical and/or electrical devices and chemical compounds and/or mixtures) such that the drill cartridge forms a blank ammunition cartridge. In another example, the housing may contain a collection of components such that the drill cartridge forms a non-lethal projectile training ammunition cartridge. For example, the drill cartridge may contain a primer, a charge, and a projectile that is filled with a colored marking compound (e.g., a paintball). In the preferred embodiment, the housing may contain components for a light emitting dry fire training device. For instance, the front and rear casing may cooperate to house a laser module, a power supply, a laser module activation system or other components. In a preferred embodiment, the drill cartridge 10 may house a light emitting dry fire training device as disclosed and described in co-pending patent application Ser. No. 13/008,234 filed on Jan. 18, 2011, which is incorporated by reference herein in its entirety.

Referring to FIGS. 5, 7, 8 and 9, certain internal components of the drill cartridge 10 may be housed within the front casing 12 and other internal components may be housed in the rear casing 14. For instance, these components may include a lens 57, a striking pad 54, an energy absorbing material 64, a conductive material 66, a control circuit 68, a control circuit bias 70, a securing element 72, an illuminator 74, a resilient member 76, a power supply 78 (which may include one or more batteries 80), an attachment element 82, and an attachment indicator 84. The dry fire training device may emit emissions of light 86 having a predominant wavelength of between approximately 635 nm to approximately 650 nm. In addition, the dry fire training device may emit another emission of light 88 having a predominant wavelength of between approximately 780 nm to approximately 850 nm. A detailed discussion of the structure and operation of these components and of a dry fire training device that may be housed in the drill cartridge of the present invention is described in co-pending patent application Ser. No. 13/008,234 filed on Jan. 18, 2011, which is incorporated by reference herein in its entirety.

Referring to FIGS. 8 and 9, the rear casing 14 may form an actuator assembly 90 and the front casing 12 may house an illuminator assembly (or laser module) 92. The illuminator assembly 92 may include an emitter (e.g., laser diode) 94, an emitter housing 100, a focusing cylinder 96, 98 and a lens 52.

The front 12 and rear 14 casing may be tubular and formed from an electrically conducting material in order to accommodate the structure, arrangement, and functional interaction of any internal components. For instance, the front and rear casing may be from aluminum or corrosion resistant steel (e.g., stainless steel AISI 304). Dimensions for the front and rear casing of FIG. 1 are identified in FIG. 9 and exemplary values for these dimensions are provided in Table 1A.

TABLE 1A 9 mm Drill Cartridge Front and Rear Casings

| Dimension | Upper Value (mm) | Lower Value (mm) | Upper Preferred Value (mm) | Lower Preferred Value (mm) | Most Preferred Value (mm) |
|---|---|---|---|---|---|
| D1 | 8.75 | 4.5 | 8.75 | 8.65 | 8.70 |
| D2 | 9.65 | 9.1 | 9.65 | 9.55 | 9.60 |
| D3 | 9.75 | 9.1 | 9.75 | 9.68 | 9.72 |

TABLE 1A-continued 9 mm Drill Cartridge Front and Rear Casings

| Dimension | Upper Value (mm) | Lower Value (mm) | Upper Preferred Value (mm) | Lower Preferred Value (mm) | Most Preferred Value (mm) |
|---|---|---|---|---|---|
| D4 | — | — | — | — | 7.10 |
| D5 | — | — | — | — | 7.70 |
| D6 | — | — | — | — | 8.20 |
| D7 | 9.75 | 9.1 | 9.75 | 9.68 | 9.75 |
| D8 | 9.5 | 3 | 5.15 | 5 | 5.10 |
| D9 | 10 | 4 | 7.05 | 6.95 | 7.00 |
| D10 | 9.95 | 9.1 | 9.93 | 9.83 | 9.88 |
| L1 | — | 11.5 | 25.30 | 25.20 | 25.25 |
| L2 | — | — | — | — | 25.5 |
| L3 | — | — | — | — | 20.0 |
| L4 | 18.15 | 1 | 5.80 | 6.00 | 5.90 |
| L5 | — | — | — | — | 3.25 |
| L6 | 18.15 | 1 | 13.20 | 13 | 13.10 |

Figure 5:
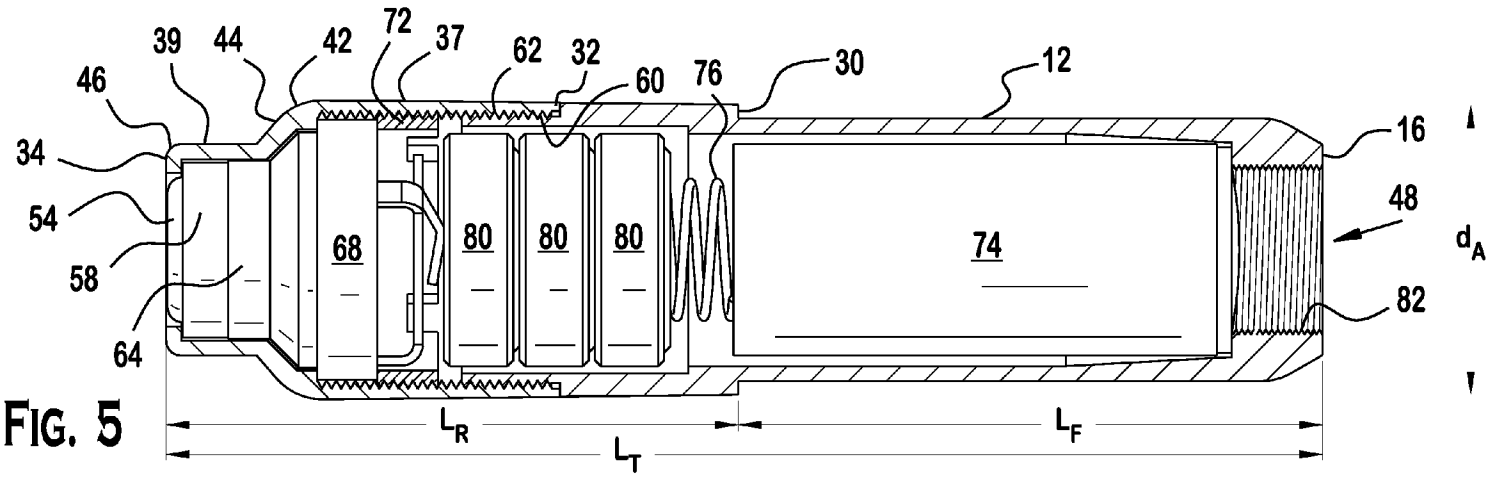
FIG. 5 shows a cross-sectional view of the device of FIG. 1.

As shown in FIG. 5, the 9 mm drill cartridge 10 may have a length LT which allows the drill cartridge to be manually inserted into an open breech of a firearm chamber without stripping the weapon or loading the drill cartridge from a magazine. Additionally, the 9 mm drill cartridge may have a first portion that simulates at least a part of the bullet that the drill cartridge is simulating. Further, the 9 mm drill cartridge may have another portion that simulates at least a part of the cartridge case that the drill cartridge is simulating. In a preferred embodiment, the 9 mm drill cartridge may include a first part that has a profile with a cross-section having an effective diameter DA that is less than or equal to the cross-section of the corresponding cartridge for which the firearm was chambered. Also, the 9 mm drill cartridge may have an effective length LR measured from the rear end of the drill cartridge to the location on the drill cartridge that seats against the chamber wall or barrel face when the drill cartridge is loaded into the chamber of the firearm. Exemplary dimensions for the 9 mm drill cartridge of FIG. 1 are presented in Table 1B.

TABLE 1B 9 mm Drill Cartridge

| Dimension | Upper Value (mm) | Lower Value (mm) | Upper Preferred Value (mm) | Lower Preferred Value (mm) | Most Preferred Value (mm) |
|---|---|---|---|---|---|
| LT | 39 | 29.7 | 38.4 | 38.2 | 38.35 |
| LR | 19.15 | 17.5 | 19 | 18.9 | 18.95 |
| LF | 21.5 | 10.55 | 19.4 | 19.3 | 19.35 |
| DA | 9.65 | 9.1 | 9.63 | 9.57 | 9.60 |

The 9 mm drill cartridge of FIG. 1 may be combined with individual cartridge adaptors to create drill cartridge assemblies that are suitable for use in barrels which are chambered for other cartridges, for example, a .40 Smith & Wesson cartridge, a .45 ACP cartridge or a .45 GAP cartridge.

Figure 10:
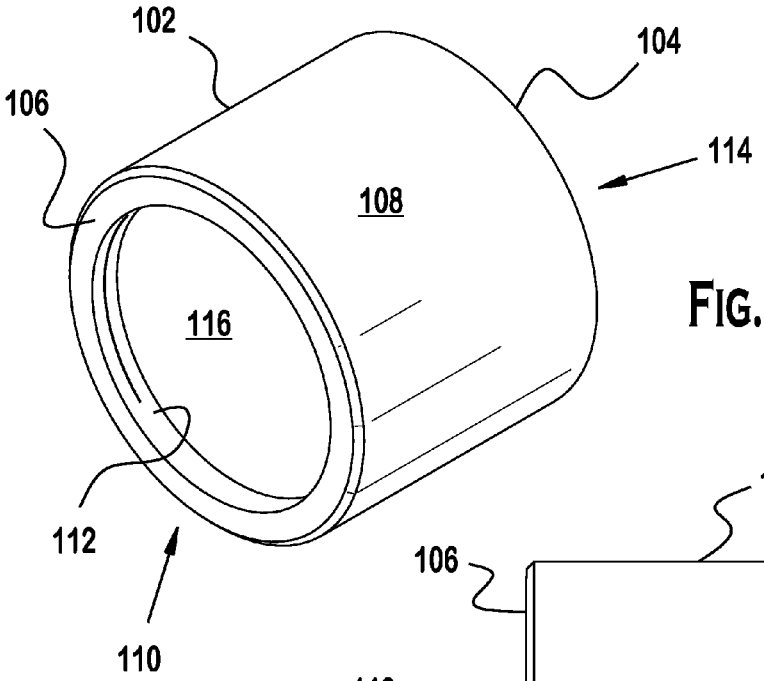
FIG. 10 shows a perspective view of an exemplary embodiment of a drill cartridge adaptor of the present invention.
Figure 11:
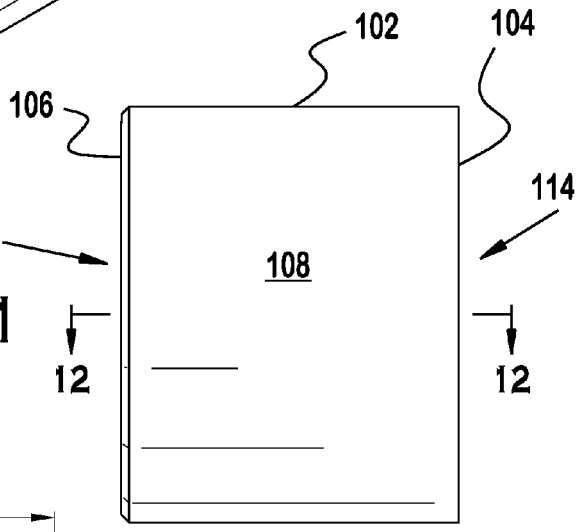
FIG. 11 shows a side view of the drill cartridge adaptor of FIG. 10.
Figure 12:
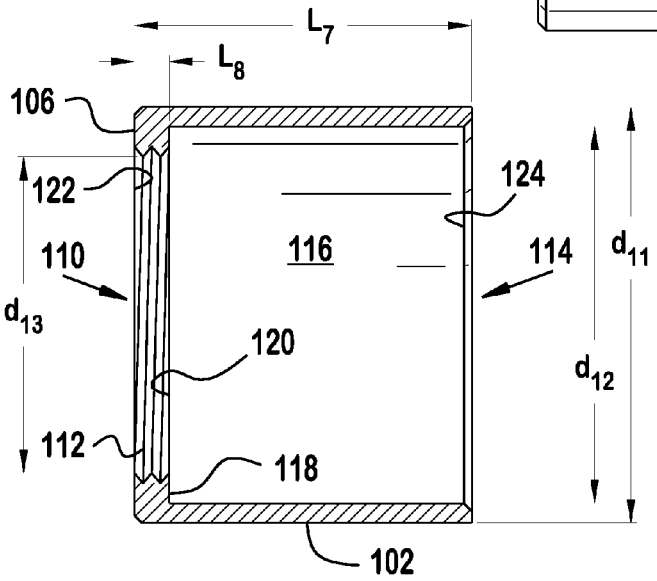
FIG. 12 shows a cross-sectional view of the drill cartridge adaptor of FIG. 11 along line 12-12.

FIGS. 10-12 show a .40 Smith & Wesson cartridge adaptor 102, in accordance with an embodiment of the present invention. The adaptor 102 has a front end 104, a rear end 106, and an outer surface 108 extending from the front end to the rear end. The ring includes a rear opening 110 extending from the rear end toward an interior of the ring. The rear opening has a diameter D13, which is sized and configured to mate with the trailing end 32 of the front casing 12. For example, the rear opening 110 may include a screw thread 112 which mates with the screw thread 62 on the trailing end 32 of the front casing 12. Preferably, the screw thread 112 is formed by two or more screw thread turns. The front end 104 of the adaptor ring 102 may include a front opening 114 which extends from the front end 104 to the trailing end of the front opening 124 disposed in the ring interior. The front opening 114 may taper from a maximum inner dimension at the front end of the ring 104 to a minimum internal dimension D12 deeper within the ring interior.

As shown in FIG. 12, the front opening 114 connects to an interior passage which is bound by an inner surface 116 of the ring. The interior passage connects the front opening 114 of the ring to the rear opening 110 of the ring. The interior passage has a diameter D12 which is greater than the diameter of the rear opening D13. The diameter of the interior passage is sized so that the rear projection 25 of the front casing 12 can be received within the interior passage. The interior passage may include an interior end wall 118. Referring to FIG. 12, the interior end wall 118 surrounds the leading end 120 of the rear opening 110 where the leading end of rear opening 120 joins to the interior passage. The interior passage extends from the leading end of the rear opening 120 to the trailing end of the front opening 124. In the embodiment of FIG. 12, the adaptor ring has a length L7 measured from the rear end 106 of the ring to the front end 104 of the ring. The adaptor ring also has a length L8 measured from the trailing end of the rear opening 122 to the leading end of the rear opening 110. Dimensions for the embodiment of FIGS. 10-12 are presented in Table 3A.

TABLE 3A

.40 Smith & Wesson Cartridge Rear Mounting Adaptor

| Dimension | Upper Value (mm) | Lower Value (mm) | Upper Preferred Value (mm) | Lower Preferred Value (mm) | Most Preferred Value (mm) |
|---|---|---|---|---|---|
| L7 | 20.6 | 3.45 | 8.65 | 8.55 | 8.60 |
| L8 | 9.3 | 0.5 | 1 | 0.8 | 0.90 |
| D11 | 10.77 | 10.2 | 10.74 | 10.70 | 10.74 |
| D12 | 9.77 | 9.2 | 9.78 | 9.73 | 9.73 |
| D13 | 9 | 1 | — | — | 8.16 |

Figure 20:
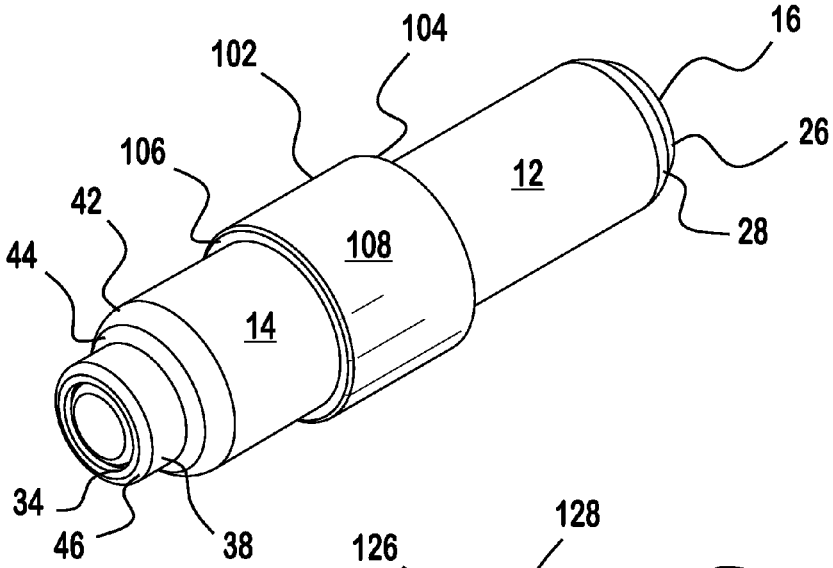
FIG. 20 shows a perspective view of another embodiment of a drill assembly of the present invention.
Figure 23:
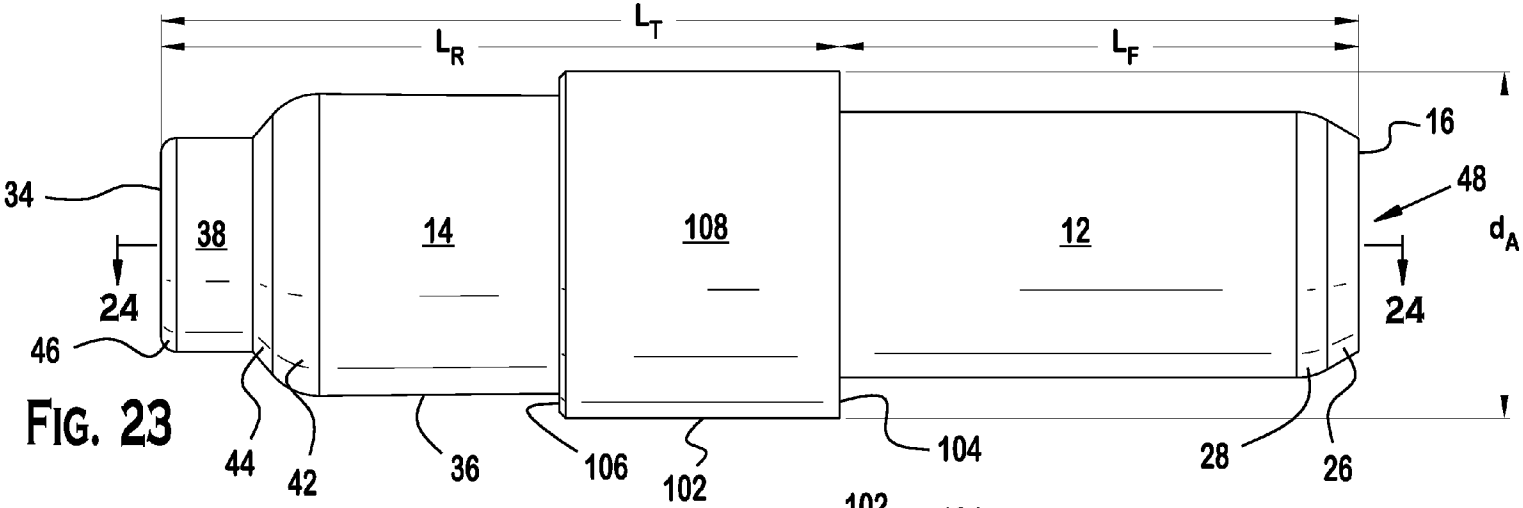
FIG. 23 shows a side view of the assembly of FIG. 20.
Figure 24:
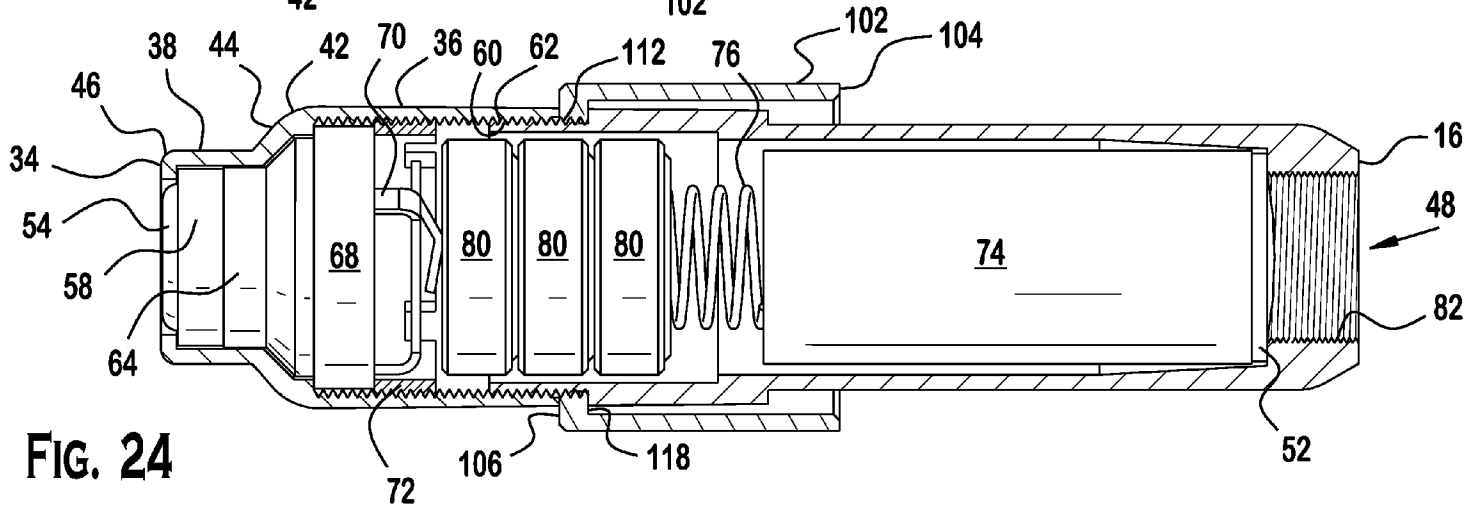
FIG. 24 shows a cross-sectional view of the assembly of FIG. 23 taken along line 23-23.
Figure 25:
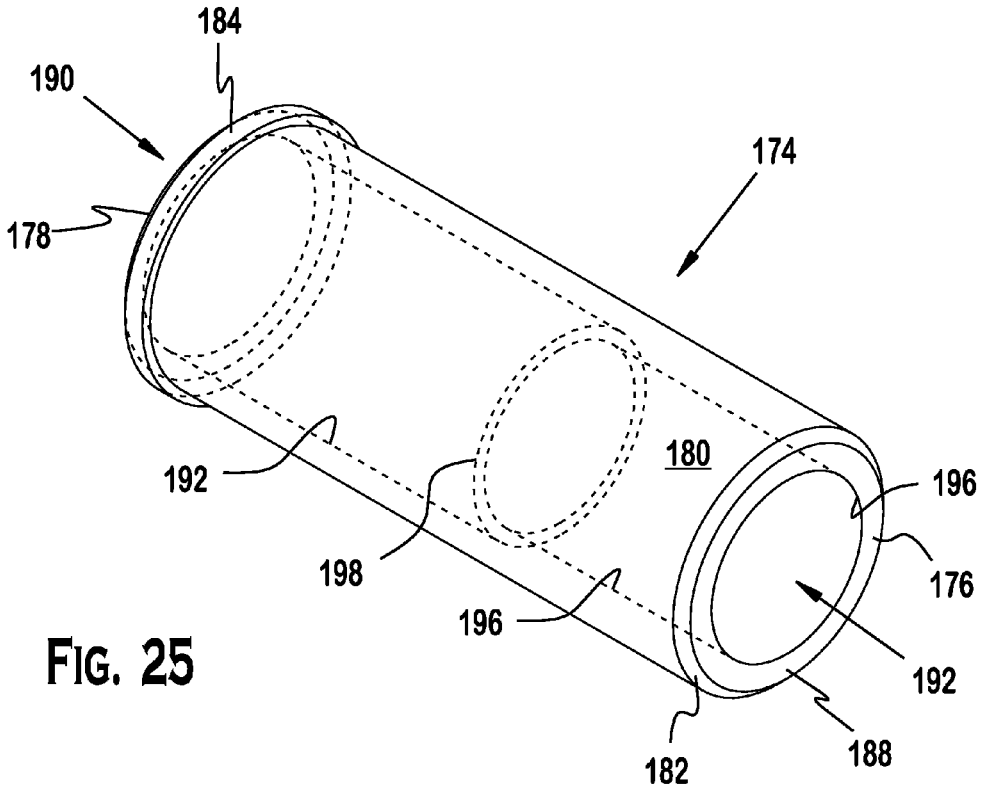
FIG. 25 shows a perspective view of another embodiment of a drill cartridge adaptor of the present invention.
Figure 26:
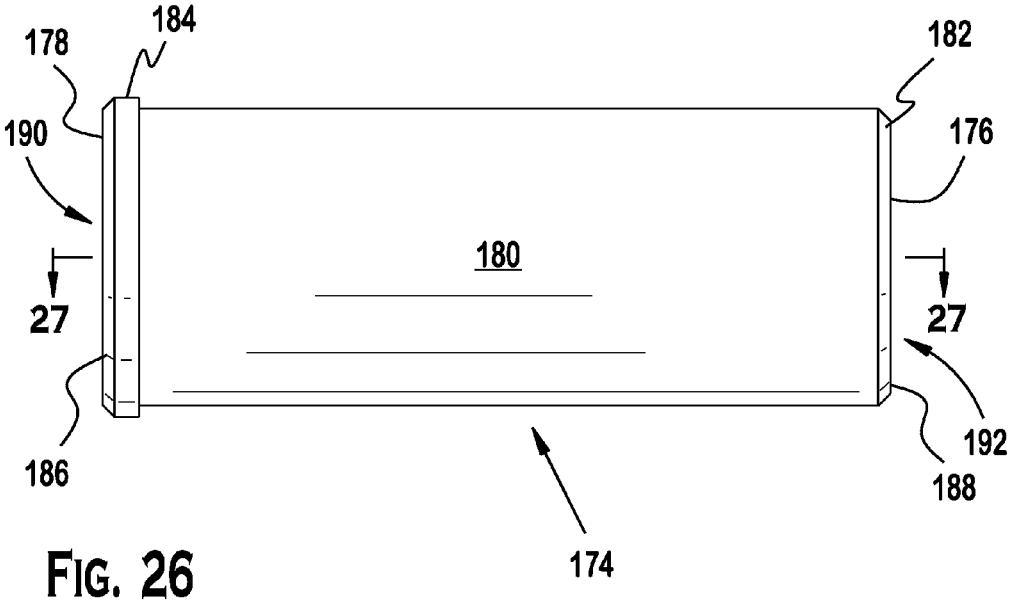
FIG. 26 shows a side view of the drill cartridge adaptor of FIG. 25.

Referring to FIGS. 20 and 23-24, the .40 Smith & Wesson Cartridge Rear Mounting Adaptor 102 may be secured to the drill cartridge of FIG. 1 to allow the drill cartridge 10 to be used in the chamber of a barrel of a firearm that is configured and dimensioned for ammunition having different characteristics than a 9 mm cartridge. For example, the front casing 12 and rear casing 14 of the 9 mm drill cartridge may be separated from each other by turning the front casing 12 counterclockwise with respect to the rear casing 14 about a common central axis. The battery pack 78 then may be removed from the front casing 12 and the adaptor cartridge 102 screwed on to the screw thread 62 of the front casing until the interior end wall 118 is seated against the trailing edge 19 of the stepped portion 23 of the front casing 12. The rear casing 14 then may be screwed onto the remaining exposed portion of the screw thread 62, until the leading end 32 of the rear casing 14 is disposed against the rear end 106 of the cartridge adaptor 102. In this fashion, the cartridge adaptor 102 may be secured to the rear section 24 of the front casing 12 to change the effective length LR and effective diameter DA of the drill cartridge.

Exemplary dimensions for the 9 mm dry fire training device/.40 Smith & Wesson cartridge adaptor assembly are presented in Table 3B.

TABLE 3B 9 mm Drill Cartridge/.40 Smith & Wesson Cartridge Adaptor Assembly

| Cartridge Adaptor | LT (mm) | LR (mm) | LF (mm) | DA (mm) |
|---|---|---|---|---|
| .40 S&W (RM) | 39.15 | 21.7 | 17.55 | 10.74 |

Although the .40 adaptor ring 102 has a circular cross-section, the adaptor ring may have other cross-sectional shapes provided the interior passage is sized to receive the rear section of the front casing and the rear opening mates with the trailing end of the front casing. For example, the ring adaptor may have a polygonal cross-section. Similarly, the cross-section of the interior passage, the front opening, and the rear opening may have a non-circular shape, such as an octagonal cross section, provided the interior passage and front opening are sized to receive the rear section of the front casing and the rear opening mates with the trailing end of the front casing.

The adaptor ring may be formed from metal or metal alloy. For example, the ring may be formed from aluminum or stainless steel. Other metals may include brass, steel, and titanium. The adaptor may be formed from a polymeric material. The ring also may be formed from a graphite composite material.

Figure 13:
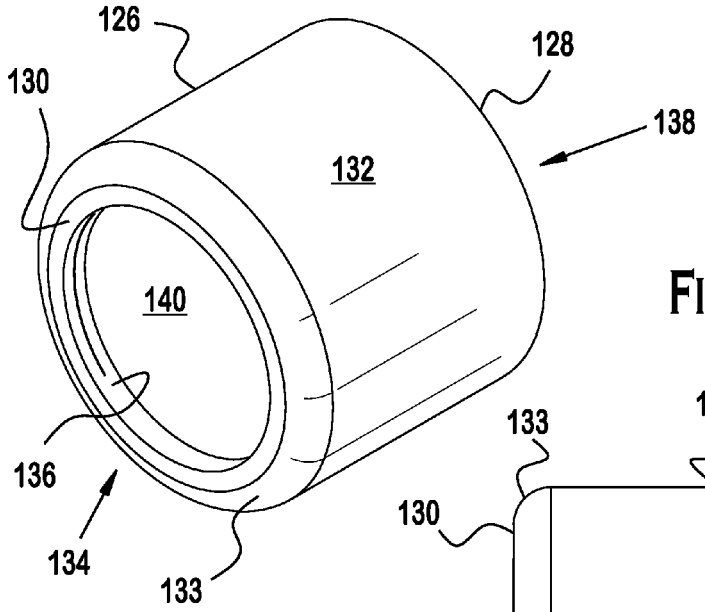
FIG. 13 shows a perspective view of another embodiment of a drill cartridge adaptor of the present invention.
Figure 14:
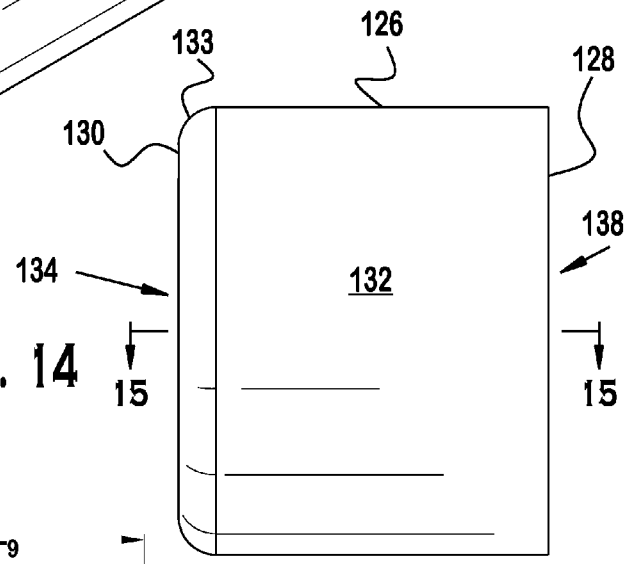
FIG. 14 shows a side view of the drill cartridge adaptor of FIG. 13.
Figure 15:
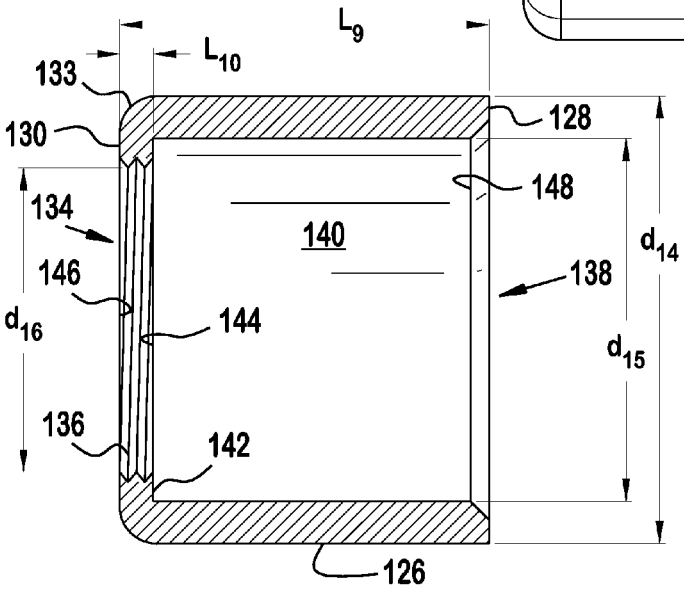
FIG. 15 shows a cross-sectional view of the drill cartridge adaptor of FIG. 14 along line 15-15.

FIGS. 13-15 show a .45 ACP adaptor ring 126. The ring has a front end 128 and a rear end 130, and an outer surface 132 extending from the front end to the rear end. The outer surface may include a transition portion 133. The ring includes a rear opening 134 extending from the rear end toward an interior of the ring. The rear opening has a diameter D16, which is sized and configured to mate with the trailing end 32 of the front casing 12. For example, the rear opening 134 may include a screw thread 136 which mates with the screw thread 62 on the trailing end 32 of the front casing 12. Preferably, the screw thread 136 is formed by two or more screw thread turns. The front end 128 of the adaptor ring 126 may include a front opening 138 which extends from the front end 128 to the trailing end of the front opening 144 disposed in the ring interior. The front opening 138 may taper from a maximum inner dimension at the front end of the ring to a minimum internal dimension D15 deeper within the ring interior.

As shown in FIG. 15, the front opening 138 connects to an interior passage which is bound by an inner surface 140 of the ring. The interior passage connects the front opening 138 of the ring to the rear opening 134 of the ring. The interior passage has a diameter D15 which is greater than the diameter of the rear opening. The diameter of the interior passage is sized so that the rear section 24 of the front casing 12 can be received within the interior passage. The interior passage may include an interior end wall 142. Referring to FIG. 15, the interior end wall 142 surrounds the leading end 144 of the rear opening 134 where the leading end of rear opening 144 joins to the interior passage. The interior passage extends from the leading end of the rear opening 144 to the trailing end of the front opening 148. In FIG. 15, the adaptor ring has a length L9 measured from rear end 130 of the ring to the front end 128 of the ring. The adaptor ring also has a length L10 measured from the trailing end of the rear opening 146 to the leading end of the rear opening 144. Dimensions for the cartridge adaptor of FIGS. 13-15 are presented in Table 4A.

TABLE 4A

| .45 ACP Cartridge Rear Mounting Adaptor | | | | | |
|---|---|---|---|---|---|
| Dimension | Upper Value (mm) | Lower Value (mm) | Upper Preferred Value (mm) | Lower Preferred Value (mm) | Most Preferred Value (mm) |
| L9 | 22 | 4.85 | 9.95 | 9.8 | 9.90 |
| L10 | 10 | 0.5 | 1 | 0.8 | 0.90 |
| D14 | 12.05 | 11.5 | 12 | 11.9 | 12.00 |
| D15 | 9.77 | 9.2 | 9.78 | 9.73 | 9.73 |
| D16 | 9 | 1 | — | — | 8.16 |

Referring to FIGS. 13-15 and 21 the .45 ACP Cartridge Rear Mounting Adaptor 126 may be secured to the drill cartridge of FIG. 1 to allow the drill cartridge 10 to be used in the chamber of a barrel of a firearm that is configured and dimensioned for ammunition having different characteristics than a 9 mm cartridge. For example, the front casing 12 and rear casing 14 of the 9 mm drill cartridge may be separated from each other by turning the front casing 12 counter-clockwise with respect to the rear casing 14 about a common central axis. The battery pack 78 then may be removed from the front casing 12 and the adaptor cartridge 126 screwed on to the screw thread 62 of the front casing until the interior end wall 142 is seated against the trailing edge 19 of the stepped portion 23 of the front casing 12. The rear casing 14 then may be screwed onto the remaining exposed portion of the screw thread 62, until the leading end 32 of the rear casing 14 is disposed against the rear end 130 of the adaptor cartridge 126. In this fashion, the adaptor cartridge 126 may be secured to the rear section 24 of the front casing 12 to change the effective length LT and effective diameter DA of the drill cartridge.

Exemplary dimensions for the 9 mm dry fire training device/.45 ACP cartridge adaptor assembly are presented in Table 4B.

TABLE 3B

| Dry Fire Training Device/.45 ACP Cartridge Adaptor Assembly | | | | |
|---|---|---|---|---|
| Cartridge Adaptor | LT (mm) | LR (mm) | LF (mm) | DA (mm) |
| .45 ACP (RM) | 39.15 | 23 | 16.25 | 12 |

Although the .45 adaptor ring 126 has a circular cross section, the adaptor ring may have other cross-sectional shapes provided the interior passage is sized to receive the rear section of the front casing and the rear opening mates with the trailing end of the front casing. For example, the ring adaptor may have a polygonal cross-section. Similarly, the cross-section of the interior passage, the front opening, and the rear opening may have a non-circular shape, such as an octagonal cross section, provided the interior passage and front opening are sized to receive the rear section of the front casing and the rear opening mates with the trailing end of the front casing. The adaptor ring may be formed from metal or metal alloy. For example, the ring may be formed from aluminum or stainless steel. Other metals may include brass, steel, and titanium. The adaptor may be formed from a polymeric material. The adaptor also may be formed from a graphite composite material.

Figure 16:
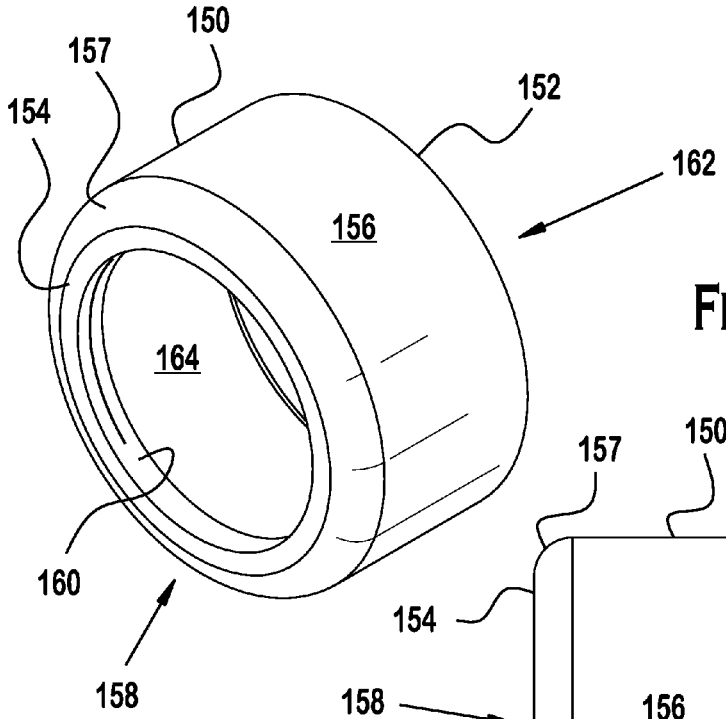
FIG. 16 shows a perspective view of another embodiment of a drill cartridge adaptor of the present invention.
Figure 17:
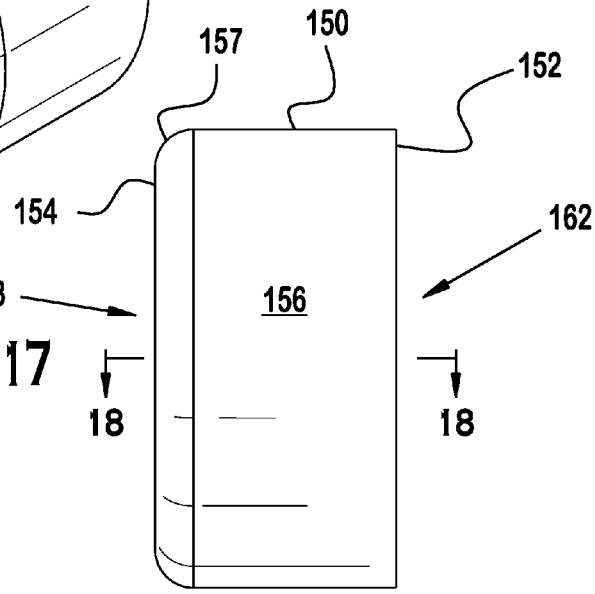
FIG. 17 shows a side view of the drill cartridge adaptor of FIG. 16.
Figure 18:
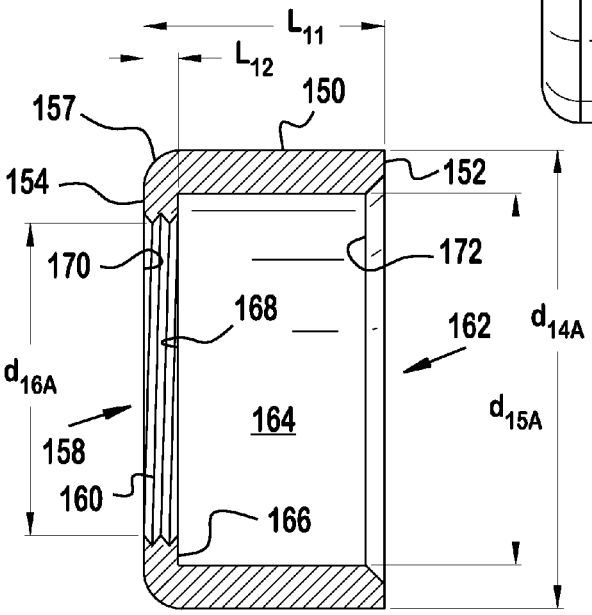
FIG. 18 shows a cross-sectional view of the drill cartridge adaptor of FIG. 17 along line 18-18.

FIGS. 16-18 show a .45 GAP cartridge adaptor 150. The ring has a front end 152 and a rear end 154, and an outer surface 156 extending from the front end to the rear end. The outer surface may include a transition portion 157. The ring includes a rear opening 158 extending from the rear end toward an interior of the ring. The rear opening has a diameter D16, which is sized and configured to mate with the trailing end 32 of the front casing 12. For example, the rear opening 158 may include a screw thread 160 which mates with the screw thread 62 on the trailing end 32 of the front casing 12. Preferably, the screw thread 160 is formed by two or more screw thread turns. The front end 152 of the adaptor ring 150 may include a front opening 162 which extends from the front end 162 to the trailing end of the front opening 168 disposed in the ring interior. The front opening 162 may taper from a maximum inner dimension at the front end of the ring to a minimum internal dimension D15 deeper within the ring interior.

As shown in FIG. 18, the front opening 162 connects to an interior passage which is bound by an inner surface 164 of the ring. The interior passage connects the front opening 162 of the ring to the rear opening 158 of the ring. The interior passage has a diameter D15 which is greater than the diameter of the rear opening. The diameter of the interior passage is sized so that the rear projection 24 of the front casing 12 can be received within the interior passage. The interior passage may include an interior end wall 166. The interior end wall 166 surrounds the leading end 168 of the rear opening 158 where the leading end of rear opening 168 joins to the interior passage. The interior passage extends from the leading end of the rear opening 170 to the trailing end of the front opening 168. The adaptor ring may have a length L11 measured from the rear end 154 of the ring to the front end 152 of the ring. The adaptor ring also may have a length L12 measured from the trailing end of the rear opening 154 to the leading end of the rear opening 168. Dimensions for the cartridge adaptor of FIGS. 16-18 are presented in Table 5A.

TABLE 5A

| .45 GAP Cartridge Rear Mounting Adaptor | | | | | |
|---|---|---|---|---|---|
| Dimension | Upper Value (mm) | Lower Value (mm) | Upper Preferred Value (mm) | Lower Preferred Value (mm) | Most Preferred Value (mm) |
| L11 | 18.2 | 1.05 | 6.35 | 6.25 | 6.30 |
| L12 | 8.1 | 0.5 | 1 | 0.8 | 0.90 |
| D14A | 12.05 | 11.5 | 12 | 11.9 | 12.00 |
| D15A | 9.77 | 9.2 | 9.78 | 9.73 | 9.73 |
| D16A | 9 | 1 | — | — | 8.16 |

Referring to FIGS. 16-19 and 22, the .45 GAP Cartridge Rear Mounting Adaptor 150 may be secured to the drill cartridge of FIG. 1 to allow the drill cartridge 10 to be used in the chamber of a barrel of a firearm that is configured and dimensioned for ammunition having different characteristics than a 9 mm cartridge. For example, the front casing 12 and rear casing 14 of the 9 mm drill cartridge may be separated from each other by turning the front casing 12 counter-clockwise with respect to the rear casing 14 about a common central axis. The battery pack 78 then may be removed from the front casing 12 and the adaptor cartridge 150 screwed on to the screw thread 62 of the front casing until the interior end wall 166 is seated against the trailing edge 19 of the stepped portion 23 of the front casing 12. The rear casing 14 then may be screwed onto the remaining exposed portion of the screw thread 62, until the leading end 32 of the rear casing 14 is disposed against the rear end 154 of the adaptor cartridge 150. In this fashion, the adaptor cartridge 150 may be secured to the rear projection 25 of the front casing 12 to change the effective length LT and effective diameter DA of the drill cartridge.

Exemplary dimensions of the 9 mm dry fire training device/.45 GAP cartridge adaptor assembly are presented in Table 5B.

TABLE 5B

| Dry Fire Training Device/.45 GAP Cartridge Adaptor Assembly | | | | |
|---|---|---|---|---|
| Cartridge Adaptor | LT (mm) | LR (mm) | LF (mm) | DA (mm) |
| .45 GAP (RM) | 39.15 | 19.2 | 19.75 | 12 |

Although the .45 adaptor ring 150 has a circular cross section, the adaptor ring may have other cross-sectional shapes provided the interior passage is sized to receive the rear section of the front casing and the rear opening mates with the trailing end of the front casing. For example, the ring adaptor may have a polygonal cross-section. Similarly, the cross-section of the interior passage, the front opening, and the rear opening may have a non-circular shape, such as an octagonal cross section, provided the interior passage and front opening are sized to receive the rear section of the front casing and the rear opening mates with the trailing end of the front casing. The adaptor ring may be formed from metal or metal alloy. For example, the ring may be formed from aluminum or stainless steel. Other metals may include brass, steel, and titanium. The adaptor may be formed from a polymeric material. The adaptor also may be formed from a graphite composite material.

Figure 19:
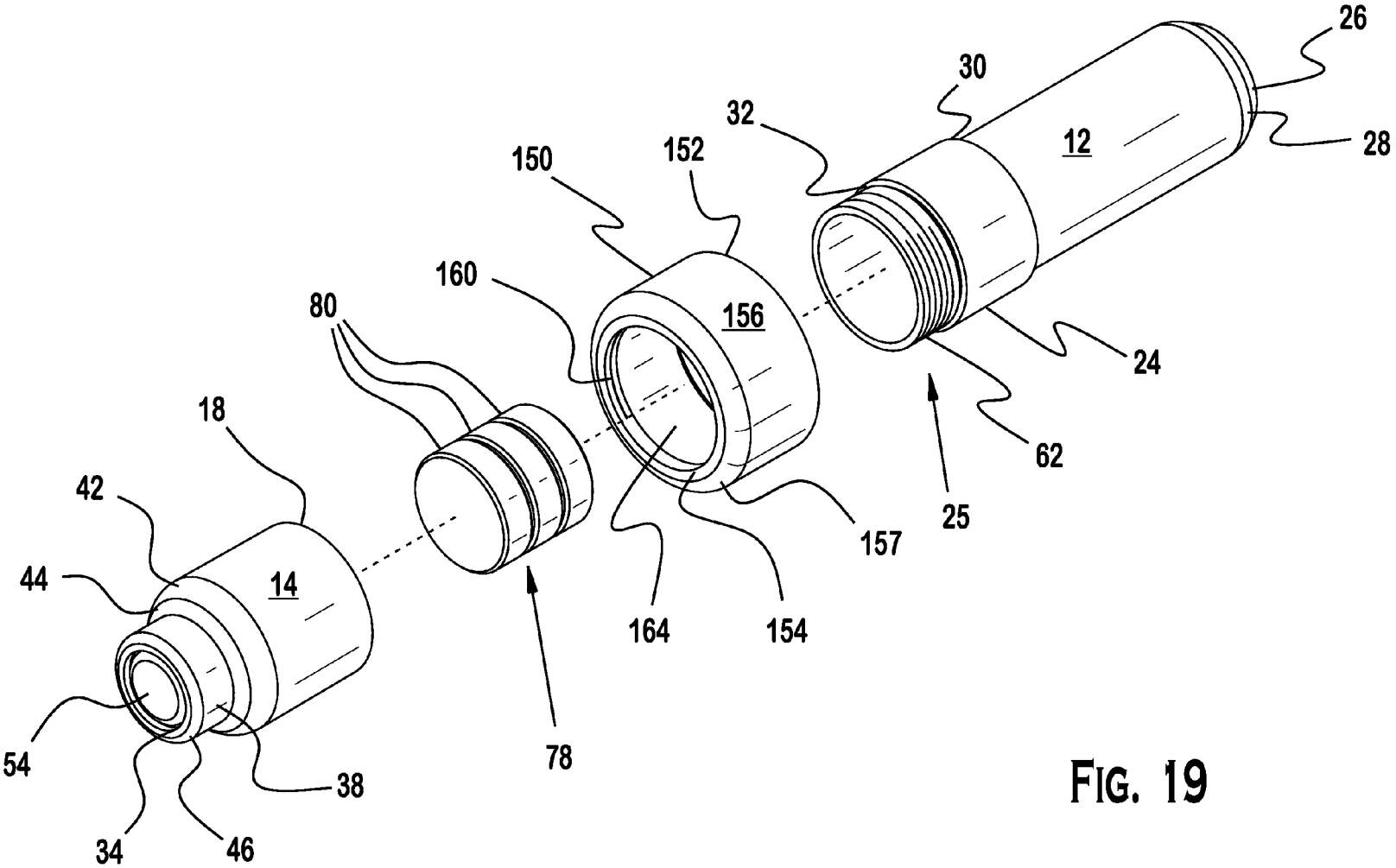
FIG. 19 shows a partially exploded view of an exemplary embodiment of a drill cartridge adaptor assembly of the present invention.

FIG. 19 shows an exploded view of an illustrative drill cartridge assembly of the present invention. The assembly is constructed by screwing the adaptor ring 150 onto the rear section of the front casing 12. For example, the front end of the ring 152 may be slipped over the external screw thread 62 on the front casing until mating screw threads 160 engage the external screw thread 62. The ring 150 may be rotated with respect to the front casing to advance the adaptor ring until it is fully threaded on the front casing. In a preferred embodiment, the ring 150 may be rotated clockwise with respect to the front casing to advance the ring toward the front end of the front casing and may be rotated counter clockwise with respect to the front casing to move the ring in the opposite direction. A power supply 78 then may be inserted into the front casing 12 and the rear casing may be threaded onto the remaining exposed portion of the external screw thread 62 to enclose and secure the internal components.

Figure 21:
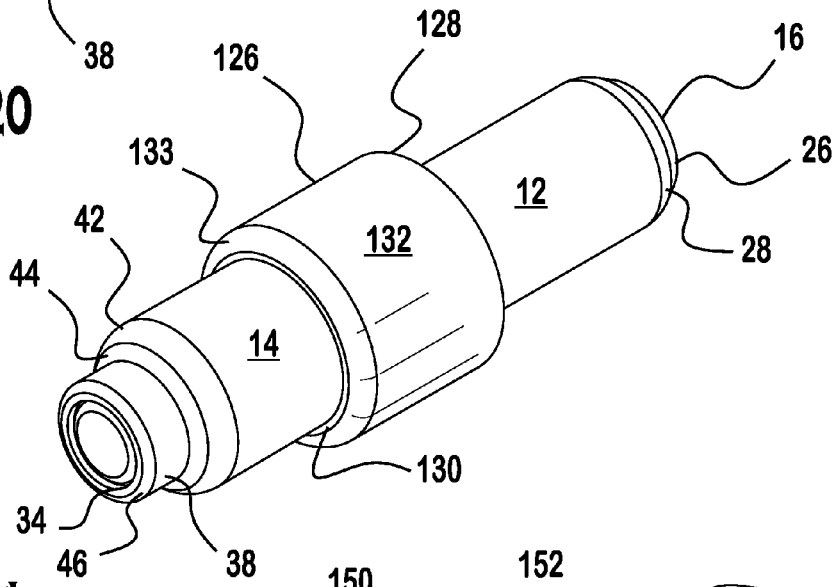
FIG. 21 shows a perspective view of another embodiment of a drill cartridge assembly of the present invention.
Figure 22:
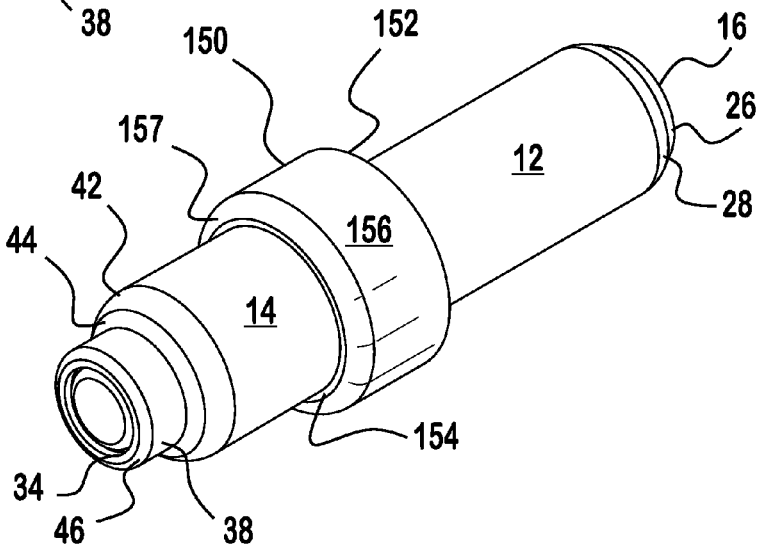
FIG. 22 shows a perspective view of the assembly of FIG. 19.

FIGS. 20-22 present perspective views of three exemplary embodiments of a drill cartridge assembly of the present invention. FIG. 20 shows the drill cartridge of FIG. 1 with the cartridge adaptor of FIG. 10. FIG. 21 shows the drill cartridge of FIG. 1 with the cartridge adaptor of FIG. 13. And, FIG. 22 shows the drill cartridge of FIG. 1 with the cartridge adaptor of FIG. 16.

FIGS. 23 and 24 show a side view of an exemplary embodiment of a drill cartridge assembly of the present invention which houses a light emitting dry fire training device. In this exemplary embodiment, the assembly has a length LT measured from the trailing end 34 to the leading end 16. In addition, the assembly has a length LR measured from the trailing end 34 to the front end of the adaptor ring 104. The assembly has a length LF measured from the front end of the ring 104 to the leading end 16. As shown in FIG. 24, the front end of the ring 104 is closer to the leading end 16 of the front casing than is the outer annular surface 30. Additionally, the maximum diameter of the assembly DA is greater than the maximum diameter of the dry fire training device 10 of FIG. 1. Thus, use of a cartridge adaptor in combination with a drill cartridge may increase the effective length (LR) and effective diameter (DA) of the front casing to conform to (or simulate) the profile of a larger caliber cartridge.

FIGS. 25-28 show a .45 Long Colt cartridge adaptor 174. The adaptor is suitable for use in a revolver. The adaptor 174 has a front end 176, a rear end 178, and an outer surface 180 extending from the front end 176 to the rear end 178. The front end 176 has a generally flat surface and a tapered portion 182 adjacent the front end 176. The rear end 178 has a rim 184 which surrounds the adaptor. The trailing end of the rim 184 (or rear end 178 of the adaptor) has a beveled surface 186, whereas the leading end of the rim has a planar face 188. The rear end 178 of the adaptor has a rear opening 190. The rear opening 190 is defined by an inner surface 192 that extends from the rear end 178 to the interior of the adaptor. The front end 176 of the adaptor has a front opening 194. The front opening 194 is defined by another inner surface 196 which extends from the front end 176 of the adaptor to the leading end 198 of the rear opening.

Figure 27:
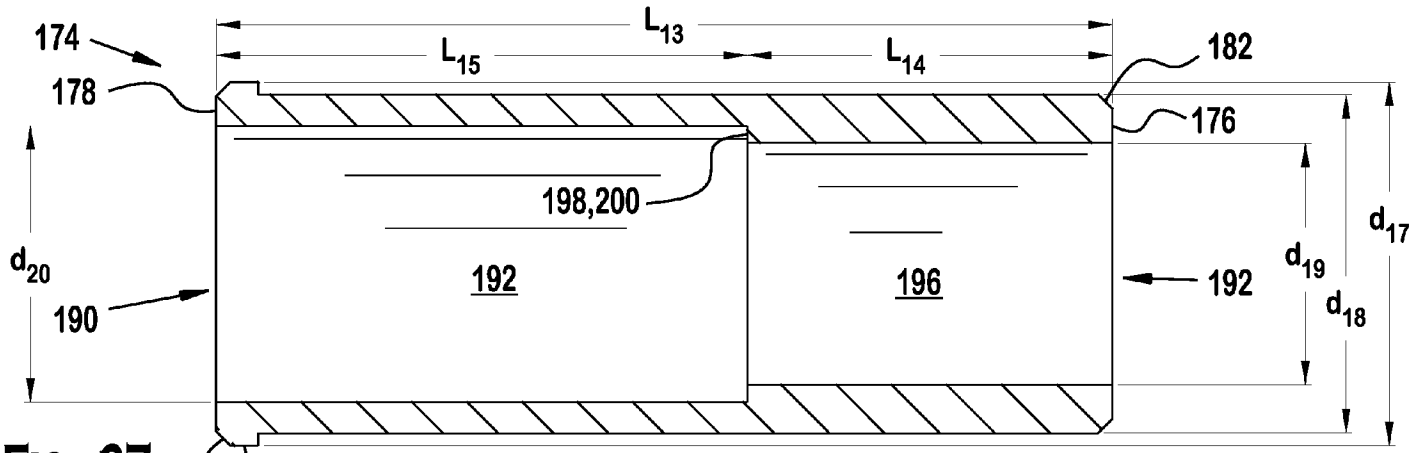
FIG. 27 shows a cross-sectional view of the drill cartridge adaptor of FIG. 25 along line 27-27.

Exemplary dimensions for the adaptor 174 are shown in FIG. 27 and presented in Table 6A. The rear opening 190 has an inner diameter D20 and the front opening has an inner diameter D19. The inner diameter D20 of the rear opening 190 is greater than the inner diameter D19 of the front opening 192. As the front opening 192 is counter sunk into the rear opening 192, the leading end of the rear opening 198 forms an interior end wall 200. The interior end wall 200 forms an annular bench where the rear opening 190 and the front opening connect 192. The outer surface of the adaptor has uniform diameter D18. The rim has a maximum outer diameter D17. The adaptor has a length L13 measured from the rear end 178 to the front end 176. The rear opening 190 has a length L15 measured from the rear end 178 to the interior end wall 198. The front opening 192 has a length L14 measured from the front end 176 to the interior end wall 200 of the rear opening 190.

TABLE 6A

| .45 Long Colt Cartridge Adaptor | | | | | |
|---|---|---|---|---|---|
| Dimension | Upper Value (mm) | Lower Value (mm) | Upper Preferred Value (mm) | Lower Preferred Value (mm) | Most Preferred Value (mm) |
| L13 | 40.60 | 20 | 32.70 | 32.50 | 32.60 |
| L14 | 21.60 | 1 | 13.70 | 13.50 | 13.60 |
| L15 | 19.15 | 18.85 | 19.05 | 18.95 | 19.00 |
| D17 | 13.10 | 12.45 | 13.10 | 12.90 | 13.00 |
| D18 | 12.20 | 11.50 | 12.15 | 12.05 | 12.10 |
| D19 | 9.40 | 1 | 8.75 | 8.65 | 8.70 |
| D20 | 11.20 | 9.20 | 10 | 9.88 | 9.90 |

Figure 4:
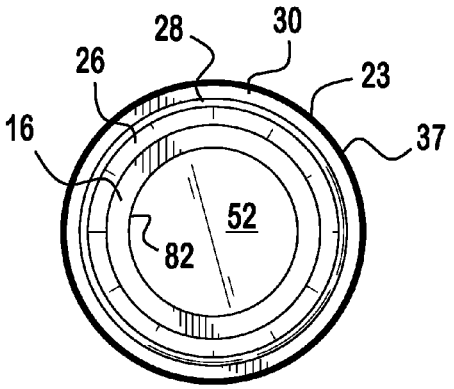
FIG. 4 shows a rear view of the device of FIG. 1.
Figure 28:
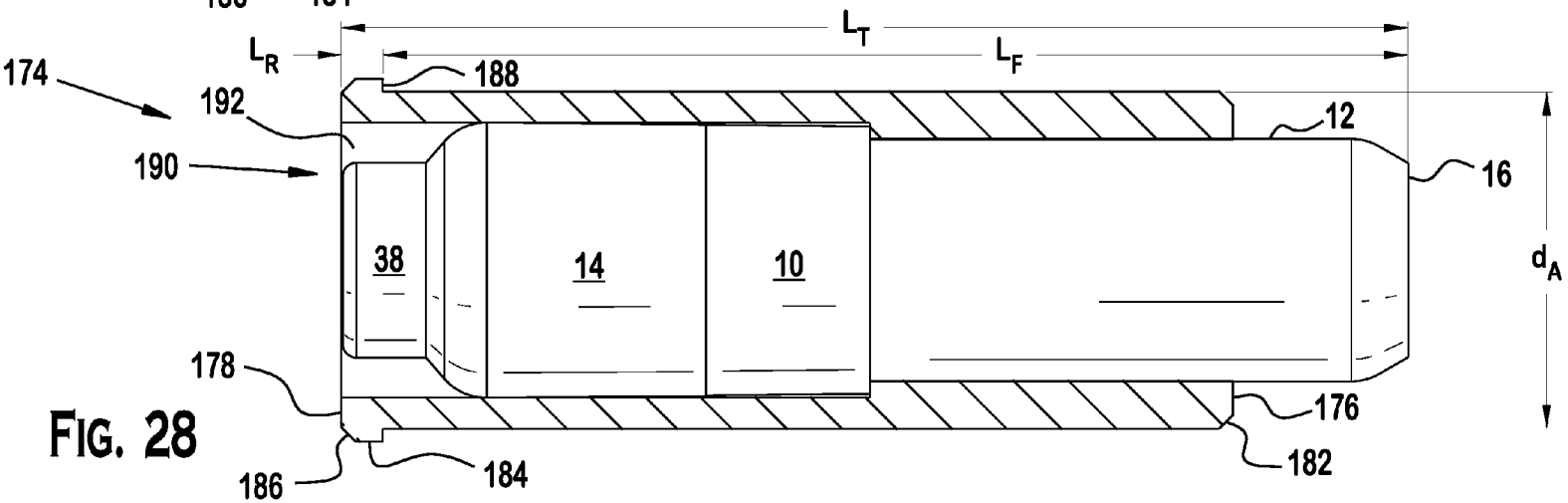
FIG. 28 shows a partial cross-sectional view of another embodiment of a drill cartridge adaptor assembly of the present invention.

Referring to FIG. 28, the .45 Long Colt cartridge adaptor is configured to receive the light emitting drill cartridge of FIG. 4. The front end 16 of the drill cartridge is inserted into the rear opening of the .45 Long Colt adaptor 174. The drill cartridge 10 is inserted into the rear opening until the outer annular surface 30 of the drill cartridge bears against the interior end wall 200 of the rear opening 190. The trailing end of the rear casing 34 is flush with the rear end 178 of the adaptor. The leading edge of the front casing 16 extends beyond the front end 176 of the adaptor. The total length LT of the assembly is measured from the rear end of the adaptor 178 to the leading edge of the front casing 16. The adaptor depth LF of the assembly is measured from the leading edge of the drill cartridge 16 to the front face 188. The length LR of the assembly is measured from the rear end 178 of the drill cartridge 174 to the front face 188. Exemplary dimensions for the 9 mm dry fire training device/.45 Long Colt cartridge adaptor assembly are presented in Table 6B.

TABLE 6B

| Dry Fire Training Device/.45 Long Colt Cartridge Adaptor Assembly | | | | | |
|---|---|---|---|---|---|
| Cartridge Adaptor | LT (mm) | LR (mm) | LF (mm) Adaptor Depth | DA (mm) | DA2 (mm) Rim Size |
| .45 Long Colt | 38.35 | 1.5 | 36.85 | 12.10 | 13 |

Figure 29:
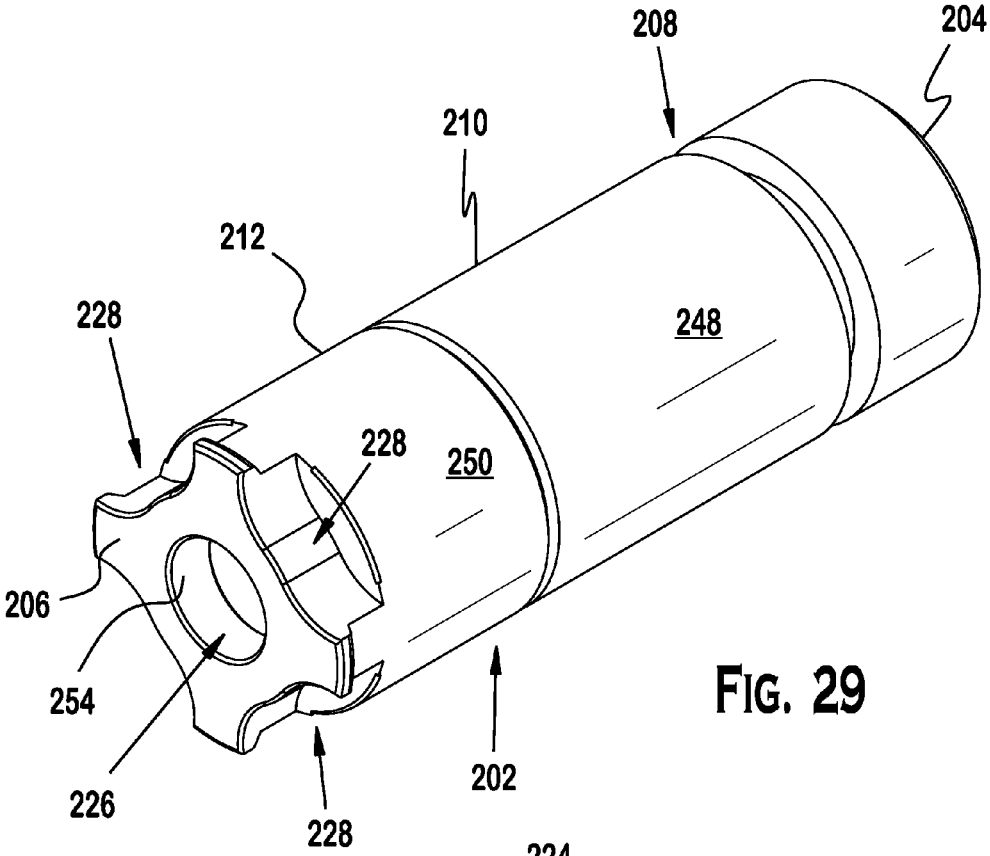
FIG. 29 shows a perspective view of another embodiment of a drill cartridge adaptor of the present invention.

Although the cartridge adaptor disclosed in FIGS. 25 through 28 is adapted for use without a securing element, the adaptor 174 may be modified to include an internal securing element. For example, in one embodiment the inner surface of the front opening 196 may be provided with a screw thread, which is configured and adapted to mate with an external screw thread disposed on the front casing of the drill cartridge 10. Additionally, the cartridge adaptor may be adapted in differing embodiments to conform to the external dimensions of cartridges other than a .45 Long Colt cartridge. For example, the cartridge adaptor of FIG. 29 may be adapted to simulate the profile of a .357 Sig Sauer cartridge, a .40 Smith & Wesson cartridge, or a .45 ACP cartridge.

FIGS. 29-38 show a 20 gauge shotgun cartridge adaptor 202. The shotgun adaptor has a front end 204 and a rear end 206. Adjacent the front end of the shotgun adaptor is a peripheral groove 208, which circumscribes the outer surface. The groove 208 is configured and dimensioned to receive an O-ring 209. The shotgun cartridge adaptor is configured to separate into two components. The first component is the front casing 210 and the second component is the rear casing 212.

Figure 30:
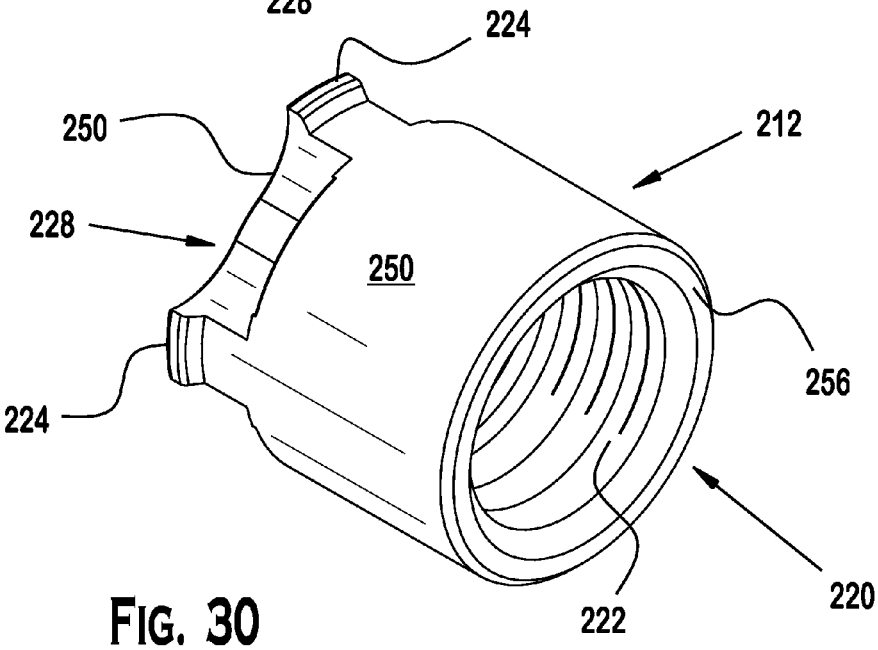
FIG. 30 shows a perspective view of the rear casing of the drill cartridge adaptor of FIG. 29.
Figure 31:
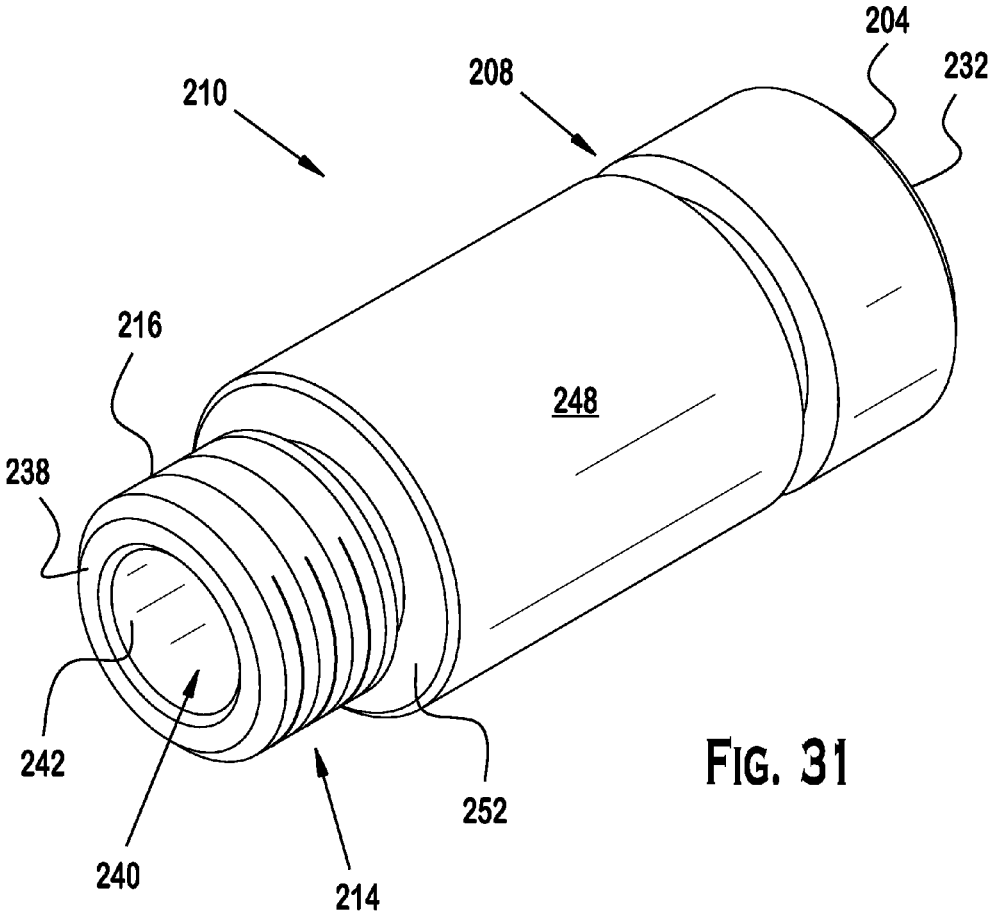
FIG. 31 shows a perspective view of the front casing of the drill cartridge adaptor of FIG. 29.
Figure 32:
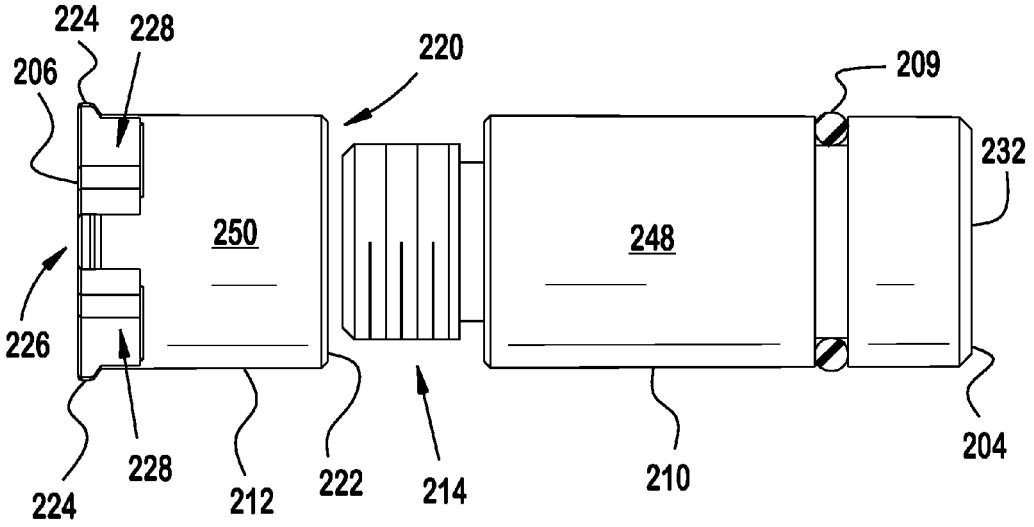
FIG. 32 is a side exploded view of the drill cartridge of FIG. 29.

Referring to FIGS. 30-32, the front casing 210 includes a rear projection 214 with an external screw thread 216. The rear casing 212 has a front opening 220, which is configured and adapted to receive the rear projection 214. The front opening of the rear casing 220 may have an internal screw thread 222. The rear projection 214 can be secured to the rear casing 212 by inserting the rear projection 214 into the front opening of the rear casing 220 and screwing the rear projection 214 into the front opening of the rear casing 220.

Figure 35:
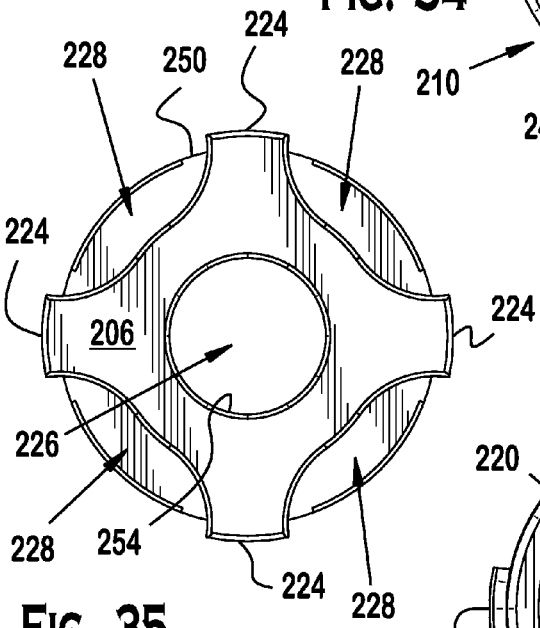
FIG. 35 is a rear view of the casing of FIG. 30.
Figure 36:
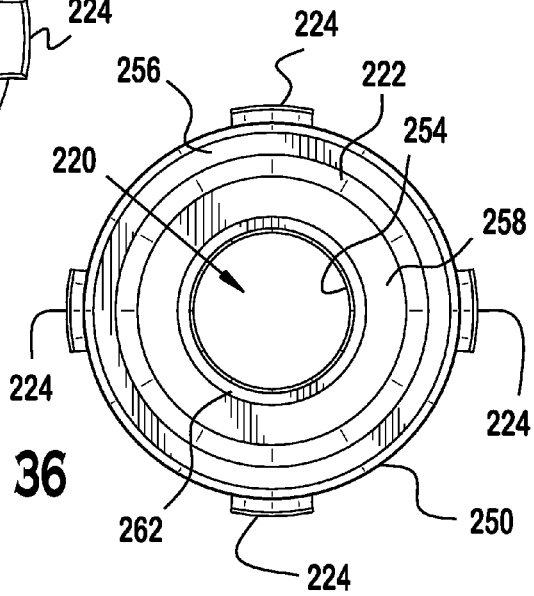
FIG. 36 is a front view of the casing of FIG. 30.
Figure 37:
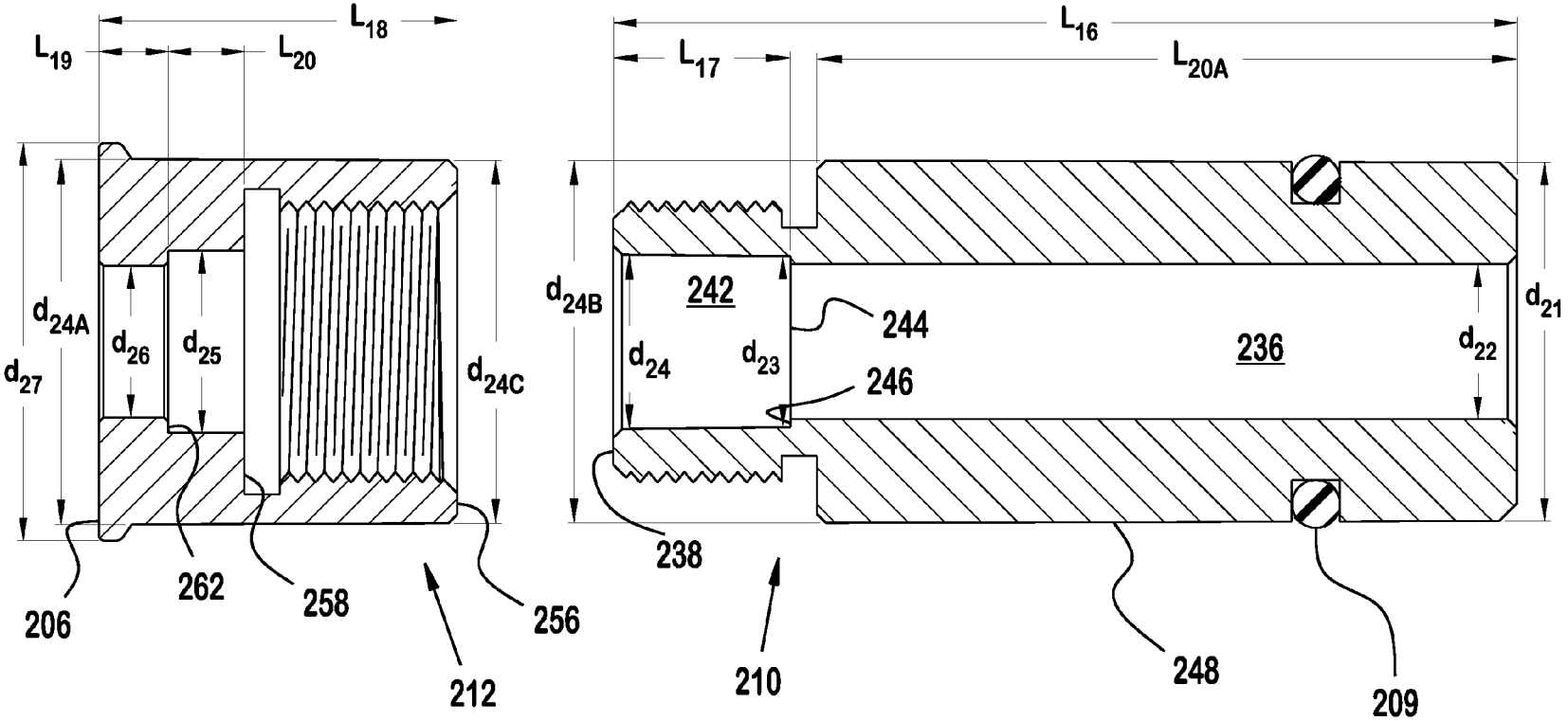
FIG. 37 shows a cross-sectional view of the drill cartridge adaptor of FIG. 32 along line 37-37.
Figure 38:
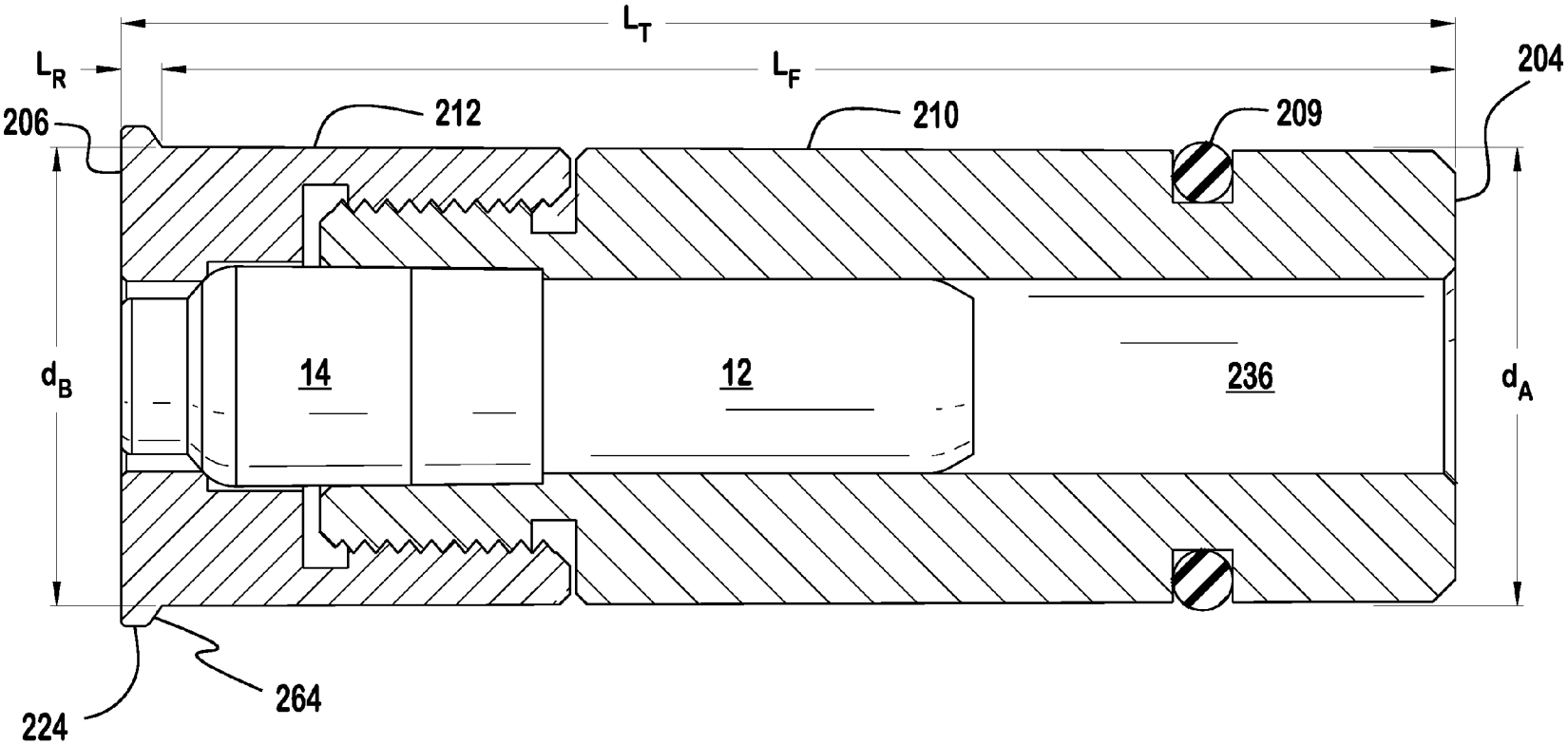
FIG. 38 shows a partial cross-sectional view of another embodiment of a drill cartridge assembly of the present invention.

In FIGS. 35 and 36, the rear end 206 of the shotgun cartridge adaptor has four projections 224 and a rear opening 226. The rear opening 226 of the rear casing 212 extends into the interior of the casing. Each projection 224 extends radially outward. Disposed between each adjacent pair of projections 224 is a bay (or stepped recess) 228 at the rear end 206 of the shotgun adaptor 202. Each projection 224 may extend beyond the outer diameter of the front casing 210. The bays (or recesses) 228 are configured and adapted to create space around the shotgun cartridge extractor(s) when the adaptor 202 is chambered into a shotgun barrel. In use, the shotgun cartridge adaptor 202 can be placed in the chamber of a shotgun with the bays positioned next to the cartridge extractor(s) so that the shotgun cartridge adaptor assembly is not ejected by the shotgun cartridge extractor(s) when the shotgun is racked.

Figure 33:
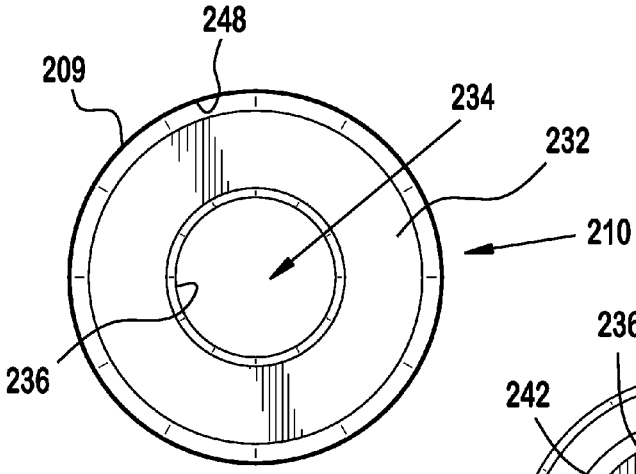
FIG. 33 is a front view of the casing of FIG. 31.
Figure 34:
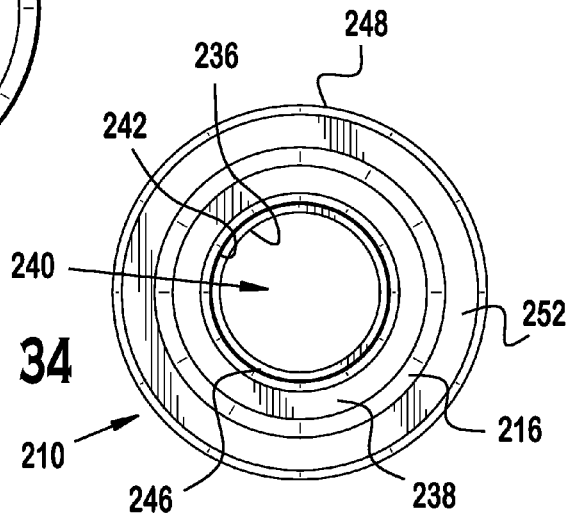
FIG. 34 is a rear view of the casing of FIG. 31.

Referring to FIGS. 33 and 34, the leading end of the front casing 232 has a front opening. The front opening 234 is defined by an inner surface 236 that extends from the leading end of the front casing 232 to the interior of the front casing. The rear end of the front casing 238 has a rear opening 240. As shown in FIG. 34, the rear opening 240 is defined by another inner surface 242 which extends from the rear end of the front casing 238 to the trailing end of the front opening 244.

Exemplary dimensions for the front casing 212 are described below and presented in Table 7A. The rear opening 240 has an inner diameter D23 and the front opening has an inner diameter D22. The inner diameter D23 of the rear opening is greater than the inner diameter D22 of the front opening. The rear projection 214 has an outer diameter D24A. As the front opening is counter sunk into the rear opening, the leading end of the rear opening 244 forms an interior end wall 246. The interior end wall 246 forms an annular bench where the rear opening 240 and the front opening 234 connect. The outer surface of the front casing 248 has a maximum outer diameter D21. The front casing 210 has a length L16 measured from the leading end of the front casing 232 to the rear end 238 of the front casing. The inner surface of the front casing's rear opening 242 has a length L17 measured from the rear end of the front casing 238 to the trailing end of the front opening 244.

Referring to FIGS. 34 and 30, the trailing end of the rear casing 206 has a rear opening 226. The rear opening 226 is defined by an inner surface 254 that extends from the trailing end 206 of the rear casing 212 to the interior of the rear casing 212. The leading end 256 of the rear casing has a front opening 220.

Exemplary dimensions for the rear casing 212 are described below and presented in Table 7A. The rear opening 226 has an inner diameter D26, the adjacent interior chamber has an inner diameter D25, and the innermost interior chamber has an inner diameter D24. The front opening 220 has an inner diameter D24B. The rear casing has a maximum outer dimension D27 measured from the outer edge of one projection 224 to the outer edge of the opposing projection 224. The rear casing has a length L18 measured from the leading end of the rear casing 256 to the trailing end of the rear casing 206. The rear opening 226 has a length L19 and the adjacent interior chamber has a length L20. The innermost interior chamber has a length of L20A. The front opening of the rear casing 220 has a length of L20B. Also, the dimensions of the shotgun adaptor 202 may be changed to accommodate shotgun cartridges of different gauges as presented in Table 7A.

TABLE 7A

| Shotgun Cartridge Adaptor | | | | | | | | |
|---|---|---|---|---|---|---|---|---|
| | | | Upper | Lower | Most Preferred Value | | | |
| Dimension | Upper Value (mm) | Lower Value (mm) | Preferred Value (mm) | Preferred Value (mm) | 20-Gauge (mm) | 16-Gauge (mm) | 12-Gauge (mm) | 10-Gauge (mm) |
| D21 | — | — | — | — | 17.4 | 18.6 | 20.23 | 21.5 |
| D22 | 9 | 4.6 | 8.78 | 8.7 | 8.74 | 8.74 | 8.74 | 8.74 |

TABLE 7A-continued

| Shotgun Cartridge Adaptor | | | | | | | | |
|---|---|---|---|---|---|---|---|---|
| | | | Upper | Lower | Most Preferred Value | | | |
| Dimension | Upper Value (mm) | Lower Value (mm) | Preferred Value (mm) | Preferred Value (mm) | 20-Gauge (mm) | 16-Gauge (mm) | 12-Gauge (mm) | 10-Gauge (mm) |
| D23 | 9.7 | 9.15 | 9.70 | 9.65 | 9.65 | 9.65 | 9.65 | 9.65 |
| D24 | 10 | 9.15 | 9.90 | 9.80 | 9.85 | 9.85 | 9.85 | 9.85 |
| D24A | — | — | — | — | 17.6 | 18.8 | 20.50 | 21.7 |
| D24B | — | — | — | — | 17.5 | 18.7 | 20.43 | 21.6 |
| D24C | — | — | — | — | 17.5 | 18.7 | 20.43 | 21.6 |
| D25 | — | — | — | — | 10.30 | 10.30 | 10.30 | 10.30 |
| D26 | — | — | — | — | 8.55 | 8.55 | 8.55 | 8.55 |
| D27 | — | — | — | — | 17.72 | 18.92 | 22.45 | 23.7 |
| L16 | 68.85 | 1 | 52 | 50 | 51.00 | 51.00 | 51.00 | 51.00 |
| L17 | 18 | 1 | 11 | 9 | 10 | 10 | 10 | 10 |
| L18 | 68.85 | 1 | 19 | 21 | 20.20 | 20.20 | 20.20 | 20.20 |
| L19 | — | — | — | — | 3.90 | 3.90 | 3.90 | 3.90 |
| L20 | — | — | — | — | 4.30 | 4.30 | 4.30 | 4.30 |
| L20A | 68.85 | 1 | 39 | 41 | 40 | 40 | 40 | 40 |

Referring to FIGS. 30, 31, 37 and 38 the drill cartridge 10 may be inserted into the shotgun adaptor 202. First, the front casing 210 is removed from the rear casing 212 by unscrewing the front casing 210 from the rear casing 212. The front end 22 of the drill cartridge 10 is inserted into the rear opening 240 of the front casing 210. The drill cartridge 10 is advanced into the first opening 240 until the outer annular surface 30 of the drill cartridge contacts the front casing interior end wall 246. The rear end 34 and intermediate section 40 of the drill cartridge 10 protrude from the rear opening 240 of the front casing 210. The front opening 220 of the rear casing 212 is coupled to the rear projection 214 of the front casing. For example, the rear casing 212 may be advanced onto the rear projection 214 using mating screw threads 216, 222 until the rear transition segment 42 of the drill cartridge 10 is seated against the proximal seat wall 262. Accordingly, a laser drill cartridge 10 may be locked into the shotgun cartridge adaptor 202 by the front casing interior end wall 246 and the rear casing proximal seat wall 262. At the same time, the rear segment 38 of the drill cartridge 10 may be disposed within the rear opening 226 of the rear casing 212. Preferably, the trailing end 34 of the drill cartridge 10 is flush with the rear end 206 of the shotgun adaptor. The trailing end 34 of the drill cartridge 10, however, may be recessed from the rear end 206 of the shotgun cartridge adaptor.

Further, there may be a tapered surface on the trailing end of the seat wall 262. The tapered surface may have a diameter of 8.55 mm and may be spaced 3.90 mm from the rear end 206 of the shotgun adaptor. The tapered surface may provide a common seating radius for the 9 mm drill cartridge described above and the 9 mm/223 drill cartridge described below. The common seating radius enables each of these drill cartridges to fit and operate within the shotgun adaptor such that the trailing end of the housed drill cartridge 10, 400 is flush with the rear end 206 of the shot gun adaptor.

The shotgun cartridge adaptor assembly has a length LT measured from the leading edge of the drill cartridge 204 to the rear end of the shotgun adaptor 206. Shotgun cartridge adaptor assembly has a length LF measured from the leading edge of the drill cartridge 204 to the base of front face 264 of the shotgun cartridge rim. Shotgun cartridge adaptor assembly has a length LR measured from the trailing edge of the drill cartridge 206 to the base of front face 264 of the shotgun cartridge rim. Exemplary dimensions for various 9 mm shotgun cartridge adaptor assemblies are presented in Table 7B.

TABLE 7B

| Exemplary Dimensions for Various Drill Cartridge/Shotgun Cartridge Adaptor Assemblies | | | | |
|---|---|---|---|---|
| Cartridge Adaptor | LT (mm) | LR (mm) | DB (mm) | DA (mm) |
| 20-Gauge | 60 | 1.52 | 17.6 | 17.4 |
| 16-Gauge | 60 | 1.65 | 18.8 | 18.6 |
| 12-Gauge | 60 | 1.84 | 20.5 | 20.23 |
| 10-Gauge | 60 | 1.91 | 21.7 | 21.5 |

Figure 39:
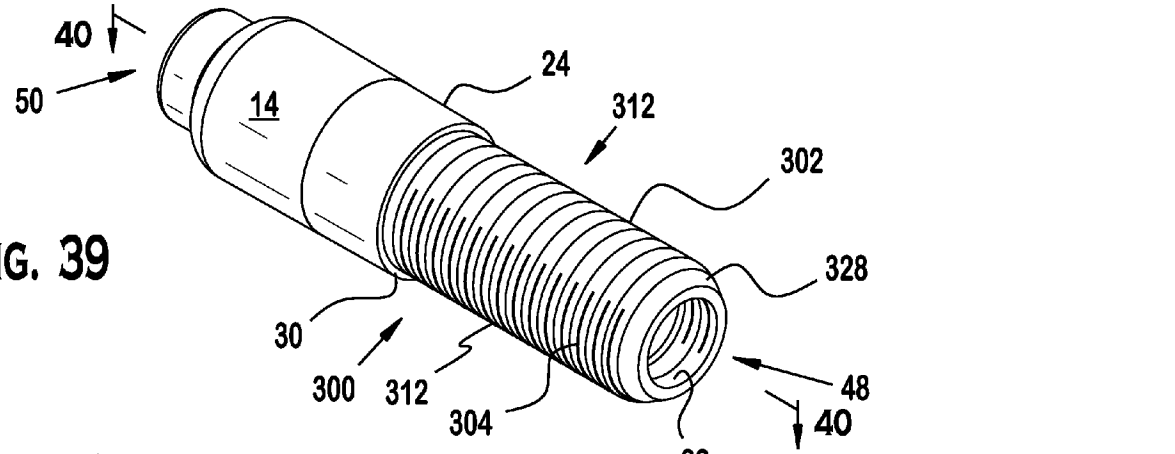
FIG. 39 shows a perspective view of an another embodiment of the drill cartridge of the present invention.
Figure 40:
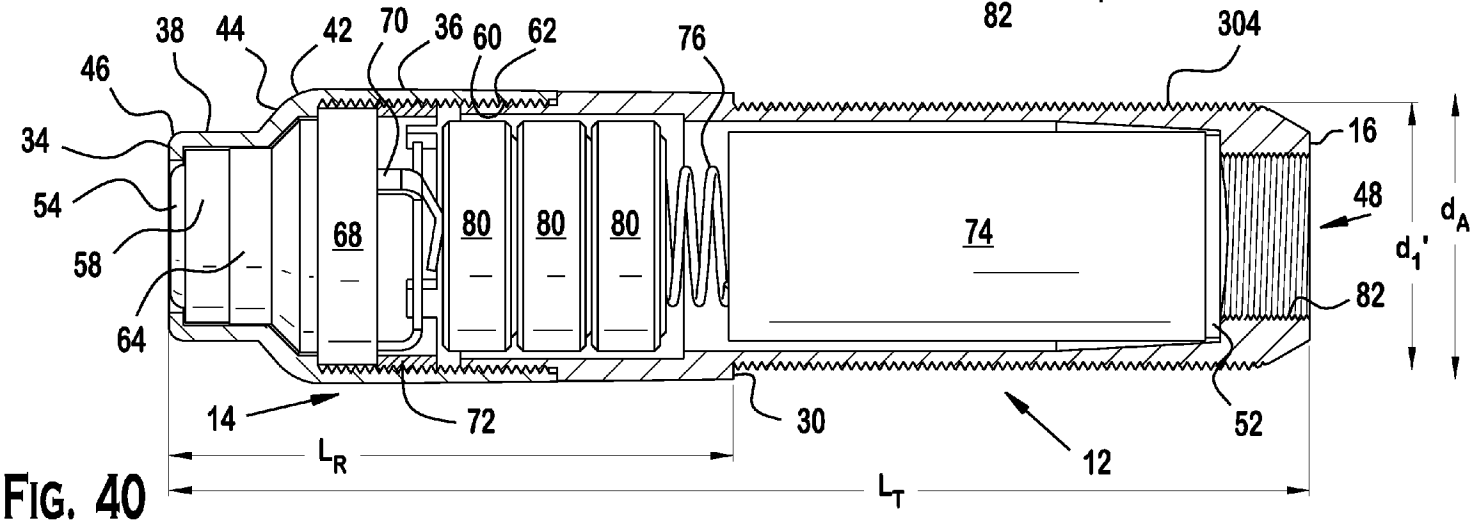
FIG. 40 shows a cross-sectional view of the device of FIG. 39, along line 40-40.

FIGS. 39 and 40 show another embodiment of the drill cartridge 300 of the present invention. In this illustrative embodiment, the drill cartridge 300 houses a light emitting dry fire training device and the intermediate section of the front casing 312 has a generally uniform outer diameter and includes an attachment mechanism 304. For instance, the attachment mechanism 304 may include a screw thread 304 on the outer surface of the intermediate section. Although the screw thread 304 may start at the trailing end of the front transition surface 28 and extend until the rear section 24 of the front casing, the screw thread 304 may extend over a smaller portion of the intermediate section, as long as the screw thread 304 provides a secure attachment mechanism for connecting the drill cartridge 300 to a selected cartridge adaptor or another accessory. In FIGS. 39-40, the features of the drill cartridge 300 and light emitting dry fire training device other than the attachment mechanism 304 may be smaller in structure but identical in function to the corresponding features of the drill cartridge of FIG. 1. For example, the total length LT of the drill cartridge may be 38.35 mm, the effective length LR of the assembly may be 17 mm, the effective diameter DA may be 9 mm, and the outer diameter D1' of intermediate section 312 may be 7 mm. Thus, the drill cartridge may be a base device which is smaller in size than the 9 mm drill cartridge of FIG. 1, but which may used in combination with any number of cartridge adaptors to simulate a larger caliber cartridge. Accordingly, a 2 mm thick threaded ring may be used with the base device to form a 9 mm cartridge adaptor assembly for a 9 mm chamber.

Figure 41:
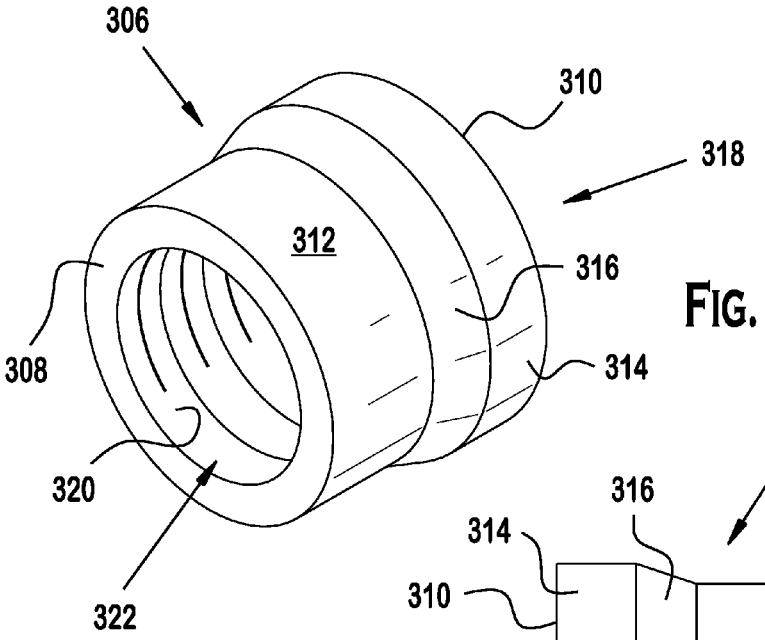
FIG. 41 shows a perspective view of another embodiment of a drill cartridge adaptor of the present invention.
Figure 42:
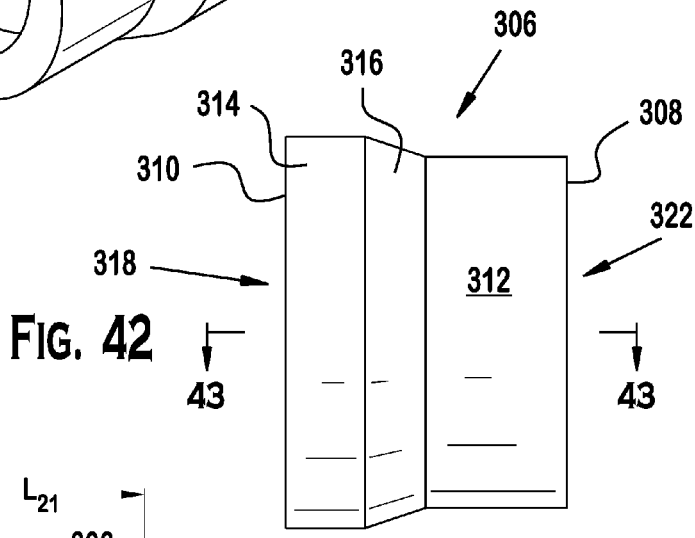
FIG. 42 shows a side view of the drill cartridge adaptor of FIG. 41.
Figure 43:
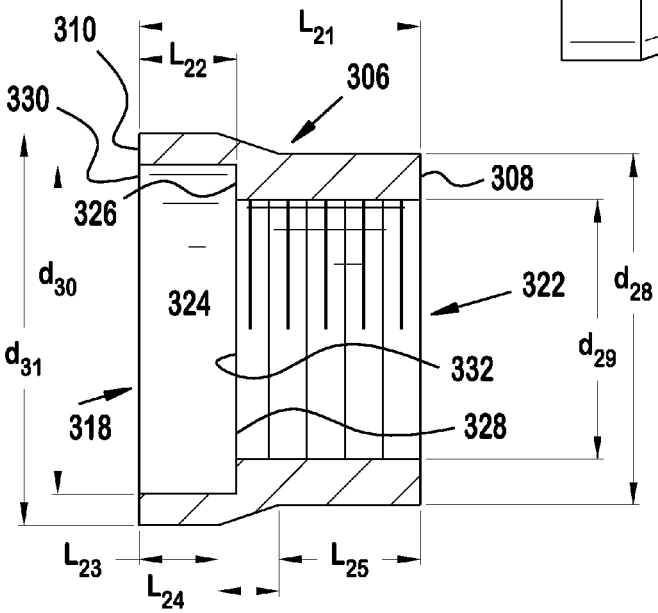
FIG. 43 shows a cross-sectional view of the drill cartridge adaptor of FIG. 42 along line 43-43.
Figure 54:
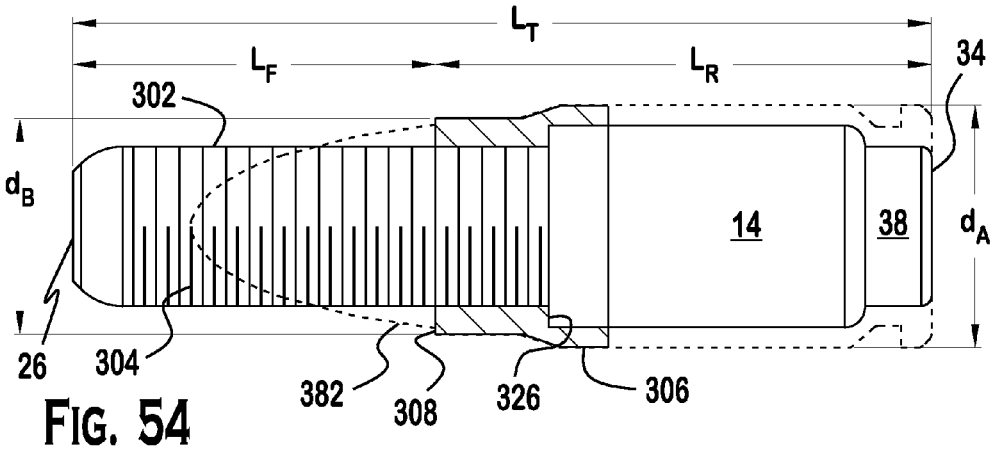
FIG. 54 shows a partial cross-sectional view of the assembly of FIG. 51 with a profile of a .357 SIG Sauer Caliber cartridge.

FIGS. 41-43 show a .357 SIG Sauer cartridge adaptor 306, in accordance with an embodiment of the present invention. The adaptor 306 has a front end 308, a rear end 310, and an outer surface 311 extending from the front end 308 to the rear end 310. The outer surface may include a first segment 312 abutting the front end 308 having a generally uniform outer diameter D28, a second segment abutting the rear end having a generally uniform outer diameter D31, and a third section disposed between the first section and the second section having a generally non-uniform outer diameter. In this embodiment, the outer diameter of the second section is greater than the outer diameter of the first section D28, and the outer diameter of the third section D31 is greater than the outer diameter of the second section. As shown in FIG. 43, the outer diameter of the third section transitions uniformly from the first section to the second section. Referring to FIG. 54, the profile of the cartridge adaptor 306 simulates a portion of the profile 382 of a .357 SIG cartridge. For example, as shown in FIG. 43, the first segment may have length L25, the second segment may have length L24, and the third segment may have length L23.

As shown in FIGS. 42-43, the cartridge adaptor 306 includes a rear opening 318 and a front opening 322. The rear opening 318 is defined by a rear interior side wall 324 which extends from the rear end 310 toward an interior of the adaptor. In this embodiment, the rear interior side wall 324 is smooth and generally defines a rear circular cylindrical passage having diameter D30. Similarly, the front opening 322 is defined by a front interior side wall 358 which extends from the front end 308 toward an interior of the adaptor. In this embodiment, the front interior side wall 358 defines a front circular cylindrical passage having diameter D29 and a screw thread 320.

The front and rear passages are aligned on a common central axis. The passages intersect within the cartridge adaptor. At the intersection of the two passages, the rear passage forms an annular end wall 326 around the front passage. In the embodiment of FIGS. 41-43, the cartridge adaptor has a length L21 measured from the rear end 310 to the front end 308. The rear interior passage has a length L22 measured from the rear end to the annular end wall 326.

Table 8A lists preferred dimensions for the cartridge adaptor of FIGS. 41-43.

TABLE 8A

.357 SIG Cartridge Front Mounting Adaptor

| Dimension | Preferred Value (mm) |
|---|---|
| L21 | 7.7 |
| L22 | 2.65 |
| L23 | 2.2 |
| L24 | 1.65 |
| L25 | 3.85 |
| D28 | 9.65 |
| D29 | 7.1 |
| D30 | 9.1 |
| D31 | 10.75 |

Figure 51:
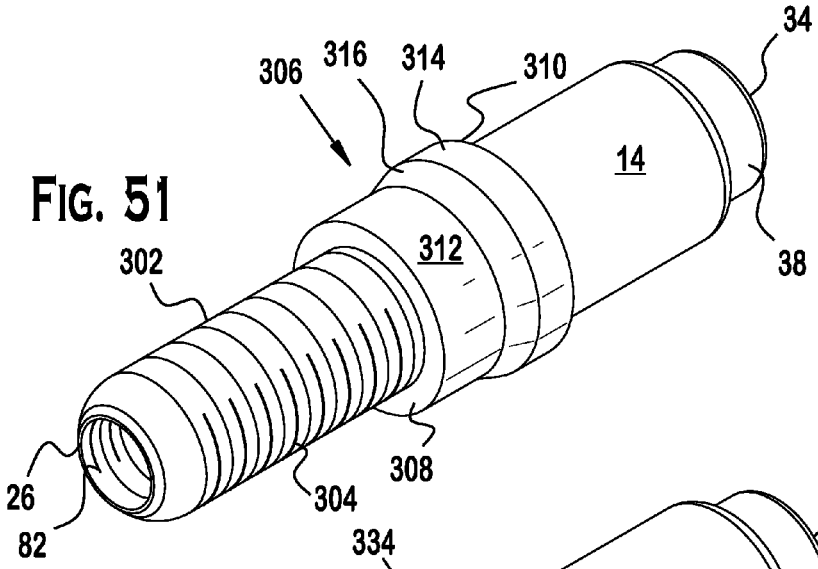
FIG. 51 shows a perspective view of another embodiment of a drill cartridge adaptor assembly of the present invention.

Referring to FIGS. 51 and 54, the cartridge adaptor 306 may be combined with the drill cartridge 300 of FIG. 39 to form a drill cartridge assembly for a firearm having a chamber and barrel that are compatible with a .357 SIG cartridge. As shown in FIG. 54, the assembly may have a total length LT measured from the trailing end of the rear casing 34 to the leading end of the front casing 26. The apparatus may have a length LF measured from the front end 26 of the cartridge to the front end of the adaptor 308. The assembly may have a length LR measured from the trailing end of the rear cartridge 34 to the front end of the adaptor 308. The assembly may have a maximum outer diameter DA. Table 8B lists exemplary dimensions for the apparatus of FIG. 54.

TABLE 8B

Dry Fire Training Device/.357 SIG Cartridge Adaptor Assembly

| Cartridge Adaptor | LT (mm) | LR (mm) | DA (mm) | DB (mm) |
|---|---|---|---|---|
| .357 SIG Sauer | 38.35 | 22 | 10.75 | 9.65 |

Although the .357 adaptor 306 has a generally circular cross section, the adaptor may have other cross-sectional shapes provided the interior passage is sized to receive the rear section of the front casing and the front interior passage mates with the front casing. For example, the adaptor may have a polygonal cross-section. Similarly, the cross-section of the interior passages, the front opening, and the rear opening may have a non-circular shape, such as an octagonal cross section, provided the rear passage is sized to receive the rear section of the front casing and the front opening is sized to receive the front section of the front casing.

The adaptor ring may be formed from metal or metal alloy. For example, the ring may be formed from aluminum or stainless steel, such as 306 SS. Other metals may include brass, steel, and titanium. The adaptor may be formed from a polymeric material or a graphite composite material.

Figure 44:
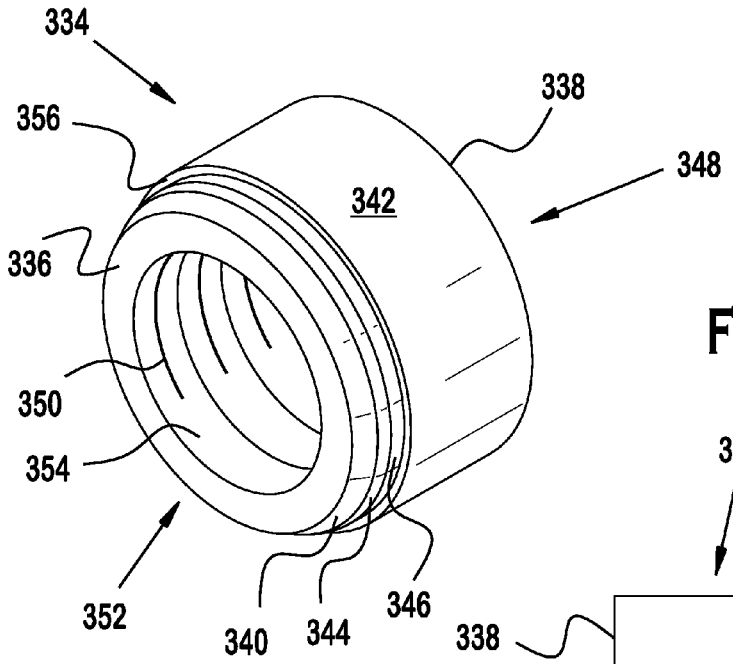
FIG. 44 shows a perspective view of another embodiment of a drill cartridge adaptor of the present invention.
Figure 45:
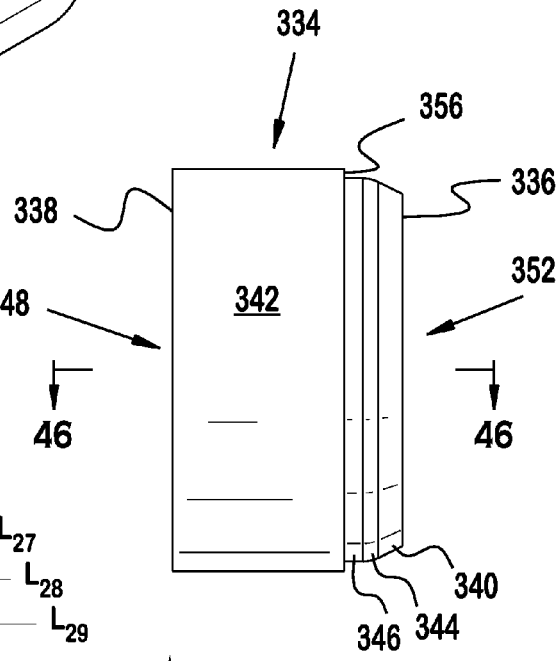
FIG. 45 shows a side view of the drill cartridge adaptor of FIG. 44.
Figure 46:
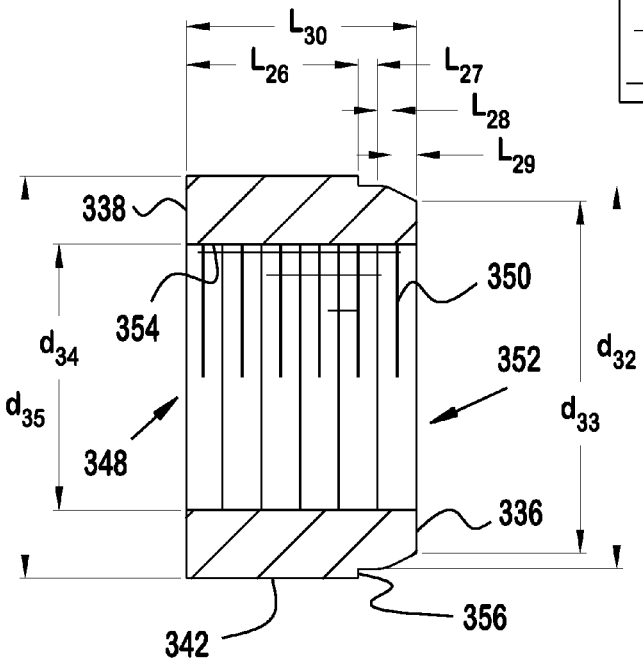
FIG. 46 shows a cross-sectional view of the drill cartridge adaptor of FIG. 45 along line 46-46.

FIGS. 44-46 show a .40 Smith & Wesson cartridge adaptor 334. The adaptor 334 has a front end 336, a rear end 338, and an outer surface extending from the front end 336 to the rear end 338. The outer surface may include a first segment 340 abutting the front end 336 having a generally uniform outer diameter D33, a second segment 342 abutting the rear end 338 having a generally uniform outer diameter D35, and a third and fourth segment 344, 346 disposed between the first segment 340 and the second segment 342. In this embodiment, the outer diameter of the second segment D35 is greater than the outer dimension of the other segments, which decrease progressively toward the front end 336. As shown in FIG. 46, the fourth segment 346 may have a generally uniform diameter D32.

Figure 55:
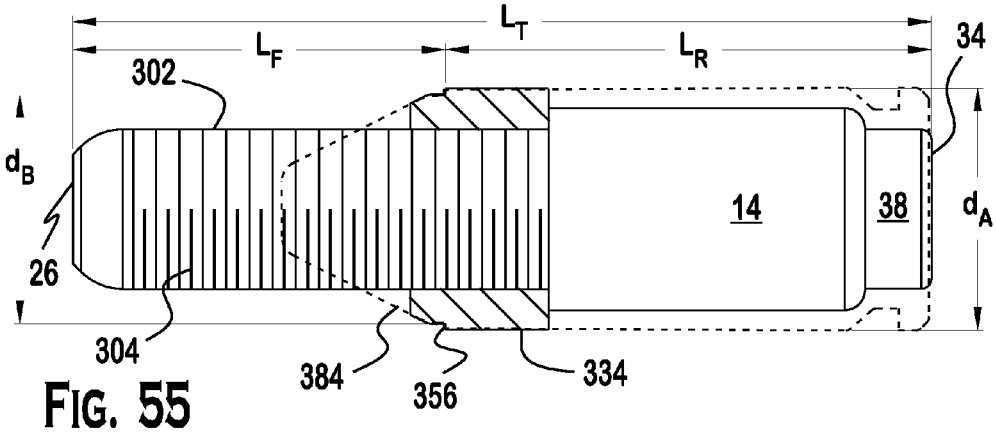
FIG. 55 shows a partial cross-sectional view of the assembly of FIG. 52 along with a profile of a .40 Smith & Wesson Caliber cartridge.

Referring to FIG. 55, the profile of the cartridge adaptor 334 simulates a portion of the profile 384 of a .40 Smith & Wesson cartridge. For example, as shown in FIG. 46, the first segment 340 may have a length L29, the second segment 342 may have a length L26, and the third and fourth segments may have lengths L28 and L29, respectively. The cartridge adaptor 334 may have a length L30 measured from the rear end 338 to the front end 336.

As shown in FIGS. 44-46, the cartridge adaptor 334 includes a rear opening 348 and a front opening 352. The rear opening 348 is defined by an interior side wall which extends from the rear end 338 to the front end 336 of the adaptor. In this embodiment, the interior side wall 354 defines a generally circular cylindrical passage having diameter D34 and a screw thread 350.

Table 9A lists preferred dimensions for the cartridge adaptor of FIGS. 44-46.

TABLE 9A

| .40 Smith & Wesson Cartridge Front Mounting Adaptor | |
|---|---|
| Dimension | Preferred Value (mm) |
| L26 | 4.6 |
| L30 | 6.15 |
| D32 | 10.15 |
| D33 | 9.3 |
| D34 | 7.1 |
| D35 | 10.65 |

Figure 52:
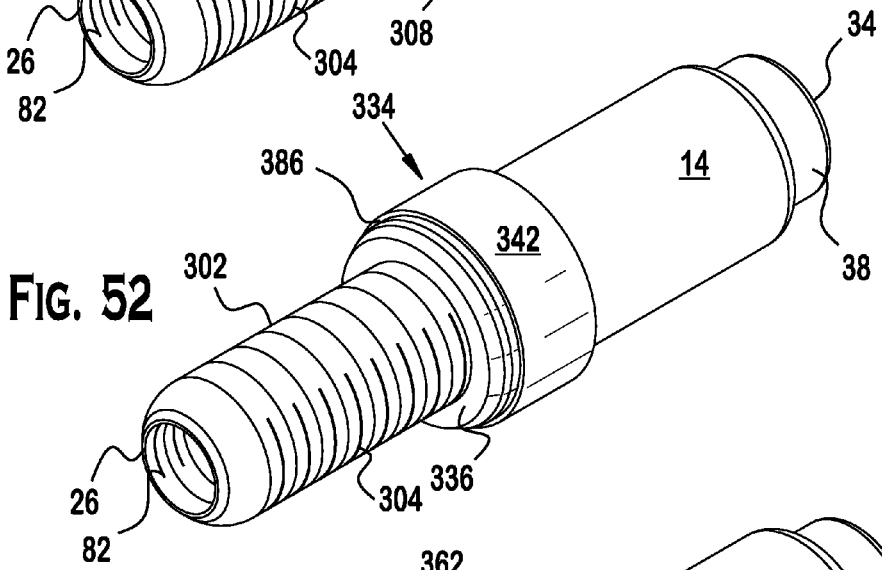
FIG. 52 shows a perspective view of another embodiment of a drill cartridge adaptor assembly of the present invention.

Referring to FIGS. 52 and 55, the cartridge adaptor 334 may be combined with the 9 mm drill cartridge 300 of FIG. 39 to form a drill cartridge assembly for a firearm having a chamber and barrel that are compatible with a .40 Smith & Wesson cartridge. As shown in FIG. 55, the assembly may have a total length LT measured from the trailing end of the rear casing 34 to the leading end of the front casing 26. The apparatus may have a length LR measured from the trailing end of the rear cartridge 34 to the exterior side wall 356. The apparatus may have a length LF measured from the front end of the 26 cartridge to the exterior side wall 356. The apparatus may have a maximum outer diameter DA. Table 9B lists exemplary and preferred dimensions for the assembly of FIG. 55.

TABLE 9B

| Dry Fire Training Device/.40 S&W Cartridge Front Mounting Adaptor Assembly | | | | |
|---|---|---|---|---|
| Cartridge Adaptor | LT (mm) | LR (mm) | DA (mm) | DB (mm) |
| .40 S&W (FM) | 38.35 | 21.6 | 10.65 | 10.15 |

Although the .40 Smith & Wesson adaptor 334 has a generally circular cross section, the adaptor may have other cross-sectional shapes provided the interior passage is sized to receive the rear section of the front casing and the front interior passage mates with the front casing. For example, the adaptor may have a polygonal cross-section. Similarly, the cross-section of the interior passage, the front opening, and the rear opening may have a non-circular shape, such as an octagonal cross section, provided the internal passage is sized to receive the front section of the front casing.

The adaptor ring may be formed from metal or metal alloy. For example, the ring may be formed from aluminum or stainless steel, such as 306 SS. Other metals may include brass, steel, and titanium. The adaptor may be formed from a polymeric material, a fiber reinforced polymer, a carbon reinforced polymer, or a carbon nanotube reinforced polymer.

Figure 47:
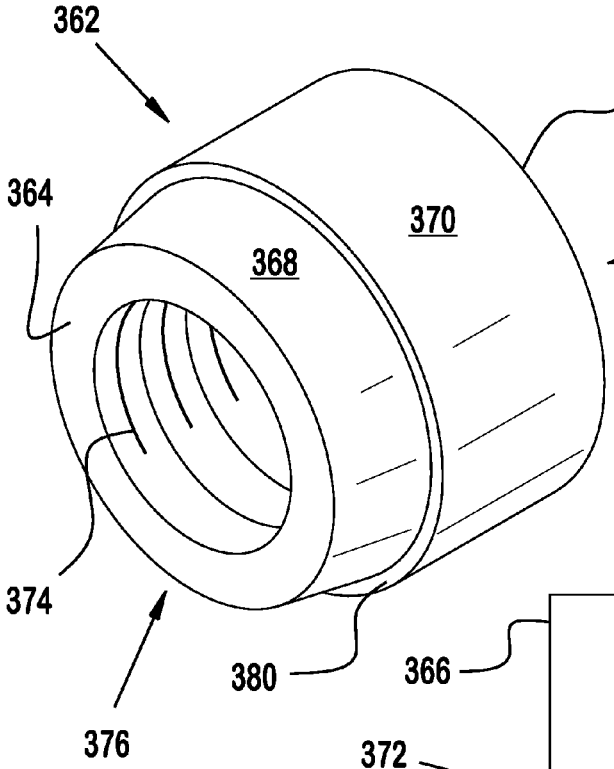
FIG. 47 shows a perspective view of another embodiment of a drill cartridge adaptor of the present invention.
Figure 48:
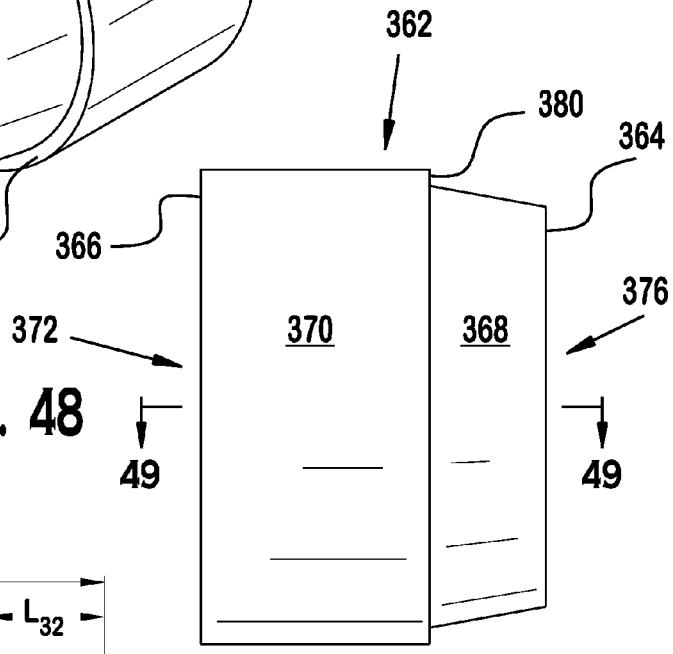
FIG. 48 shows a side view of the drill cartridge adaptor of FIG. 47.
Figure 49:
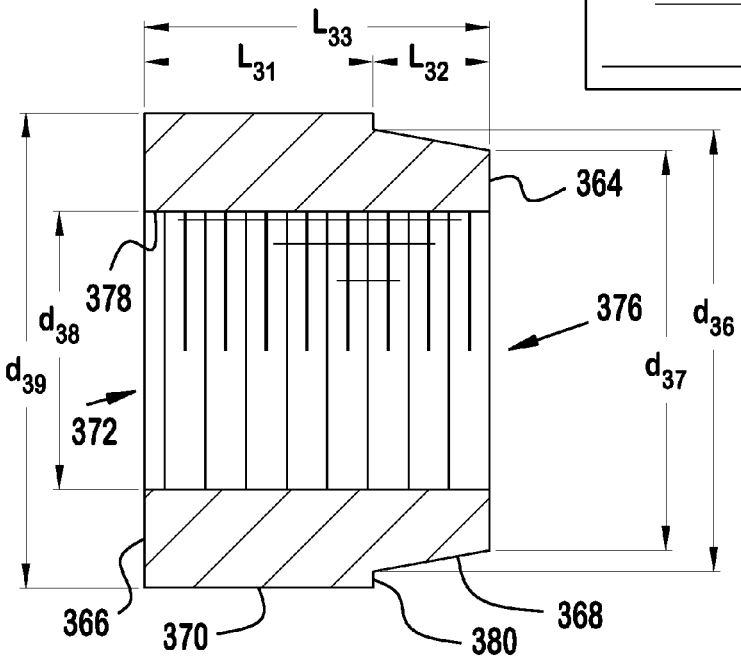
FIG. 49 shows a cross-sectional view of the drill cartridge adaptor of FIG. 48 along line 49-49.

FIGS. 47-49 show a .45 ACP cartridge adaptor 362, in accordance with an embodiment of the present invention. The adaptor 362 has a front end 364, a rear end 366, and an outer surface extending from the front end 364 to the rear end 366. The outer surface may include a first segment 368 abutting the front end 364 having a generally non-uniform outer dimension ranging from a maximum outer diameter D36 to a minimum outer diameter D37. The outer surface further may include a second segment 370 abutting the rear end 366 having a generally uniform outer diameter D39. The first segment 368 and the second segment 370 may be joined by an annular side wall 380. In this embodiment, the outer diameter of the second segment D39 is greater than the outer dimension of the first segment, which decreases progressively toward the front end 364.

Figure 56:
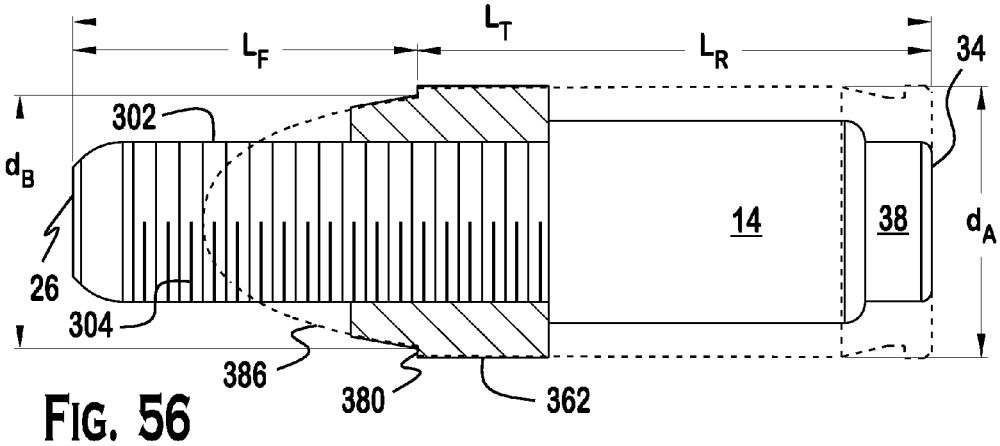
FIG. 56 shows a partial cross-sectional view of the assembly of FIG. 53 along with a profile of a .45 ACP Caliber cartridge.

Referring to FIG. 56, the profile of the cartridge adaptor 362 simulates a portion of the profile 386 of a .45 ACP cartridge. For example, as shown in FIG. 49, the first segment 368 may have a length L32. The second segment 370 may have a length L31. And, the cartridge adaptor 362 may have a length L33 measured from the rear end 366 to the front end 364.

As shown in FIGS. 47-49, the cartridge adaptor 362 includes a rear opening 372 and a front opening 376. The rear opening 372 is defined by an interior side wall 378 which extends from the rear end 366 to the front end 364 of the adaptor. In this embodiment, the interior side wall defines a generally circular cylindrical passage having diameter D38 and a screw thread 374.

Figure 50:
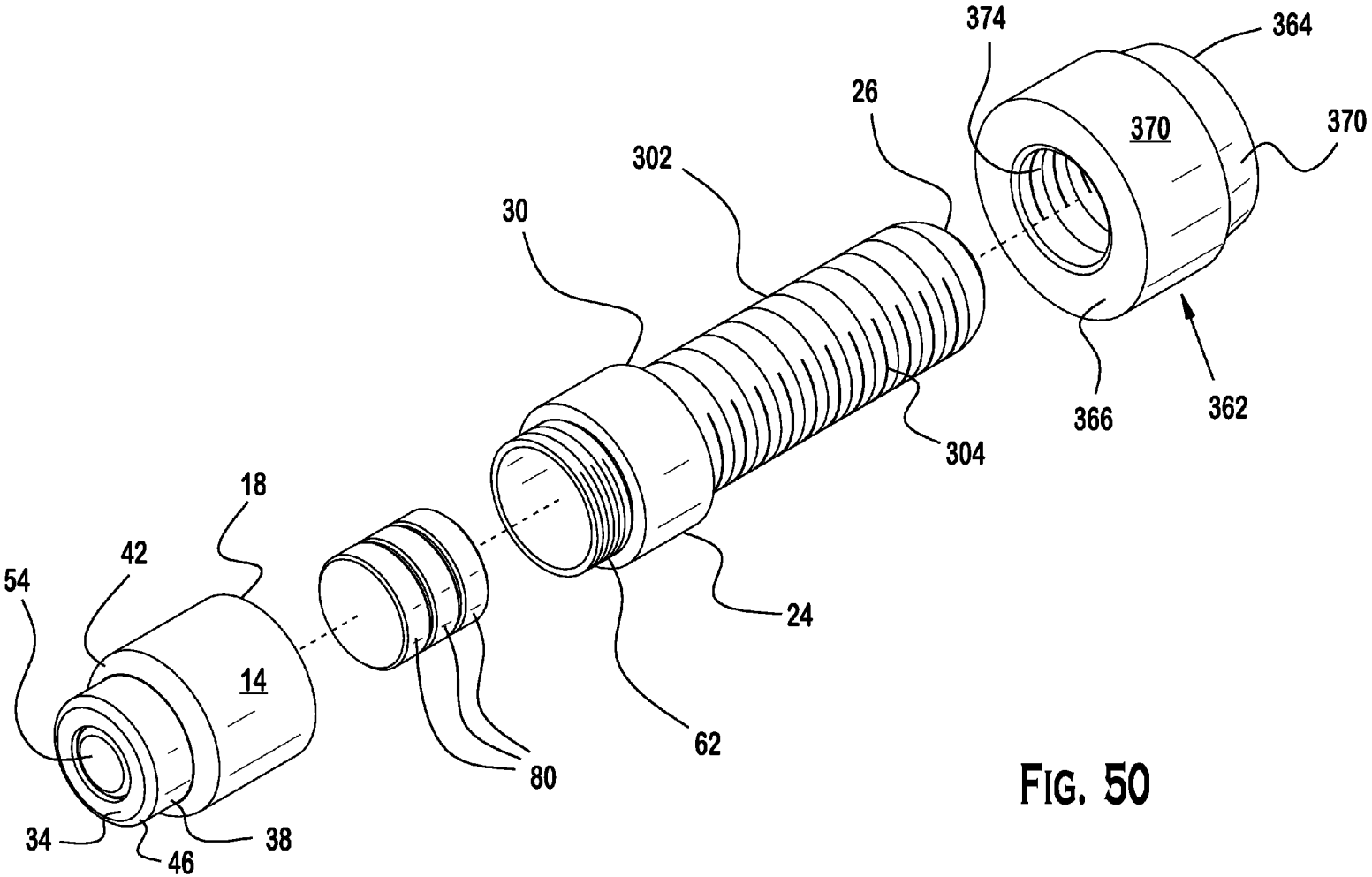
FIG. 50 shows a partially exploded view of an exemplary embodiment of a drill cartridge assembly of the present invention.

Table 10A lists preferred dimensions for the cartridge adaptor of FIGS. 50-52.

TABLE 10A

| .45 ACP Cartridge Front Mounting Adaptor | |
|---|---|
| Dimension | Preferred Value (mm) |
| L31 | 5.85 |
| L33 | 8.80 |
| D36 | 11 |
| D37 | 10 |
| D38 | 7.1 |
| D39 | 11.9 |

Figure 53:
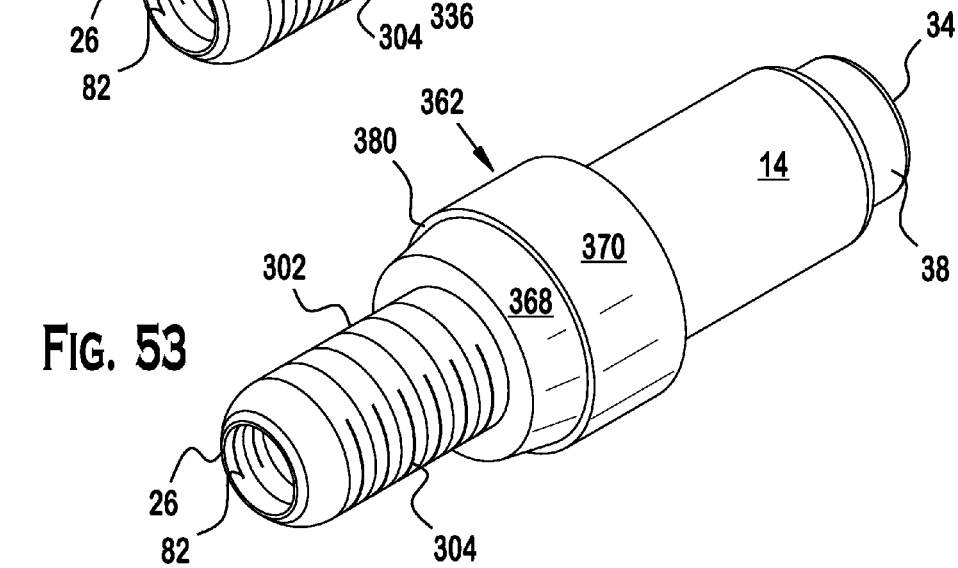
FIG. 53 shows a perspective view of the assembly of FIG. 50.

Referring to FIGS. 50, 53 and 56, the cartridge adaptor 362 may be combined with the 9 mm drill cartridge 300 of FIG. 39 to form a drill cartridge for a firearm having a chamber and barrel that are compatible with a .45 ACP cartridge.

FIG. 50 shows an exploded view of an illustrative drill cartridge assembly that houses a light emitting dry fire training device. The assembly is constructed by screwing the adaptor ring 362 onto the front section 302 of the drill cartridge 300 of FIG. 39. The rear end 366 of the adaptor 362 is advanced over the external screw thread 304 on the front casing until the rear end 366 contacts the outer annular surface 30 of the drill cartridge of FIG. 39. For example, the adaptor may be rotated clockwise with respect to the front casing to advance the adaptor until it is seated against the outer annular surface of the front casing. A power supply 80 then may be inserted into the front casing 312 and the rear casing may be threaded onto the external screw thread 362 to enclose and secure the internal components of the light emitting dry fire training device.

As shown in FIG. 56, the assembly may have a total length LT measured from the trailing end of the rear casing 34 to the leading end of the front casing 26. The apparatus may have a length LR measured from the trailing end of the rear cartridge 34 to the exterior side wall 380. The apparatus may have a maximum outer diameter DA. Table 10B lists exemplary dimensions for the apparatus of FIG. 56.

TABLE 10B

| Dry Fire Training Device/.45 ACP Cartridge Front Mounting Adaptor Assembly | | | | |
|---|---|---|---|---|
| Cartridge Adaptor | LT (mm) | LR (mm) | DA (mm) | DB (mm) |
| .45 ACP(FM) | 38.35 | 22.85 | 11.9 | 11 |

Although the .45 ACP adaptor 362 has a generally circular cross section, the adaptor may have other cross-sectional shapes provided the interior passage is sized to receive the rear section of the front casing and the front interior passage mates with the front casing. For example, the adaptor may have a polygonal cross-section. Similarly, the cross-section of the interior passage, the front opening, and the rear opening may have a non-circular shape, such as an octagonal cross section, provided the internal passage is sized to receive the front section of the front casing.

The adaptor ring may be formed from metal or metal alloy. For example, the ring may be formed from aluminum or stainless steel, such as 306 SS. Other metals may include brass, steel, and titanium. The adaptor may be formed from a polymeric material or a graphite composite material.

Tables 11A and 11B summarize the change in total length (Δ LT), effective length (Δ LR), and effective diameter (Δ DA) that exemplary cartridge adaptors may have on the preferred embodiment of the 9 mm drill cartridge and threaded base device.

TABLE 11A

Effective Lengths and Diameters Of 9 mm Drill Cartridge Assemblies

| Drill Cartridge Assembly | LT (mm) | LR (mm) | LF (mm) | DA (mm) | Δ LT (mm) | Δ LR (mm) | Δ DA (mm) |
|---|---|---|---|---|---|---|---|
| .40 S&W (RM) | 39.15 | 21.70 | 17.55 | 10.74 | 0.90 | 2.7 | 1.09 |
| .45 ACP (RM) | 39.15 | 23 | 16.25 | 12 | 0.90 | 4 | 2.35 |
| .45 GAP (RM) | 39.15 | 19.20 | 19.75 | 12 | 0.90 | 0.20 | 2.35 |
| .45 Long Colt | 38.35 | 1.5 | 36.85 | 12.10 | 0.00 | −17.50 | 2.5 |
| 20-Gauge Shotgun | 60 | 1.52 | 58.48 | 17.4 | 21.65 | −17.48 | 7.80 |
| 16-Gauge Shotgun | 60 | 1.65 | 58.35 | 18.6 | 21.65 | −17.35 | 9 |
| 12-Gauge Shotgun | 60 | 1.84 | 58.16 | 20.23 | 21.65 | −17.16 | 10.63 |
| 10-Gauge Shotgun | 60 | 1.91 | 58.09 | 21.50 | 21.65 | −17.09 | 11.9 |

(a) $\Delta LT = LT_{assembly} - LT_{9\ mm\ Drill\ Cartridge}$
(b) $\Delta LR = LR_{assembly} - LR_{9\ mm\ Drill\ Cartridge}$
(c) $\Delta DA = DA_{assembly} - DA_{9\ mm\ Drill\ Cartridge}$

TABLE 11B

Effective Lengths and Diameters Of Threaded Base Device Drill Cartridge Assemblies

| Drill Cartridge Assembly | LT (mm) | LR (mm) | LF (mm) | DA (mm) | Δ LT (mm) | Δ LR (mm) | Δ DA (mm) |
|---|---|---|---|---|---|---|---|
| .357 SIG Sauer | 38.35 | 22 | 16.35 | 10.75 | 0.00 | 5 | 1.75 |
| .40 S&W (FM) | 38.35 | 21.70 | 16.65 | 10.74 | 0.00 | 4.7 | 1.74 |
| .45 ACP(FM) | 38.35 | 23.00 | 15.35 | 12 | 0.00 | 6 | 3 |

Figure 57:
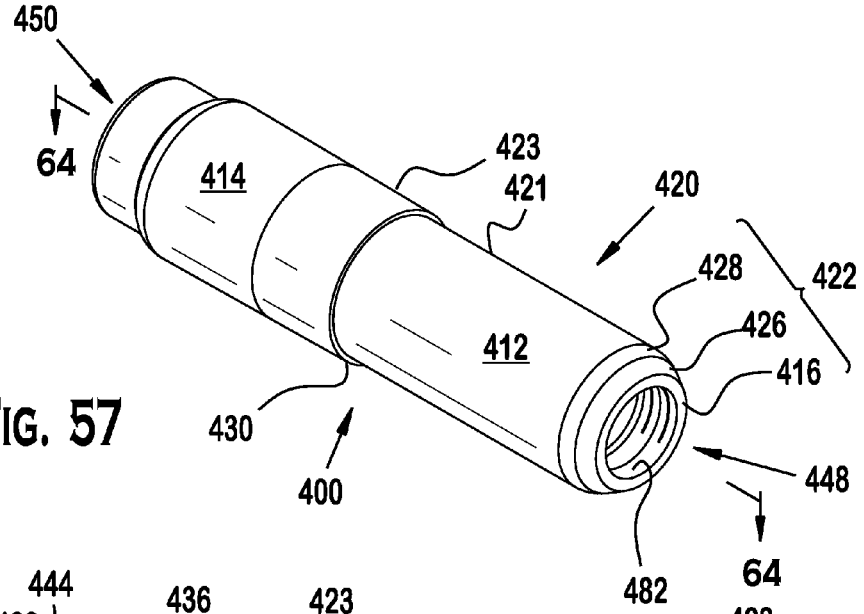
FIG. 57 shows a perspective view of another embodiment of the drill cartridge of the present invention.
Figure 58:
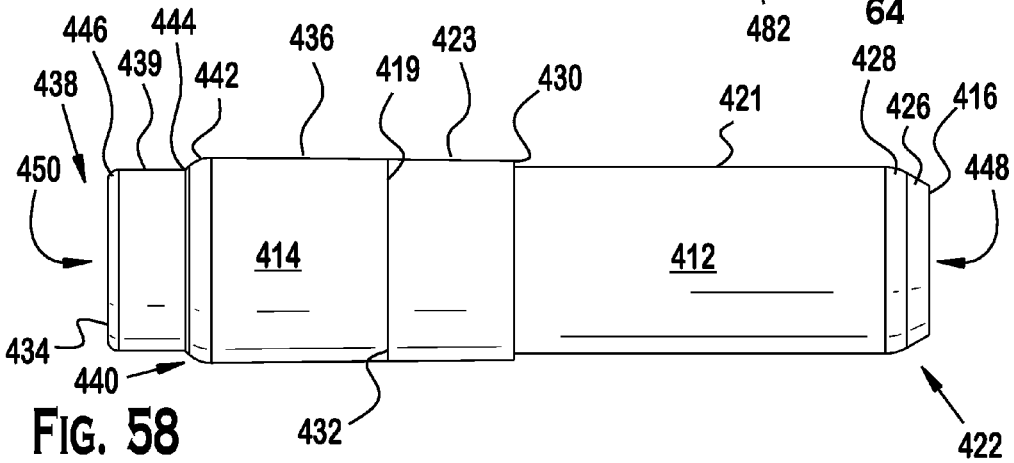
FIG. 58 shows a side view of the device of FIG. 57.
Figure 59:
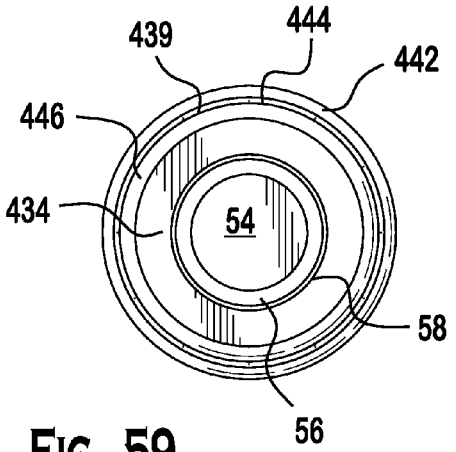
FIG. 59 shows a front view of the device of FIG. 57.
Figure 60:
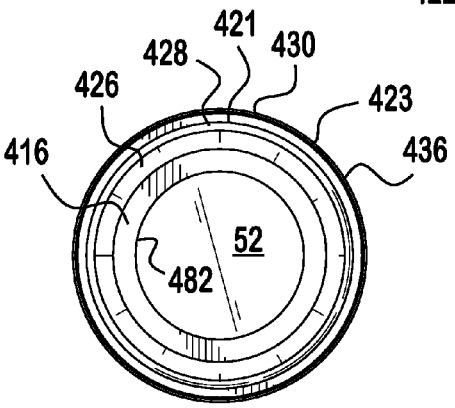
FIG. 60 shows a rear view of the device of FIG. 57.
Figure 61:
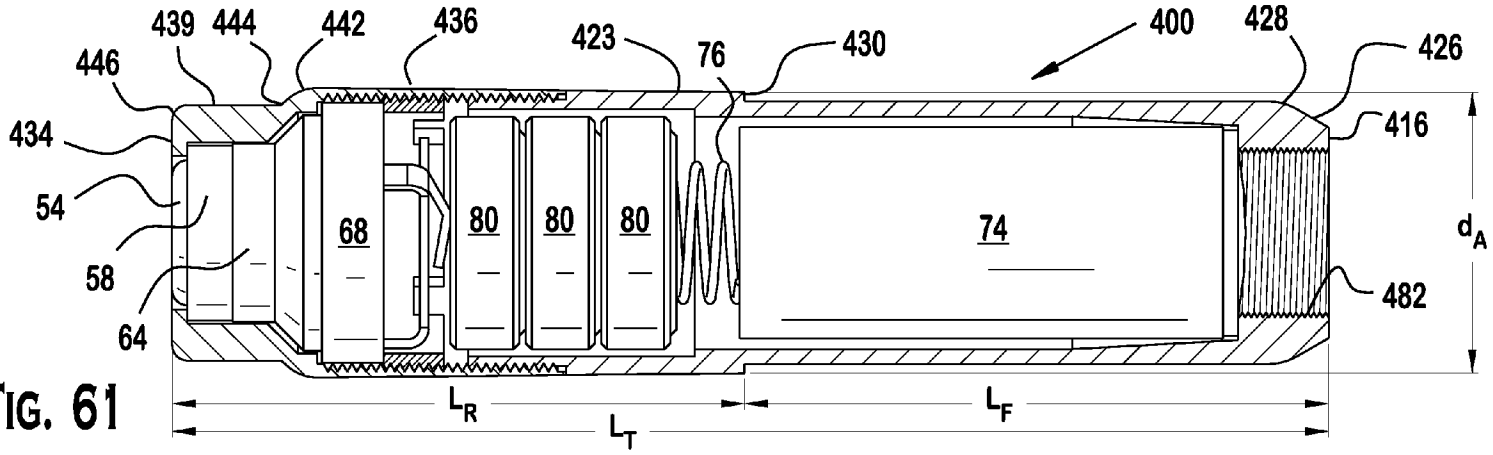
FIG. 61 shows a cross-sectional view of the device of FIG. 57 along line 61-61.

(a) $\Delta LT = LT_{assembly} - LT_{Threaded\ Base\ Device}$
(b) $\Delta LR = LR_{assembly} - LR_{Threaded\ Base\ Device}$
(c) $\Delta DA = DA_{assembly} - DA_{Threaded\ Base\ Device}$ FIG. 57 shows another embodiment of the drill cartridge 400 of the present invention. In this embodiment, the drill cartridge 400 is suitable for use in a 9 mm handgun or a .223 caliber rifle. The drill cartridge may include a front casing 412 and a rear casing 414 which cooperate to form a housing for internal components of the drill cartridge.

Figure 62:
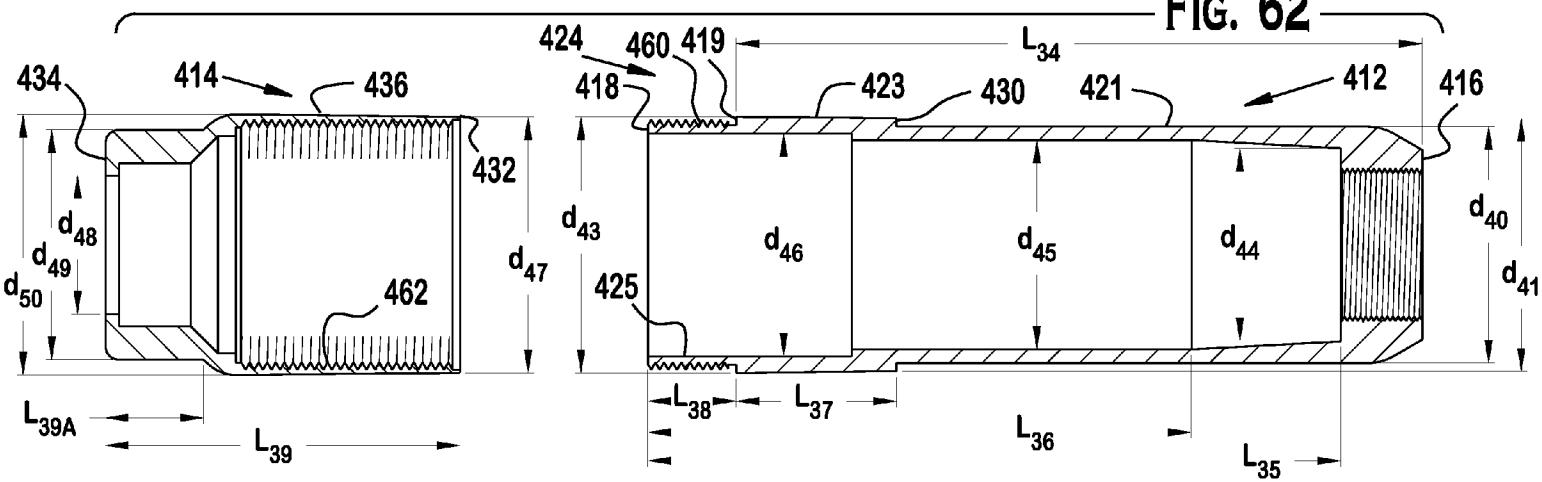
FIG. 62 shows an exploded view of the housing of FIG. 61.
Figure 63:
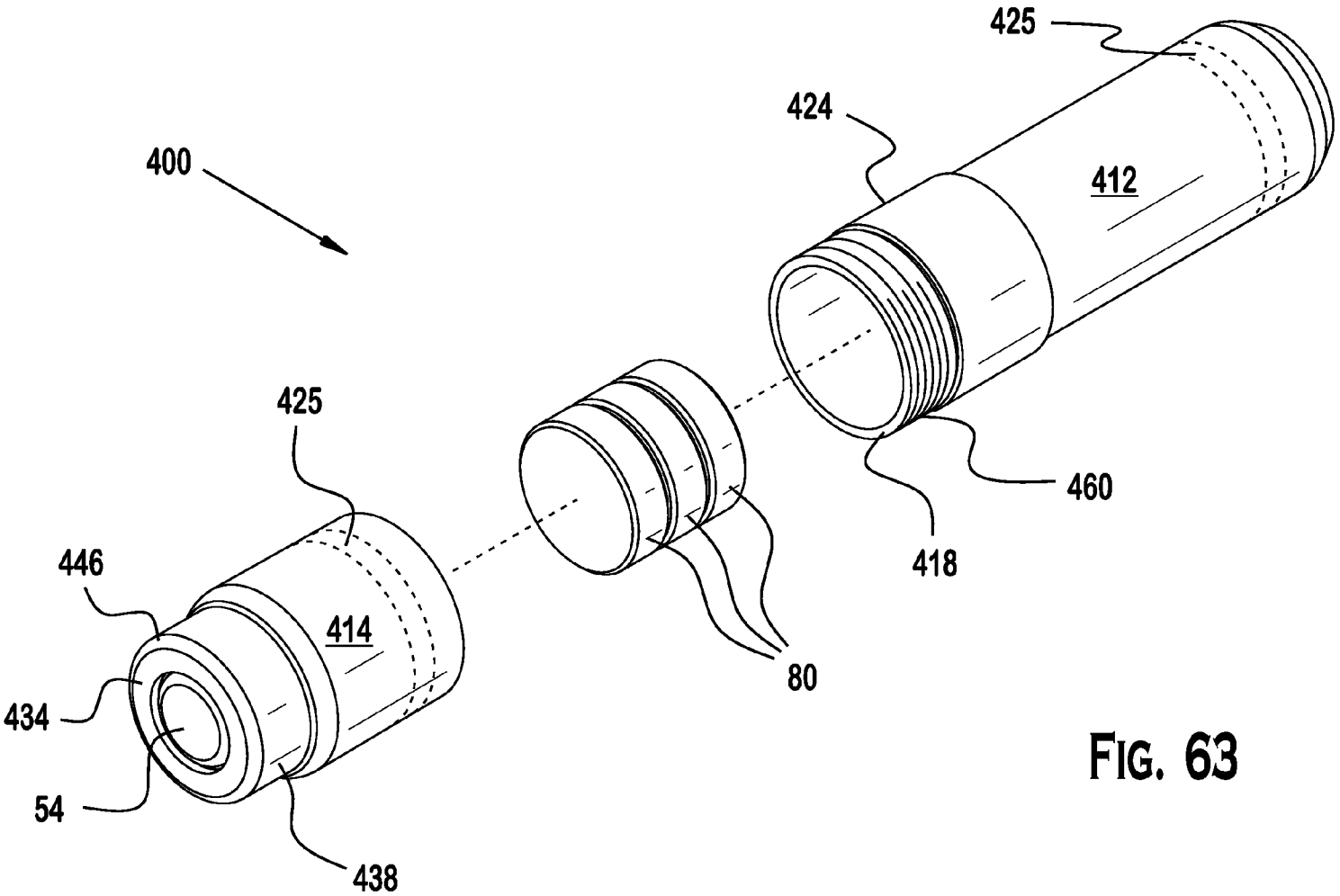
FIG. 63 shows a partially exploded view of the drill cartridge of FIG. 57.

Referring to FIGS. 58-63, the front casing 412 may have a leading edge 416 and a trailing edge 418 (See FIG. 62). The front casing may include a front section 422, intermediate section 420, and a rear section 424 (See FIG. 62). The front section 422 may include a front face 416 that defines a leading edge of the front casing, a leading side surface 426, and a front side transition surface 428. The intermediate section 420 of the front casing 412 may include a cylindrical portion 421 having generally uniform dimension. As shown in FIG. 62, the rear section 424 may include another cylindrical portion 423 having generally uniform dimension and a rear projection 425 of generally lesser outer dimension than the cylindrical portion 423. The rear projection 425 may further include a securing element 460 for connecting with the rear casing 414. For example, the securing mechanism 460 may be a screw thread that is disposed on the outside of the rear projection. The transition between the intermediate section 420 of the front casing and the rear section 424 of the front casing may include a surface 430 extending between the cylindrical portion 421 and the other cylindrical portion 423. The surface 430 may form an outer annular surface 430.

The rear casing may be a series of cylindrical segments of varying diameter that are disposed between a leading end 432 and a trailing end 434. For example, the rear casing may include a front section 436, a rear section 438, and an intermediate section 440. The front section 436 may include a generally cylindrical segment that increases in diameter from the leading end of the rear casing 432 to a point where the diameter reaches a maximum value. The intermediate section 440 may include the portion of the rear casing in which the outer diameter of the rear casing decreases from its widest point until reaching a rear cylindrical portion 438 of the casing having generally uniform dimension. For example, the intermediate section 440 may include a rear transition surface 442 and a rear tapered surface 444. The rear section 438 may include a generally circular cylindrical segment 439 until the diameter of the casing decreases over a rear trailing surface 446 which intersects the trailing end 434 of the rear casing.

Referring to FIG. 62, the rear casing 414 may include a securing mechanism 462 which cooperates with the securing mechanism 460 on the front casing to securely connect the front casing 412 and rear casing 414 together. More particularly the securing mechanism 462 on the front section of the rear casing may be a screw thread which mates with the screw thread 460 on the outside of casing 412.

The housing formed by the front 412 and rear casings 414 may be used to contain components for various types of drill cartridges. For example, the housing may contain a collection of components (i.e., mechanical and/or electrical devices and chemical compounds and/or mixtures) such that the drill cartridge forms a blank ammunition cartridge. In another example, the housing may contain a collection of components such that the drill cartridge forms a non-lethal projectile training ammunition cartridge. For example, the drill cartridge may contain a primer, a charge, and a projectile that is filled with a colored marking compound (e.g., a paintball). In the preferred embodiment, the housing may contain components for a light emitting dry fire training device. For instance, the front and rear casing may cooperate to house a laser module 74, a power supply 78, a laser module activation system 54, 64, 66, 68, or other components. In a preferred embodiment, the drill cartridge 400 may have front and rear casings that house a light emitting dry fire training device as disclosed and described in co-pending patent application Ser. No. 13/008,234 filed on Jan. 18, 2011, which is incorporated by reference herein in its entirety.

Referring to FIGS. 61, 7, 8 and 9, certain internal components of the drill cartridge may be housed within the front casing 412 and other internal components may be housed in the rear casing 414. For instance, these components may include a light emitting dry fire training device which includes a lens 57, a striking pad 54, an energy absorbing material 64, a conductive material 66, a control circuit 68, a control circuit bias 70, a securing element 72, an illuminator 74, a resilient member 76, a power supply 78 (which may include one or more batteries 80), an attachment element 82, and an attachment indicator 84. The dry fire training device may emit emissions of light 86 having a predominant wavelength of approximately 635 nm. In addition, the dry fire training device may emit another emission of light 88 having a predominant wavelength of approximately 780 nm. A detailed discussion of the structure and operation of these components and of a dry fire training device is described in co-pending patent application Ser. No. 13/008,234 filed on Jan. 18, 2011, which is incorporated by reference herein in its entirety.

The front 412 and rear 414 casing may be tubular and formed from an electrically conducting material in order to accommodate the structure, arrangement, and functional interaction of any internal components. For instance, the front and rear casing may be from aluminum or corrosion resistant steel (e.g., stainless steel AISI 304). Dimensions for the front and rear casing of FIG. 57 are identified in FIG. 62 and exemplary values for these dimensions are provided in Table 12A.

TABLE 12A 9 mm/.223 Caliber Drill Cartridge Front and Rear Casings

| Dimension | Upper Value (mm) | Lower Value (mm) | Upper Preferred Value (mm) | Lower Preferred Value (mm) | Most Preferred Value (mm) |
|---|---|---|---|---|---|
| D40 | 8.75 | 8.65 | 8.75 | 8.65 | 8.70 |
| D41 | 9.33 | 9.27 | 9.32 | 9.28 | 9.30 |
| D43 | 9.44 | 9.4 | 9.43 | 9.41 | 9.42 |
| D44 | — | — | — | — | 7.10 |
| D45 | — | — | — | — | 7.70 |
| D46 | — | — | — | — | 8.20 |
| D47 | 9.44 | 9.4 | 9.43 | 9.41 | 9.42 |
| D48 | 9.5 | 3 | 5.15 | 5 | 5.10 |
| D49 | 8.6 | 7.5 | 8.6 | 8.4 | 8.5 |
| D50 | 9.62 | 7.5 | 9.62 | 9.58 | 9.6 |
| L34 | 25.30 | 25 | 25.30 | 25.20 | 25.25 |
| L35 | — | — | — | — | 25.50 |
| L36 | — | — | — | — | 20.00 |
| L37 | 18.15 | 1 | 5.80 | 6.00 | 5.9 |
| L38 | — | — | — | — | 3.25 |
| L39 | 18.15 | 1 | 13.20 | 13 | 13.10 |
| L39A | 37 | 2.5 | 3.70 | 3.50 | 3.60 |

The drill cartridge of FIG. 57 may have a length LT that allows the drill cartridge to be manually inserted into an open breech of a firearm chamber without stripping the weapon or loading the drill cartridge from a magazine. Additionally, the drill cartridge 400 may have a first portion that simulates at least a part of the bullet that the drill cartridge is simulating. Further, the drill cartridge 400 may have another portion that simulates at least a part of the cartridge case that the drill cartridge is simulating. In a preferred embodiment, the 9 mm/223 caliber drill cartridge may include a first part that has a profile with a cross-section having an effective diameter DA that is less than or equal to the cross-section of the corresponding cartridge for which the firearm was chambered. Also, the drill cartridge 400 may have an effective length LR measured from the rear end of the drill cartridge to the location on the drill cartridge that seats against the chamber wall or barrel face when the drill cartridge is loaded into the chamber of the firearm.

Figure 64:
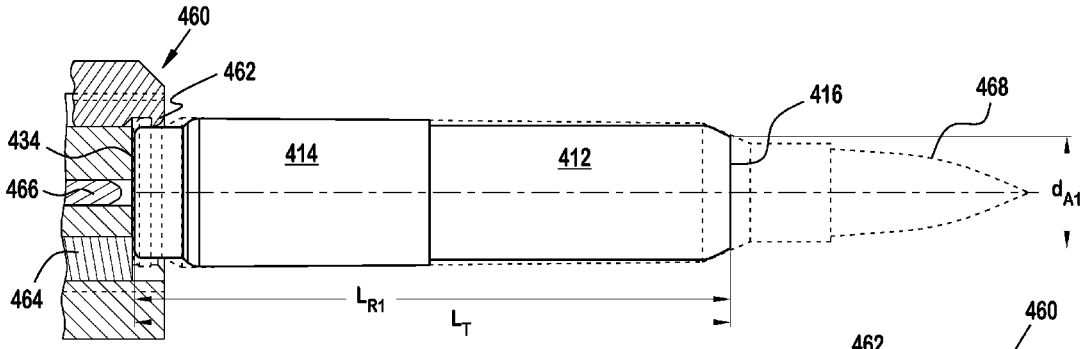
FIG. 64 shows a side view of the drill cartridge of FIG. 57 along with a silhouette of a .223 Remington Cartridge.
Figure 65:
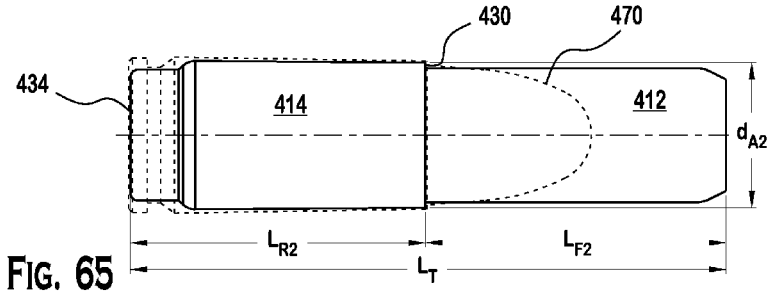
FIG. 65 shows a side view of the drill cartridge of FIG. 57 along with a silhouette of a 9 mm cartridge and a cross-sectional view of the bolt assembly of FIG. 64A.
Figure 64A:
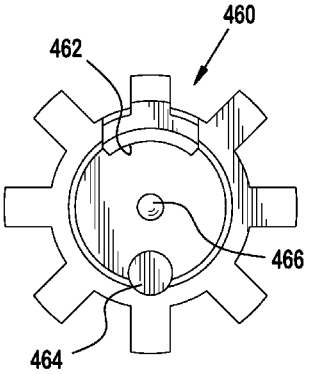
FIG. 64A shows a front view of a bolt assembly of an M-16 rifle.
Figure 75:
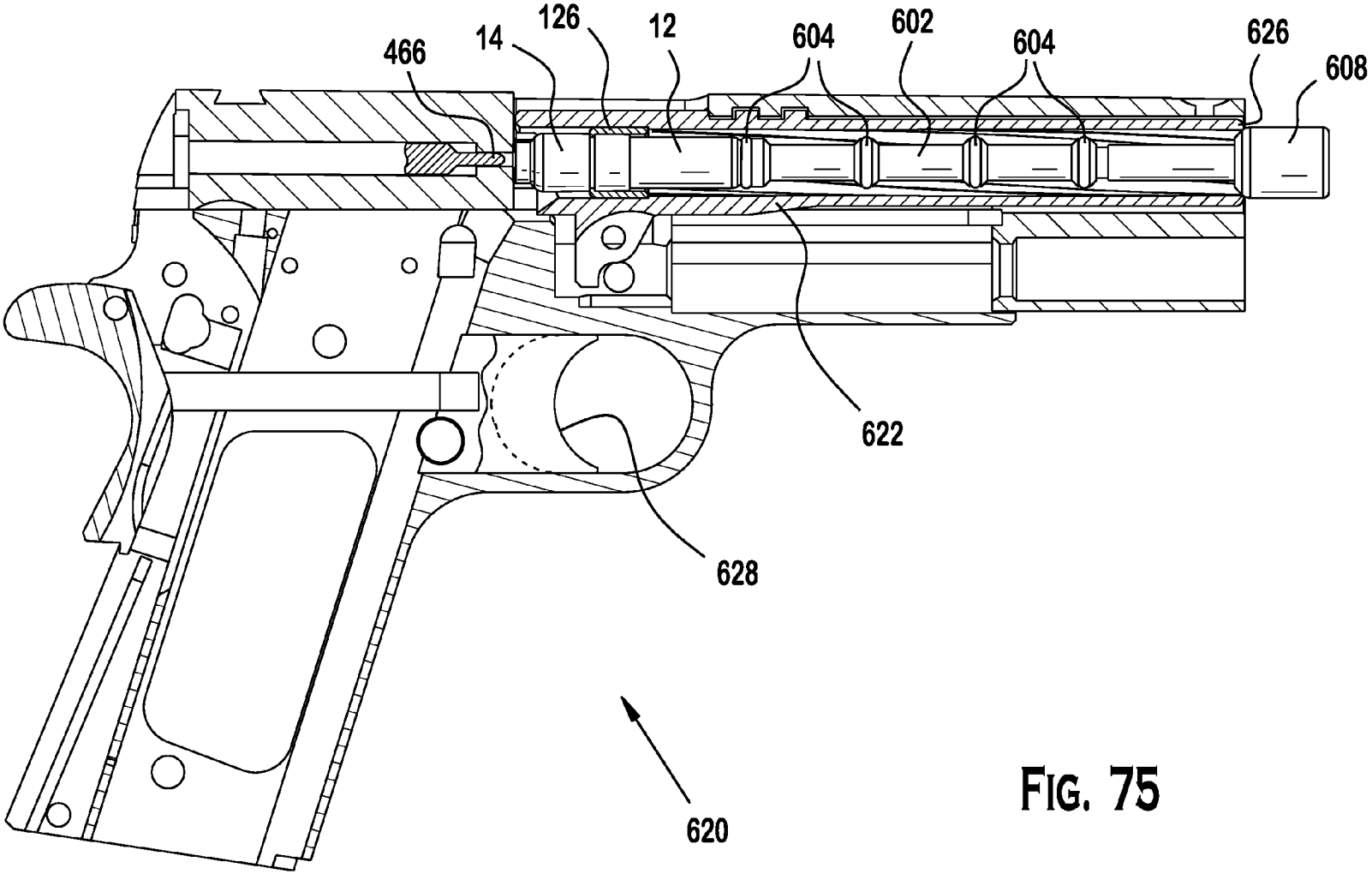
FIG. 75 shows a cross-sectional view of the firearm of FIG. 74, along with a side view of the exemplary embodiment of the drill cartridge that houses a dry fire training device, a cartridge adaptor, and a retaining pipe assembly of FIG. 74.
Figure 76:
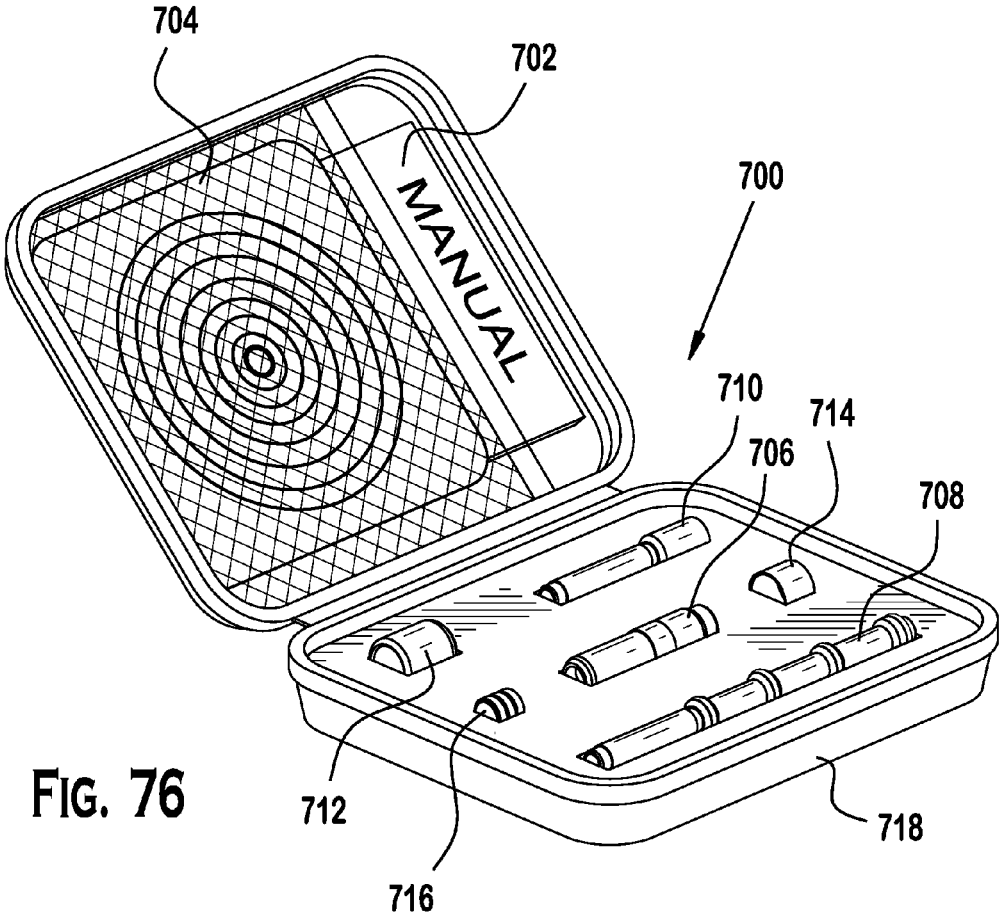
FIG. 76 shows an exemplary embodiment of a dry fire training device kit.

The drill cartridge of FIG. 57 may be configured and dimensioned to operatively fit within the chamber of a 9 mm pistol as well as a rifle which is configured to fire .223 caliber cartridges. Accordingly, the dimensions of the drill cartridge 400 are suitable for use in the chamber of both of these weapon types. For example, as illustrated in FIG. 64, the effective length (LR1) of the drill cartridge 400 in the chamber of a .223 rifle is measured from the rear end 434 of the rear casing to the leading edge 416 of the front casing, as the leading edge of the drill cartridge 400 will rest against the a face of the chamber. The effective diameter (DA1) in this configuration is the outer dimension of the leading edge 416 of the front casing, as the leading side surface 426 bears on the chamber face. In this embodiment, LR1 is 38.35 mm and DA1 is 7.10 mm. In FIG. 64, a profile of a .223 Remington cartridge 468 is depicted to illustrate similarities of drill cartridge 400 and the profile of the .223 Remington cartridge 468. By contrast, in FIG. 65 the effective length (LR2) of the drill cartridge in the chamber of a 9 mm pistol is measured from the rear end 434 of the rear casing to the outer annular surface 430 of the front casing, as the outer annular surface 430 of the drill cartridge rests against a face of the chamber. See e.g., FIG. 75. The effective diameter (DA2) in this configuration is the outer dimension of the outer annular surface 430. In this embodiment, LR2 is 19.00 mm and DA2 is 9.30 mm. In FIG. 65, a profile of a 9 mm cartridge 470 is depicted to illustrate similarities of the drill cartridge 400 and the profile of the 9 mm cartridge 470. In this manner, the drill cartridge is configured and adapted to manifest a first effective length and effective diameter (as shown in FIG. 64) when positioned in a barrel chambered for a .223 caliber cartridge and to manifest a second effective length and a second effective diameter (as shown in FIG. 65) when positioned in a barrel chambered for a 9 mm cartridge.

Moreover, to operate reliably and reduce operational stresses acting on the firing pin and drill cartridge, the drill cartridge 400 may be positioned within the firearm chamber such that the striking pad is generally centrally aligned with the firing pin 466 of the firearm and may be spaced from the firing pin. Also, the front casing may be securely positioned centrally about the central axis of the firearm barrel when the drill cartridge is chambered to provide improved accuracy in drills simulating live fire. Hence, one or more O-rings 425 may be positioned on the casing of the drill cartridge 400 to further stabilize and assist in aligning the drill cartridge in the chamber so that it is seated correctly and securely.

Additionally, the rear end of the drill cartridge 400 of FIG. 57 may be configured and adapted to neutralize the cartridge extraction mechanism of each firearm. For example, the rimless rear end is designed to avoid the extractor of a 9 mm pistol. Also, the rear surface 434 of the drill cartridge may be configured and dimensioned to neutralize the ability of an extractor system in a rifle chambered for a 0.233 cartridge to eject the drill cartridge. For example, when chambered in an AR-15, M-16 or M-4 rifle the rear surface 434 of the drill cartridge may be configured and dimensioned to rest fully on the ejection pin 464 of the bolt assembly 460 while avoiding engagement of the extractor 462. The configuration of the rear end of the drill cartridge 400 (e.g., D48, D49, D50 and L39A) enables the ejection pin 464 of the bolt assembly 460 to apply a stable, linear force to the rear end 434 of the drill cartridge 400, which enables the drill cartridge 400 to seat correctly and securely in the chamber. Thus, the drill cartridge of FIG. 57 is a multiple caliber training device that may be used without modification in either a 9 mm chambered pistol or a .223 chambered rifle. Exemplary dimensions for the 9 mm & .223 Caliber drill cartridge of FIG. 57 are presented in Table 13A.

TABLE 13A 9 mm/.223 Caliber Drill Cartridge

| Dimension | Upper Value (mm) | Lower Value (mm) | Upper Preferred Value (mm) | Lower Preferred Value (mm) | Most Preferred Value (mm) |
|---|---|---|---|---|---|
| LT | 38.50 | 38.20 | 38.40 | 38.30 | 38.35 |
| LR | 19.15 | 18.85 | 19.10 | 18.90 | 19.00 |
| LF | 19.40 | 19.20 | 19.35 | 19.25 | 19.30 |
| DA | 9.33 | 9.27 | 9.32 | 9.28 | 9.30 |

Figure 66:
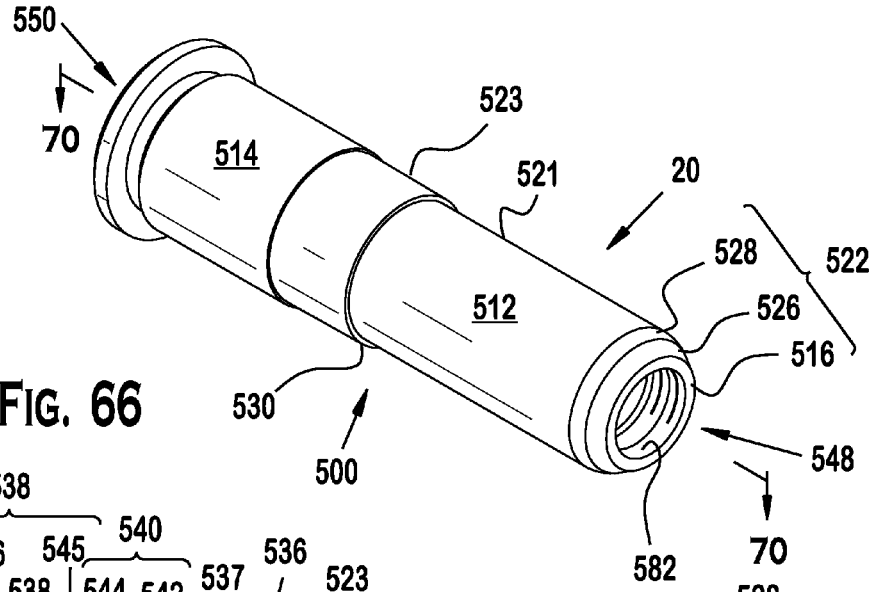
FIG. 66 shows a perspective view of another embodiment of the drill cartridge of the present invention.
Figure 67:
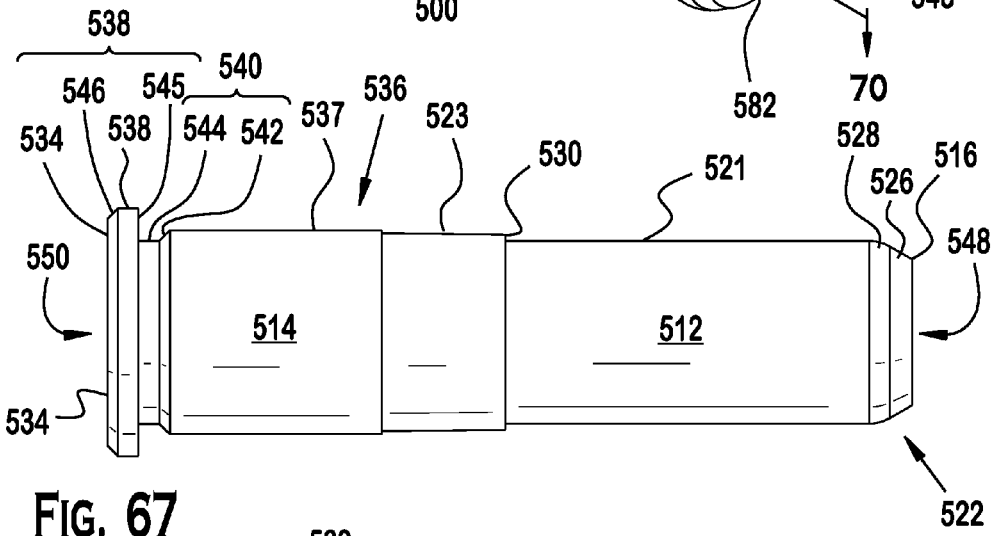
FIG. 67 shows a side view of the device of FIG. 66.
Figure 68:
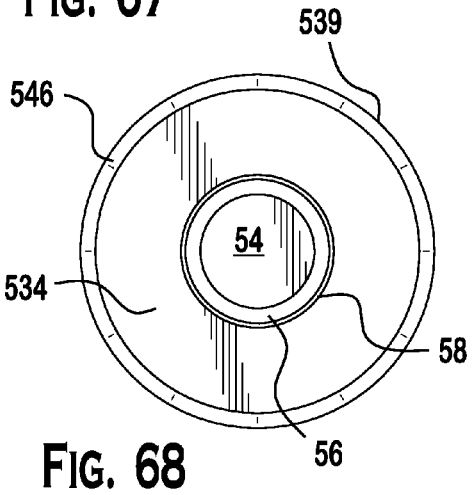
FIG. 68 shows a rear view of the device of FIG. 66.
Figure 69:
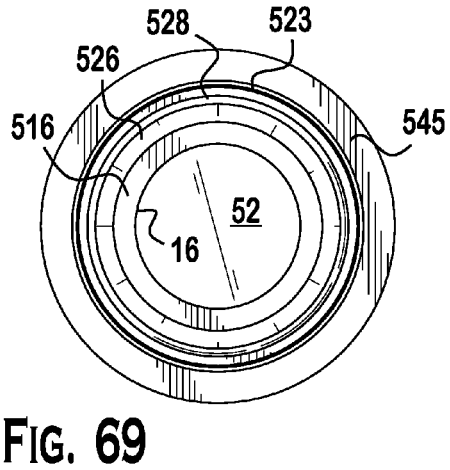
FIG. 69 shows a front view of the device of FIG. 66.
Figure 70:
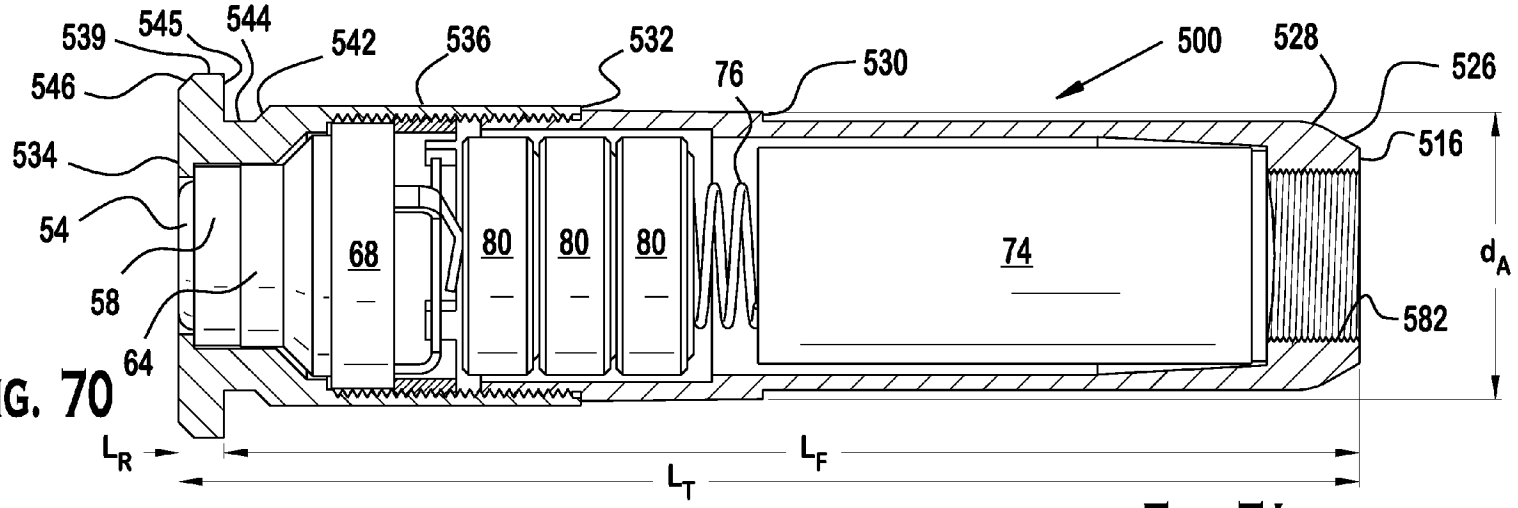
FIG. 70 shows a cross-sectional view of the device of FIG. 66 along line 70-70.

FIG. 67 presents another embodiment of a drill cartridge 500 of the present invention. In this embodiment, the drill cartridge 500 is suitable for use in a .38 caliber revolver. The drill cartridge may include a front casing 512 and a rear casing 514 which cooperate to form a housing for internal components of the drill cartridge. In the embodiment shown in FIG. 66, the drill cartridge 500 has a front casing that is identical to the front casing described in connection with the 9 mm and .223 caliber drill cartridge 400. Still, the front casing of the 9 mm device of either FIG. 1 or FIG. 39 may be used.

Figure 71:
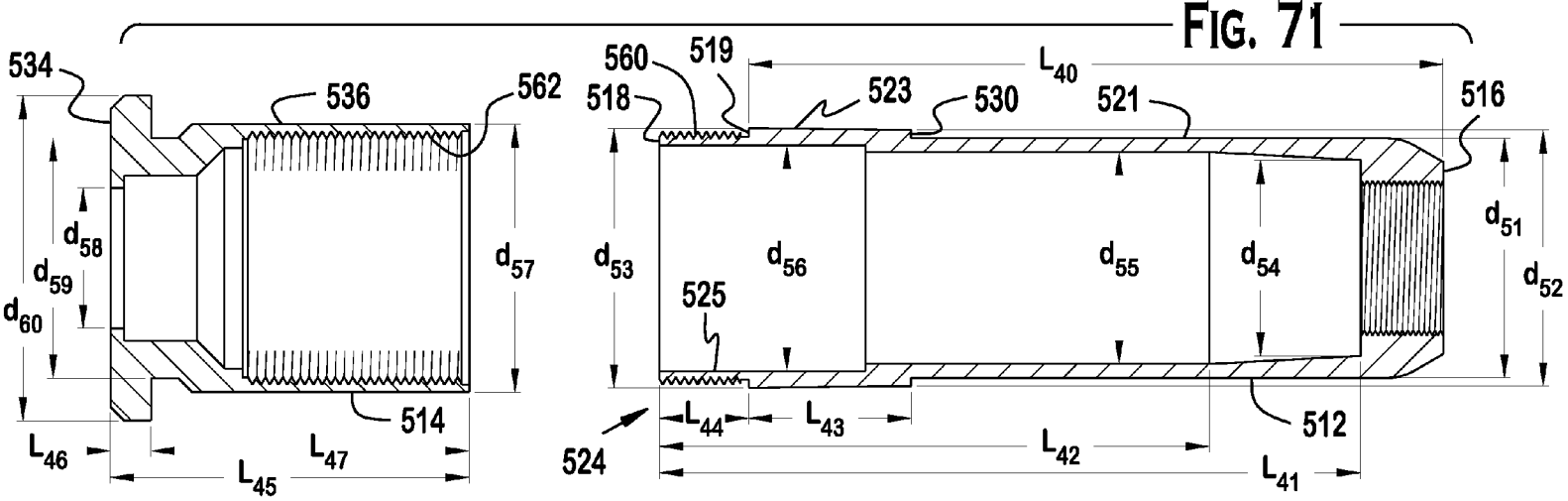
FIG. 71 shows an exploded view of the housing of FIG. 70.

Referring to FIGS. 66-72, the front casing 512 may have a leading edge 516 and a trailing edge 518 (See FIG. 71). The front casing may include a front section 522, intermediate section 520, and a rear section 524 (See FIG. 71). The front section 522 may include a front face 516 that defines a leading edge of the front casing, a leading side surface 526, and a front side transition surface 528. The intermediate section 520 of the front casing 512 may include a cylindrical portion 521 having generally uniform dimension. The rear section may include another cylindrical portion 523 having generally uniform dimension and a rear projection 525 (See FIG. 71) of generally lesser outer dimension than the other cylindrical portion 521. The rear projection 525 further may include a securing element 562 for connecting with the rear casing 514. For example, the securing mechanism 562 may be a screw thread that is disposed on the outside of the rear projection. The transition between the intermediate section 520 of the front casing and the rear section 524 of the front casing may include a surface 530 extending between the cylindrical portion 521 and the other cylindrical portion 523. The surface 530 may form an outer annular surface.

The rear casing may be a series of cylindrical segments of varying diameter that are disposed between a leading end 532 and a trailing end 534. For example, the rear casing may include a front section 536, a rear section 538, and an intermediate section 540. The front section 536 may include a cylindrical front segment 537 of generally uniform diameter from the leading end of the rear casing 532 to a point where the generally uniform diameter changes. The intermediate section 540 may include the portion of the rear casing in which the outer diameter of the rear casing decreases from the generally uniform diameter of the front segment until reaching an intermediate cylindrical portion 544 having a generally uniform diameter less than the generally uniform diameter of the front segment 537. For example, the intermediate section 540 may include a rear transition surface 542 and a rear extension surface 544. The rear section 538 may include yet another cylindrical portion 539 having a generally uniform diameter, a rear transition surface 546 having a cylindrical portion having decreasing diameter, and the trailing end 534. The rear section 540 may further include a surface 545 extending between the rear extension surface 544 and the cylindrical portion 539.

Figure 72:
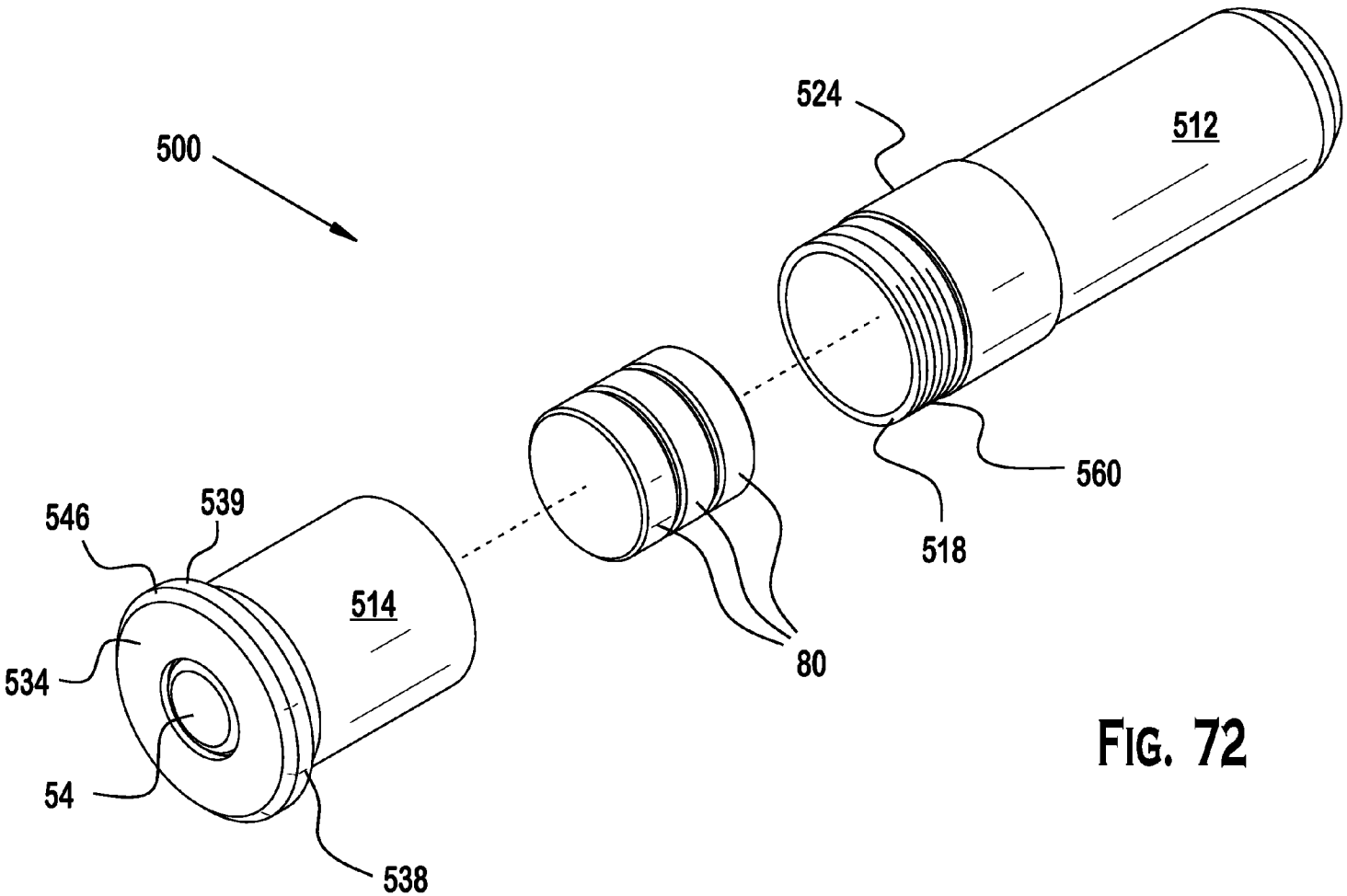
FIG. 72 shows a partially exploded view of the drill cartridge of FIG. 66.

Referring to FIGS. 71-72, the rear casing 514 may include a securing mechanism 562 which cooperates with the securing mechanism 560 on the front casing to securely connect the front casing 512 and rear casing 514 together. For example, the securing mechanism 562 on the front section of the rear casing may be a screw thread which mates with the screw thread 560 on the outside of casing 512.

The housing formed by the front 512 and rear casings 514 may be used to contain components for various types of drill cartridges. For example, the housing may contain a collection of components (i.e., mechanical and/or electrical devices and chemical compounds and/or mixtures) such that the drill cartridge forms a blank ammunition cartridge. In another example, the housing may contain a collection of components such that the drill cartridge forms a non-lethal projectile training ammunition cartridge. For example, the drill cartridge may contain a primer, a charge, and a projectile that is filled with a colored marking compound (e.g., a paintball). In the preferred embodiment, the housing may contain components for a light emitting dry fire training device. For instance, the front and rear casing may cooperate to house a laser module, a power supply, a laser module activation system or other components. In a preferred embodiment, the drill cartridge of the present invention may have front and rear casings that house a light emitting dry fire training device as disclosed and described in co-pending patent application Ser. No. 13/008,234 filed on Jan. 18, 2011, which is incorporated by reference herein in its entirety.

Referring to FIGS. 71, 10, 11 and 12, certain internal components of the drill cartridge may be housed within the front casing 512 and other internal components may be housed in the rear casing 514. For instance, these components may include a lens 57, a striking pad 54, an energy absorbing material 64, a conductive material 66, a control circuit 68, a control circuit bias 78, a securing element 72, an illuminator 74, a resilient member 76, a power supply 78 (which may include one or more batteries 80), an attachment element 82, and an attachment indicator 84. The dry fire training device may emit emissions of light 86 having a predominant wavelength of 650 nm. In addition, the dry fire training device may emit another emission of light 88 having a predominant wavelength of 780 nm.

A detailed discussion of the structure and operation of these components and of a dry fire training device is described in co-pending patent application Ser. No. 13/008,234 filed on Jan. 18, 2011, which is incorporated by reference herein in its entirety.

The front 512 and rear 514 casing may be tubular and formed from an electrically conducting material in order to accommodate the structure, arrangement, and functional interaction of any internal components. For instance, the front and rear casing may be from aluminum or corrosion resistant steel (e.g., stainless steel AISI 304). Dimensions for the front and rear casing of FIG. 66 are identified in FIG. 72 and preferred values for these dimensions are provided in Table 14A.

TABLE 14A

.38 Caliber Drill Cartridge Front and Rear Casings

| Dimension | Upper Value (mm) | Lower Value (mm) | Upper Preferred Value (mm) | Lower Preferred Value (mm) | Most Preferred Value (mm) |
|---|---|---|---|---|---|
| D51 | 8.75 | 4.5 | 8.75 | 8.65 | 8.65 |
| D52 | 9.65 | 9.1 | 9.65 | 9.55 | 9.60 |
| D53 | 9.72 | 9.1 | 9.75 | 9.68 | 9.72 |
| D54 | — | — | — | — | 7.10 |
| D55 | — | — | — | — | 7.70 |
| D56 | — | — | — | — | 8.20 |
| D57 | 9.72 | 9.60 | 9.72 | 9.68 | 9.72 |
| D58 | 9.5 | 3 | 5.15 | 5 | 5.10 |
| D59 | 9.72 | 4 | 8.8 | 8.50 | 8.72 |
| D60 | 11.20 | 9.8 | 11.10 | 10.90 | 11.00 |
| L40 | 38.4 | 11.5 | 25.30 | 25.20 | 25.25 |
| L41 | — | — | — | — | 25.50 |
| L42 | — | — | — | — | 20.00 |
| L43 | 38.4 | 1 | 5.80 | 6.00 | 5.90 |
| L44 | — | — | — | — | 3.25 |
| L45 | 37.4 | 1 | 13.20 | 13 | 13.10 |
| L46 | 1.55 | 1.45 | 1.55 | 1.45 | 1.5 |
| L47 | — | — | 11.65 | 11.55 | 11.60 |

The .38 caliber drill cartridge of FIG. 66 may have a length LT that allows the drill cartridge to be manually inserted into a revolver cylinder without stripping the weapon. Additionally, the .38 caliber drill cartridge may have a first portion that simulates at least a part of the bullet that the drill cartridge is simulating. Further, the .38 caliber drill cartridge may have another portion that simulates at least a part of the cartridge case that the drill cartridge is simulating. In a preferred embodiment, the .38 caliber drill cartridge may include a first part that has a profile with a cross-section having an effective diameter DA that is less than or equal to the cross-section of the corresponding cartridge for which the firearm was chambered. Also, the .38 caliber drill cartridge may have an effective length LR measured from the rear end of the drill cartridge to the location on the drill cartridge that seats against the chamber wall or barrel face when the drill cartridge is loaded into the chamber of the firearm. Preferred dimensions for the .38 caliber drill cartridge are identified in FIG. 71 and are presented in Table 14B.

TABLE 14B

.38 Caliber Drill Cartridge

| Dimension | Upper (mm) | Lower (mm) | Preferred Upper (mm) | Preferred Lower (mm) | Most Preferred (mm) |
|---|---|---|---|---|---|
| LT | 39.4 | 20 | 38.2 | 38.5 | 38.35 |
| LR | — | — | 1.55 | 1.45 | 1.5 |
| DA | 9.72 | 9 | 9.65 | 9.65 | 9.65 |

Figure 73:
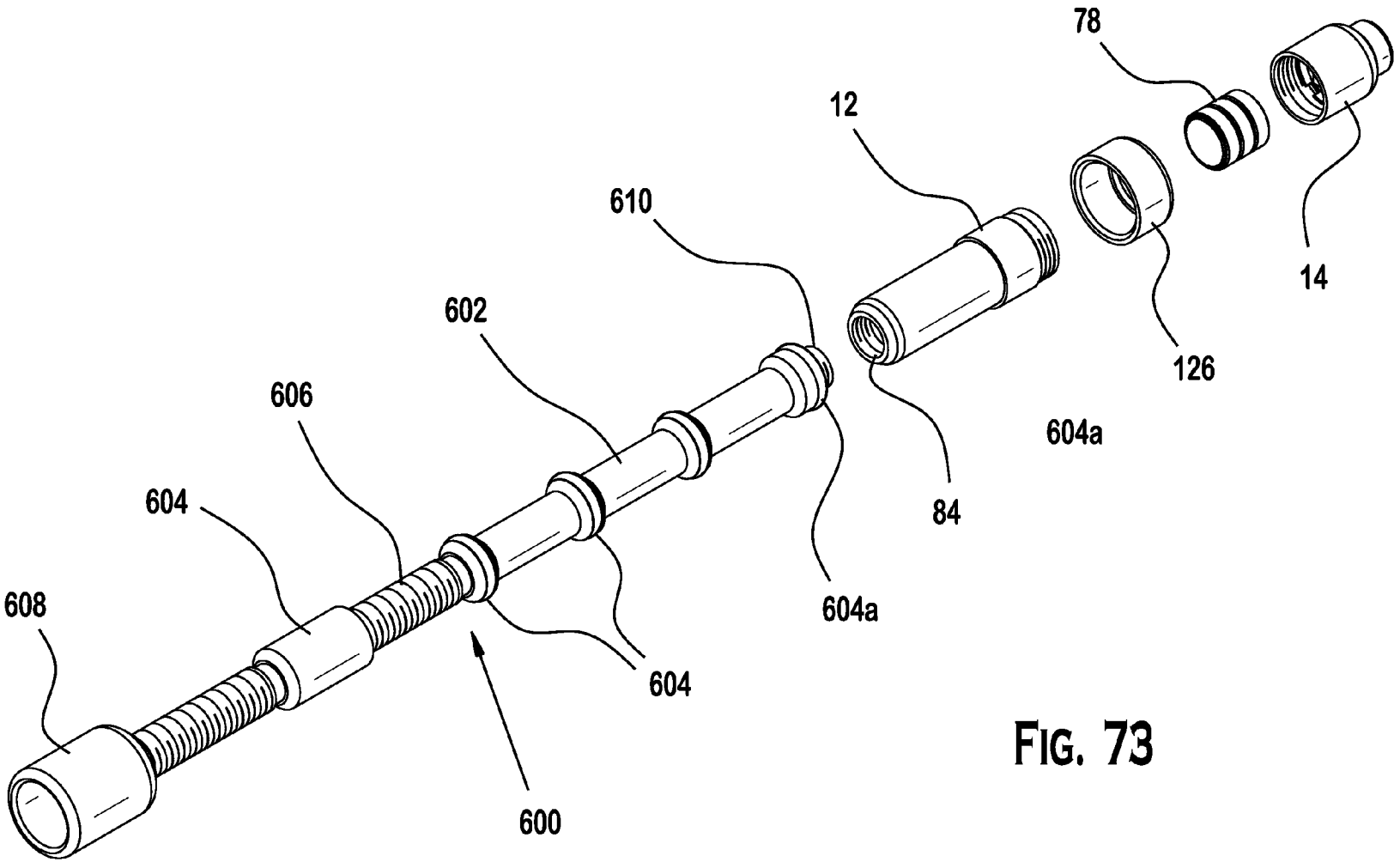
FIG. 73 shows a partially exploded view of an exemplary embodiment of a drill cartridge that houses a light emitting dry fire training device, a cartridge adaptor, and a retaining pipe assembly of the present invention.

Referring to FIG. 73, a retaining pipe 602 may be connected to an attachment element 84 on the drill cartridge 10, 300, 400. The retaining pipe also may be connected to one or more modular extension(s) 604 with attachment element 606. Further, the attachment element 606 may accommodate a reversible beveled fastener 608. The reversible beveled fastener 608 may be tubular and the through bore may have an internal screw threading extending from one end of the bore to the other. Additionally both sides of the fastener 608 may be beveled. The fastener body 608 may be installed on the retaining pipe 602 from both sides of the fastener.

One or more O-rings 604 may be placed on the retaining pipe 602 in order to prevent contact with the barrel 33 when deployed inside a firearm barrel 33. This serves the purpose of preventing damage to the retaining pipe 602 and to the barrel in which it is installed. Also, an O-ring 604A may be installed at the end of the retaining pipe 602 near the connecting threading to the dry fire training device. This O-ring 604A prevents self tightening and eventual partial locking of the retaining pipe assembly 600 to the front casing of the drill cartridge 10, 300, 400 as the result of vibrations from normal use of the drill cartridge assembly as illustrated with the .45 ACP cartridge adaptor 126.

Figure 77:
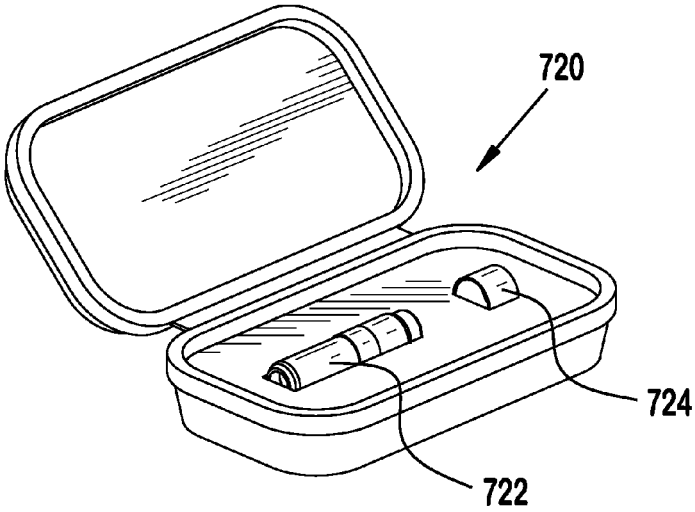
FIG. 77 shows another embodiment of a dry fire training device kit.

FIG. 77 shows a kit 700 that includes a drill cartridge 706 and a cartridge adaptor 714 of the present invention. The kit further includes a user manual 702, a reflective target 704, a drill cartridge 706, a retaining pipe 708, a retaining pipe extension 710, a beveled fastener 712, a cartridge adaptor 714, a power supply 716, and a case 718. In a preferred embodiment of the kit, the drill cartridge is a 9 mm drill cartridge of FIG. 1 that contains a light emitting dry fire training device as disclosed in co-pending patent application Ser. No. 13/008,234 filed on Jan. 18, 2011, which is incorporated by reference herein in its entirety.

FIG. 78 shows another kit 720 that includes a drill cartridge 722 and a cartridge adaptor 724 of the present invention in a case. In a preferred embodiment, the drill cartridge is a 9 mm and .223 drill cartridge of FIG. 61 that contains a light emitting dry fire training device as disclosed in co-pending patent application Ser. No. 13/008,234 filed on Jan. 18, 2011, which is incorporated by reference herein in its entirety.

Figure 74:
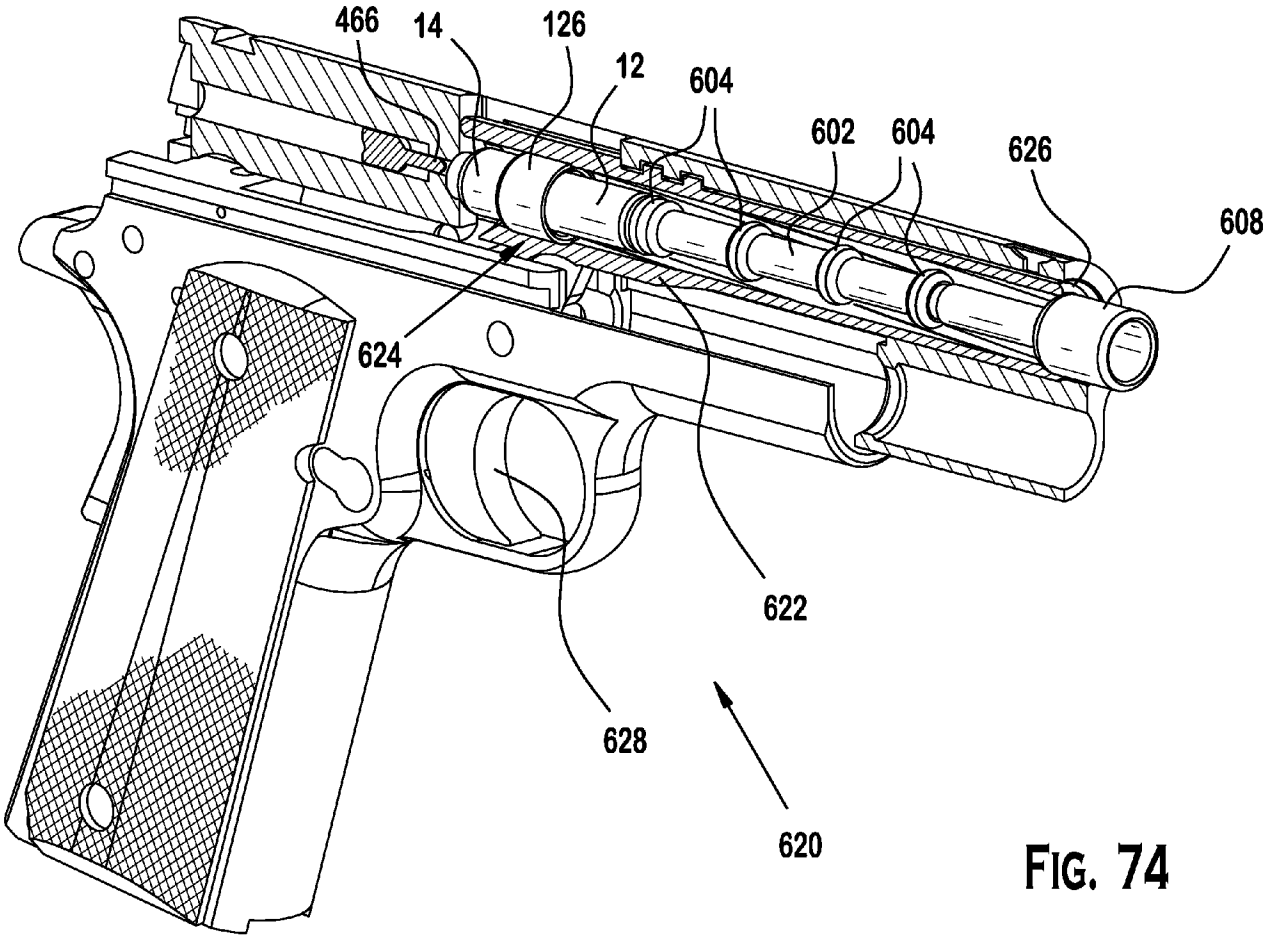
FIG. 74 shows a partial sectional view of a firearm, as well as a exemplary embodiment of a drill cartridge that houses a dry fire training device, a cartridge adaptor assembly, and a retaining pipe assembly of the present invention.

In use, the drill cartridge assembly may be positioned and secured within the barrel of a handgun. Installation of the drill cartridge assembly may be completed as follows: First, a drill cartridge may be selected for use. Next, the drill cartridge may be inspected visually to confirm the structural integrity of the housing, and the striking pad then may be depressed to confirm the operational functionality of the device. The housing may be separated into its component front and rear casing. For example, separating the housing into front and rear casing may involve unscrewing the rear casing from the front casing by turning the front casing and the rear casing in opposite directions about the central axis of the drill cartridge. Once, the rear casing is separated from the front casing, the battery pack 78 may be removed from the front casing. A cartridge adaptor may then be selected and secured to the front casing. For instance a .40 Smith & Wesson cartridge adaptor 102 may be threaded onto the trailing end of the front casing. The cartridge adaptor 102 may be advanced on the securing mechanism 62 of the front casing 12 until the front end 104 of the ring adaptor 102 contacts the trailing edge 18 of the front casing. Once the cartridge adaptor is fully seated on the front casing of the dry fire training device, the battery pack may be inserted into the front casing/cartridge adaptor so that the power supply is disposed within the intermediate section of the front casing in the same manner as it was in its initial configuration as shown in FIGS. 5 and 23-24. The rear casing of the dry fire training device may then be secured to the front casing/cartridge adaptor. For instance, the rear casing 14 may be reattached to the securing mechanism 62 of the front casing 12. Referring to FIG. 24, the rear casing may be screwed onto the trailing end of the front casing and advanced until the leading end of the rear casing contacts the adaptor cartridge to complete the dry fire training device and cartridge adaptor assembly. The dry fire training device and cartridge adaptor assembly may then be inserted into the chamber of the handgun such that the front opening of the front casing is disposed in the barrel of the handgun. As shown in FIGS. 74 and 75, the cartridge adaptor assembly may extend the effective diameter (LR) and effective length (DA) of the drill cartridge.

The proximal end of the retaining pipe may be inserted into the opposite end of the barrel to further align and secure the front casing. For instance, the retaining pipe may be connected to the front casing by joining the attachment element on the proximal end of the retaining pipe to the attachment element on the front opening of the drill cartridge assembly. In the preferred embodiment, the front opening of the dry fire training device may include a screw thread, and the end of the retaining pipe may include a mating screw thread such that turning the retaining pipe in a clockwise direction about its longitudinal axis with respect to the dry fire training device advances the retaining pipe into the front opening of the drill cartridge assembly. The retaining pipe may be connected to the front opening of the drill cartridge assembly in this manner, until the O-ring is seated firmly against the front face of the drill cartridge assembly. The retaining fastener then may be attached to the distal end of the retaining pipe or retaining pipe assembly. In a preferred embodiment, the fastener may include a beveled end which is advanced down the retaining pipe or retaining pipe assembly until it contacts the opposite end of the barrel (or muzzle). The fastener is then tightened against the muzzle. As the fastener is tightened against the muzzle, the retaining pipe assembly and drill cartridge assembly are drawn toward the muzzle. As the drill cartridge assembly advances toward the muzzle, the front casing of the drill cartridge assembly is aligned with the central axis of the barrel. Further advancement of the beveled fastener toward the muzzle draws the drill cartridge assembly against the front end of the chamber, which blocks forward movement of the drill cartridge assembly and centers the front casing about the central axis of the barrel. Further tightening of the beveled fastener imparts tension to the retention pipe assembly to fix the position of the drill cartridge assembly within the firearm.

Locking the dry fire training device/cartridge adaptor assembly into the chamber of the handgun in this manner prevents the accidental loading of a live round into the chamber. This feature enhances user safety and allows a wide range of practice drills, including magazine changes. For example, the dry fire training device may be configured (or selectively programmed) to limit the number of light emission events to a specific number (i.e. a set of light emission events) in order to simulate the maximum number of rounds in a magazine that is loaded in the handgun. Accordingly, the user may aim the firearm and depress the trigger to produce a light emission event which simulates the firing of one round of ammunition. The user may repeat these steps to simulate the firing of additional rounds of ammunition. After a specific number of simulated rounds are fired (i.e., a specific number of light emission events are produced), the dry fire training device may cease to generate further light emission events, until the slide is racked to simulate loading a live round from a new magazine into the chamber. Thus, the user may eject the simulated (i.e., "spent") magazine, reload with another simulated (i.e., "loaded") magazine, and rack the slide to simulate loading a new round into the chamber in order to enable the dry fire training system to produce another set of light emission events.

While it has been illustrated and described what at present are considered to be preferred embodiments of the present invention, it will be understood by those skilled in the art that various changes and modifications may be made, and equivalents may be substituted for elements thereof without departing from the true scope of the invention. Additionally, features and or elements from any embodiment may be used singly or in combination with other embodiments. Therefore, it is intended that this invention not be limited to the particular embodiments disclosed herein, but that the invention include all embodiments falling within the scope and the spirit of the present invention.

What is claimed is:

1. A drill cartridge having a first central axis for use in a 9 mm pistol and a .223 caliber rifle that includes a firing pin and a bolt assembly having an ejection pin and an extractor, the drill cartridge comprising:

a rear casing which comprises
- a cylindrical segment, and
- a rear surface adjacent the cylindrical segment, the rear casing being configured and dimensioned such that when the drill cartridge is chambered in a .223 caliber rifle, the rear surface seats fully on the ejection pin and the cylindrical segment avoids engagement with the extractor; and a front casing with a first maximum outer dimension perpendicular to the first central axis, the front casing being connected to the rear casing such that the front and rear casings cooperate to form a housing, the housing being configured and dimensioned for chambering in a 9 mm pistol chamber and in a .223 caliber rifle chamber.

2. The drill cartridge of claim 1, wherein the rear casing further comprises a striking pad adjacent the rear surface, the rear casing being configured and dimensioned such that when the drill cartridge is chambered in the .223 caliber rifle, the striking pad is spaced from and aligned with the firing pin.

3. The drill cartridge of claim 2, wherein the front casing further comprises a first screw thread, the rear casing comprises a second screw thread, and the first screw thread and the second screw thread mate to secure the front casing to the rear casing.

4. The drill cartridge of claim 3, wherein the rear end is configured and dimensioned to cooperate with a firearm cartridge extraction system such that the firearm cartridge extraction system biases the drill cartridge into alignment with a central axis of the firearm barrel.

5. The drill cartridge of claim 4, wherein the housing contains a plurality of internal components such that the plurality of internal components cooperates with the housing to form a dry fire training device.

6. The adaptor assembly of claim 5, wherein the plurality of internal components include a laser diode that is aligned with the first central axis.

7. The adaptor assembly of claim 6, wherein the laser diode has an operable configuration in which the laser diode produces emissions of light having a predominant wavelength between approximately 635 nm and approximately 850 nm.

8. The adaptor assembly of claim 7, wherein the plurality of internal components further comprises a power supply.

9. The adaptor assembly of claim 8, wherein the plurality of internal components further comprises a control circuit for energizing the laser diode, a microcontroller for regulating emissions from the laser diode, and a capacitor electrically connected to the power supply and microcontroller such that the capacitor provides power to the microcontroller when the laser diode produces emissions of light having a predominant wavelength of approximately 650 nm.

10. The drill cartridge of claim 9, further comprising a retaining pipe secured to the front casing.

11. The drill cartridge of claim 10, further comprising a beveled fastener secured to the retaining pipe such that the beveled fastener the retaining pipe, and the front casing are each aligned about the first central axis.

12. The adaptor assembly of the claim 9, wherein the laser diode has another operable configuration in which the laser diode produces emissions of light having a predominant wavelength of about 780 nm.

13. The adaptor assembly of claim 1, wherein the drill cartridge is formed of metal.

14. The adaptor assembly of claim 13, wherein the drill cartridge is formed of stainless steel.

* * * * *